US011413498B2

(12) United States Patent
McIntyre

(10) Patent No.: US 11,413,498 B2
(45) Date of Patent: Aug. 16, 2022

(54) EXERCISE ASSEMBLIES AND METHOD FOR UTILIZING THE SAME

(71) Applicant: Hero Board America LLC, Royal Oak, MI (US)

(72) Inventor: Donald McIntyre, Royal Oak, MI (US)

(73) Assignee: Hero Board America LLC, Royal Oak, MI (US)

( * ) Notice: Subject to any disclaimer, the term of this patent is extended or adjusted under 35 U.S.C. 154(b) by 3 days.

(21) Appl. No.: 16/599,016

(22) Filed: Oct. 10, 2019

(65) Prior Publication Data

US 2021/0106868 A1 Apr. 15, 2021

(51) Int. Cl.
*A63B 22/20* (2006.01)
*A63B 21/00* (2006.01)

(52) U.S. Cl.
CPC ..... *A63B 22/20* (2013.01); *A63B 21/0004* (2013.01)

(58) Field of Classification Search
CPC . A63B 22/20; A63B 21/0004; A63B 21/0552; A63B 21/4037; A63B 21/4045; A63B 23/0488; A63B 23/0216; A63B 2208/0204; A63B 2208/0295; A63B 2209/00
See application file for complete search history.

(56) References Cited

U.S. PATENT DOCUMENTS 3,772,733 A * 11/1973 Stosberg ..... B60B 33/021 16/35 R
D316,281 S * 4/1991 Mirisch, Sr. ..... D34/23
D320,484 S * 10/1991 Wallin ..... D34/23
D351,707 S * 10/1994 Pill ..... D34/12
D401,724 S * 11/1998 Whiteside ..... D34/23
6,926,646 B1 * 8/2005 Nguyen ..... A63B 22/208 48/51
7,438,673 B1 * 10/2008 Jones ..... A63B 23/0488 482/907
9,272,411 B1 * 3/2016 Whiteside ..... B25H 5/00
9,931,535 B2 * 4/2018 Smith ..... A63B 21/4027
11,033,768 B2 * 6/2021 Chuang ..... A63B 23/02
2010/0222180 A1 * 9/2010 Takizawa ..... A63B 21/00178 482/8

(Continued)

FOREIGN PATENT DOCUMENTS

CA 2528548 * 12/2005 ..... A63B 23/035

*Primary Examiner* — Andrew S Lo
*Assistant Examiner* — Andrew M Kobylarz
(74) *Attorney, Agent, or Firm* — Honigman LLP

(57) ABSTRACT

An assembly is disclosed. The assembly is movably-disposed upon an underlying support surface. The assembly includes a body having an upper surface and a lower surface. The body defines a pair of front axle-receiving openings and a pair of rear axle-receiving openings. A front axle member extends through the pair of front axle-receiving openings. A rear axle member extends through the pair of rear axle-receiving openings. A first front wheel is connected to a first end of the front axle member. A second front wheel is connected to a second end of the front axle member. A first rear wheel is connected to a first end of the rear axle member. A second rear wheel is connected to a second end of the rear axle member. The upper surface of the body is pitched at an angle with respect to the underlying support surface. An exercise system is also disclosed. A method is also disclosed.

25 Claims, 43 Drawing Sheets

(56) References Cited

U.S. PATENT DOCUMENTS

| | | | | |
|---|---|---|---|---|
| 2014/0035246 | A1* | 2/2014 | Plotnizky | A61G 5/047 280/87.01 |
| 2014/0336024 | A1* | 11/2014 | Huang | A63B 21/068 482/142 |
| 2017/0144009 | A1* | 5/2017 | Pearce | A63B 21/0004 |
| 2018/0154973 | A1* | 6/2018 | Chen | B62K 1/00 |

* cited by examiner

EXERCISE ASSEMBLIES AND METHOD FOR UTILIZING THE SAME

TECHNICAL FIELD

This disclosure relates to an exercise assemblies and methods for utilizing the same.

BACKGROUND

Exercise assemblies are known. While existing exercise assemblies perform adequately for their intended purpose, improvements to exercise assemblies are continuously being sought in order to advance the arts.

DESCRIPTION OF DRAWINGS

FIG. 7' is a cross-sectional view of another exemplary exercise assembly according to line 7-7 of FIG. 6.

Like reference symbols in the various drawings indicate like elements.

DETAILED DESCRIPTION

Referring to FIGS. 1-10, 11-16, 17-18B, 19-20C, and 21, exemplary assemblies are shown respectively at 10, 100, 200, 300, and 400. Each assembly 10, 100, 200, 300, and 400 may be alternatively referred to as a wheeled assembly. In other instances, each assembly 10, 100, 200, 300, and 400 may be alternatively referred to as an exercise assembly. In yet other instances, each assembly 10, 100, 200, 300, and 400 may be alternatively referred to as a leg exercise assembly (see, e.g., FIGS. 25A-25E/FIGS. 26A-26E), a core exercise assembly, or an abdominal excise assembly (see, e.g., FIGS. 26A-26E/FIGS. 27A-27E).

Referring to FIGS. 1-10, the assembly 10 is generally defined by a body 12. The body 12 may be formed from a plastic material or a metallic material that is injection molded, stamped, cast or otherwise formed by a machine, mold tool or the like. The body 12 generally includes a front edge $\mathbf{12}_F$, a rear edge $\mathbf{12}_R$ a first side edge $\mathbf{12}_{S1}$ that connects the front edge $\mathbf{12}_F$ to the rear edge $\mathbf{12}_R$, and a second side edge $\mathbf{12}_{S2}$ that connects the front edge $\mathbf{12}_F$ to the rear edge $\mathbf{12}_R$.

Figure 5:
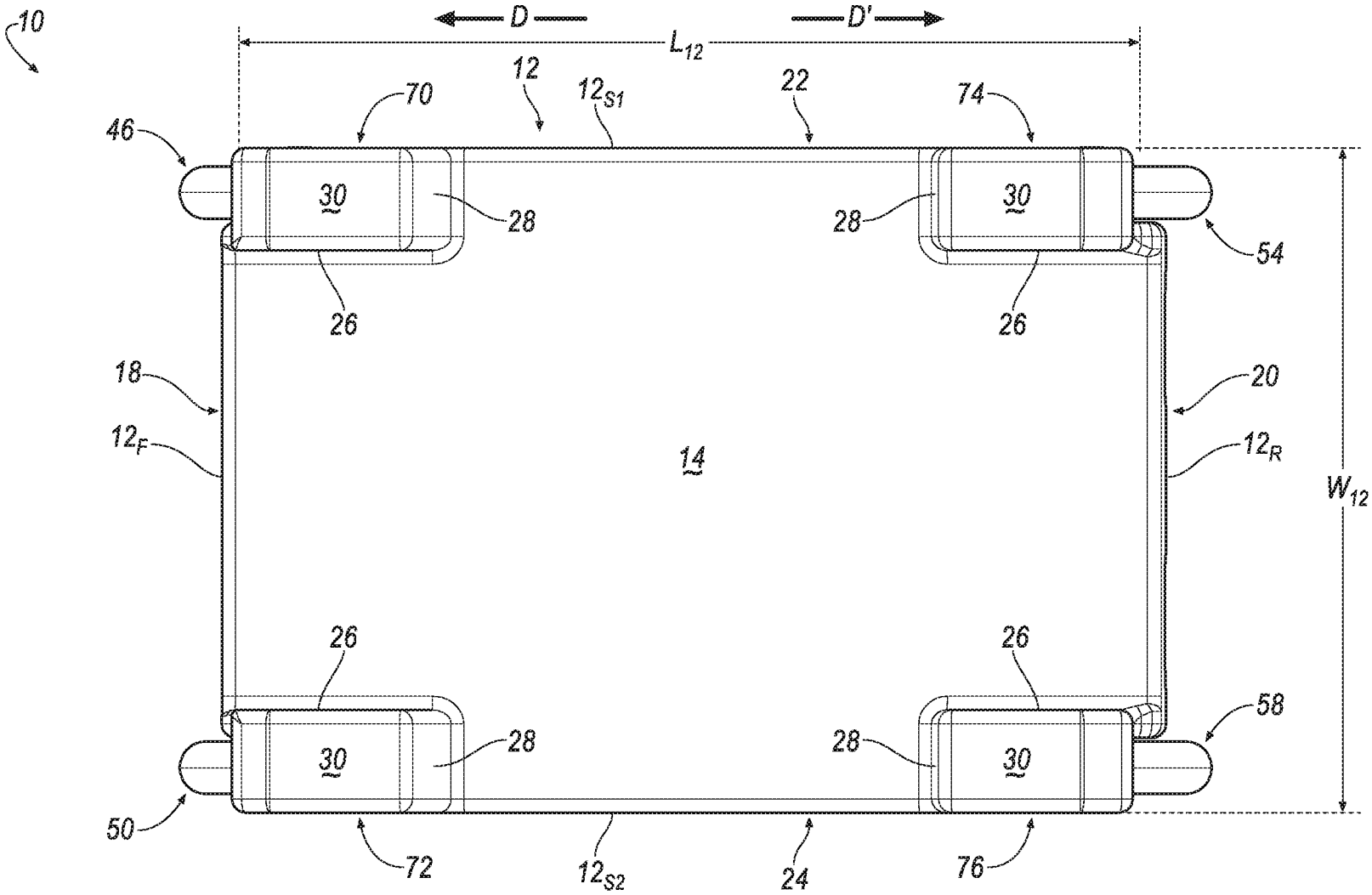
FIG. 5 is a top view of the exercise assembly of FIG. 1.

With reference to FIG. 5, the body 12 is further defined by a length $L_{12}$ extending between the front edge $\mathbf{12}_F$ and the rear edge $\mathbf{12}_R$. The body 12 is also defined by a width $W_{12}$ extending between the first side edge 12*si* and the second side edge $\mathbf{12}_{S2}$. The length $L_{12}$ and the width $W_{12}$ generally defines the body 12 to include a substantially rectangular shape whereby the length $L_{12}$ is greater than the width $W_{12}$; although a rectangular shape is shown at FIG. 5, the body 12 is not limited to a rectangular shape, and may, for example, include configurations such as, for example, a square shape whereby the length $L_{12}$ is equal to the width $W_{12}$. In some examples, the length $L_{12}$ may be approximately equal to two feet (2') and the width $W_{12}$ may be approximately equal to one foot (1').

Figure 6:
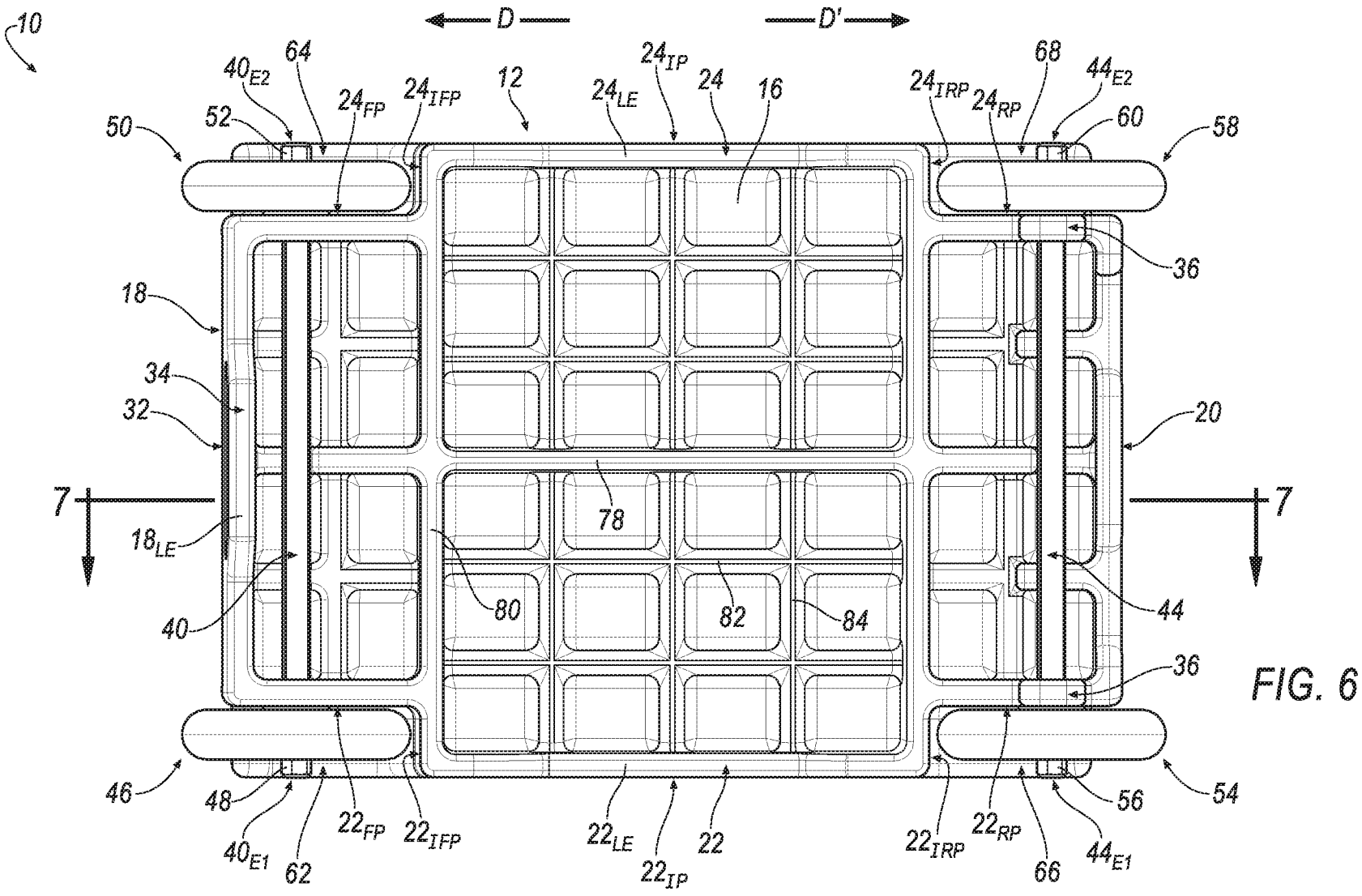
FIG. 6 is a bottom view of the exercise assembly of FIG. 1.
Figure 7:
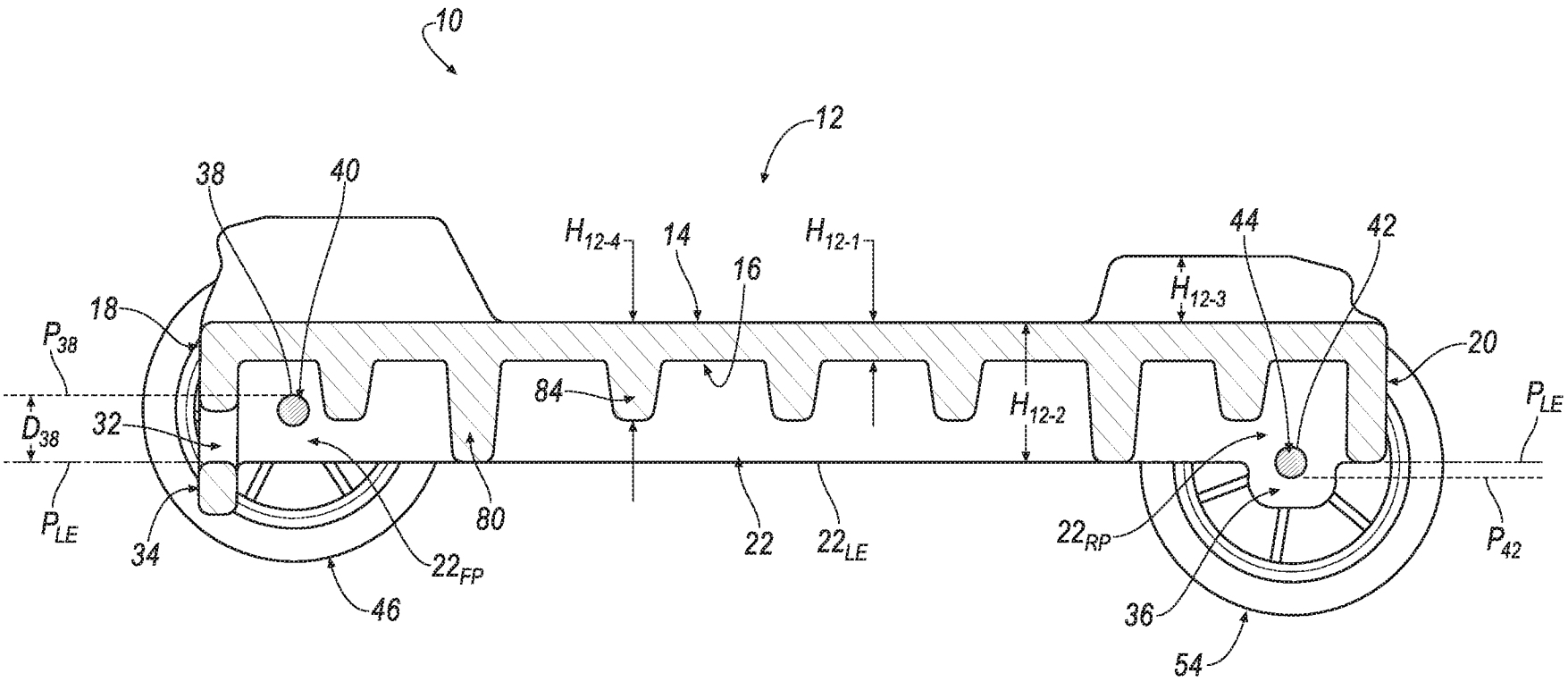
FIG. 7 is a cross-sectional view of the exercise assembly according to line 7-7 of FIG. 6.
Figure 7:
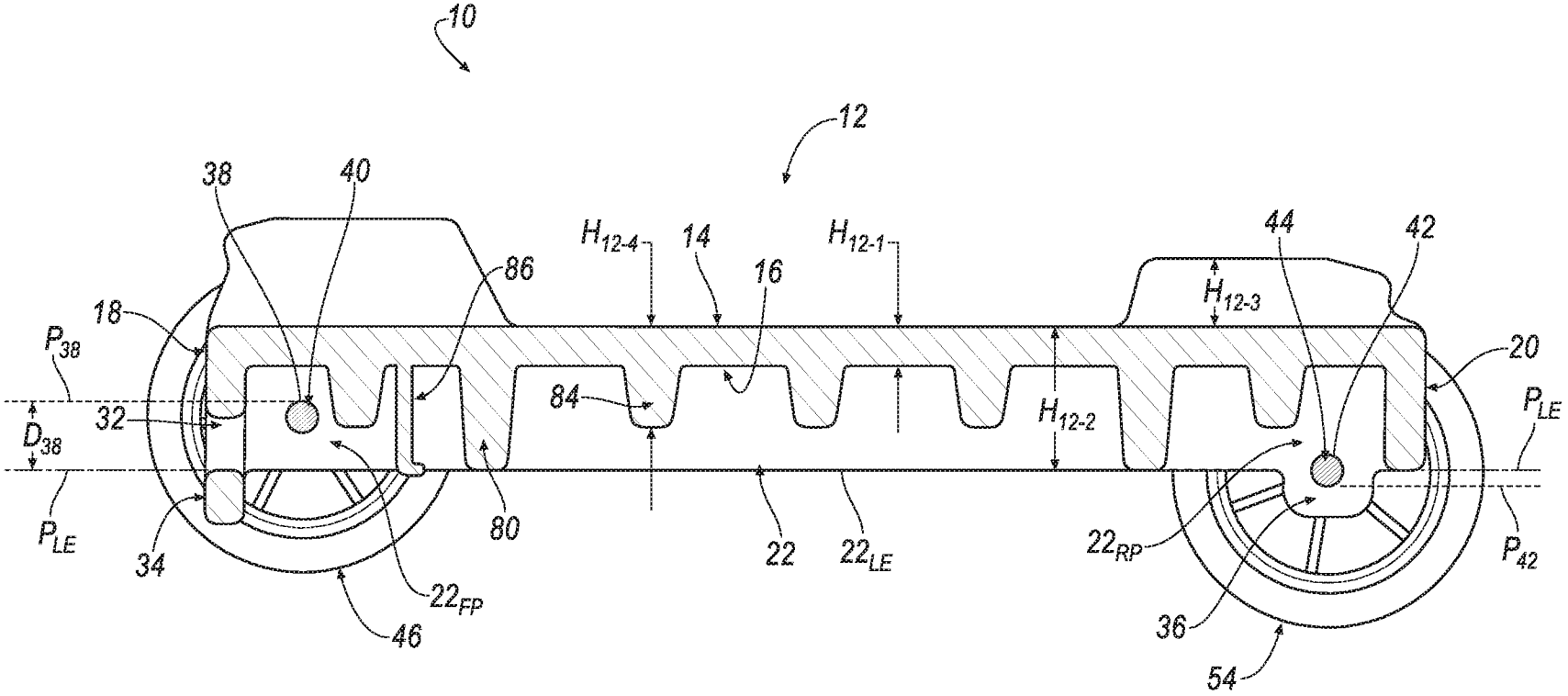
Figure 8:
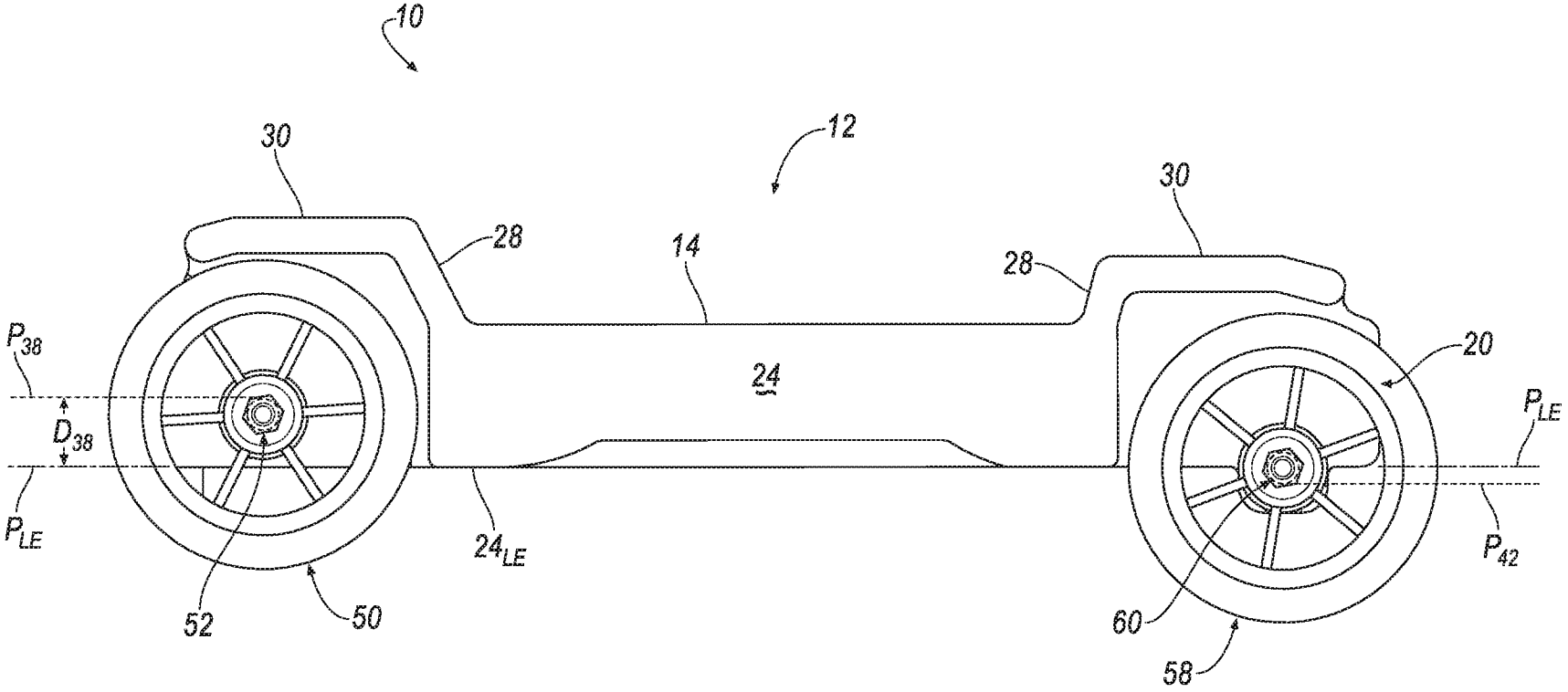
FIG. 8 is a side view of the exercise assembly of FIG. 1.
Figure 9:
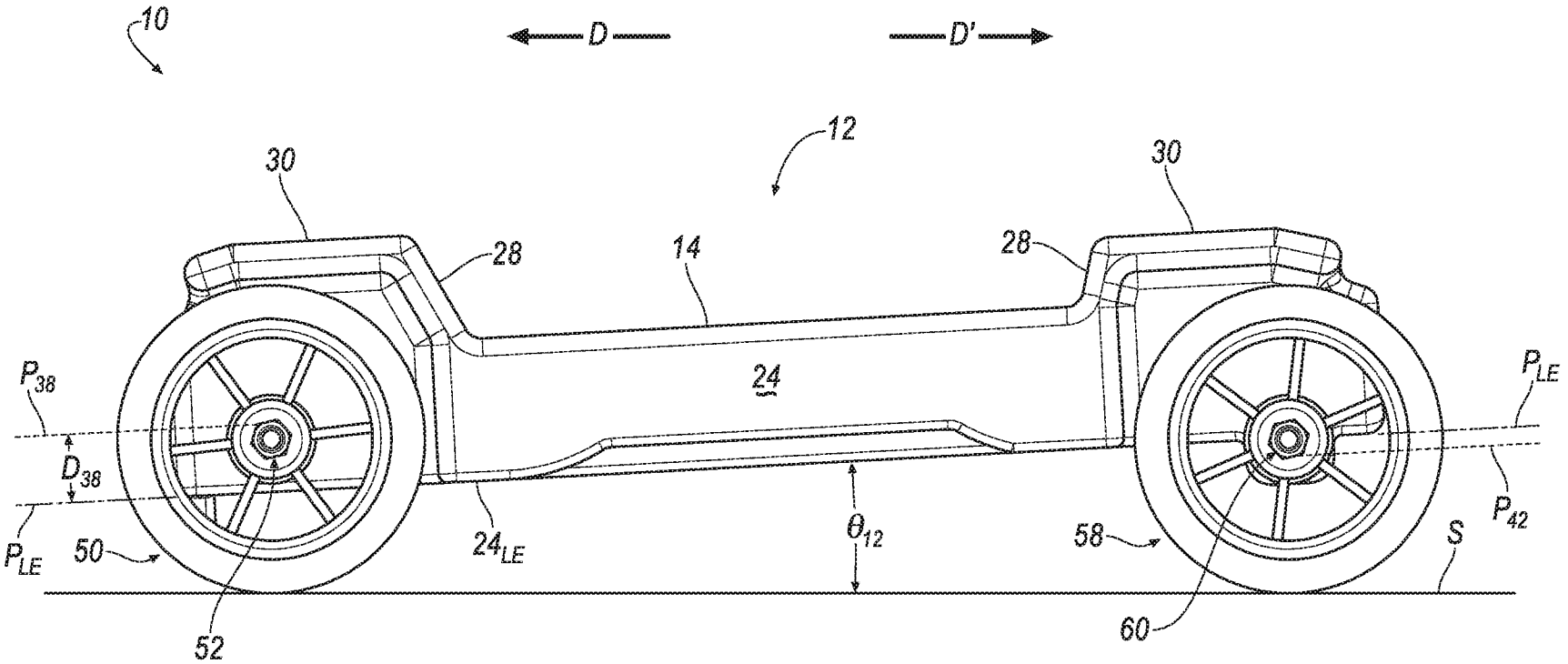
FIG. 9 is a first side view of the exercise assembly of FIG. 1 that is supported by an underlying support surface.
Figure 10:
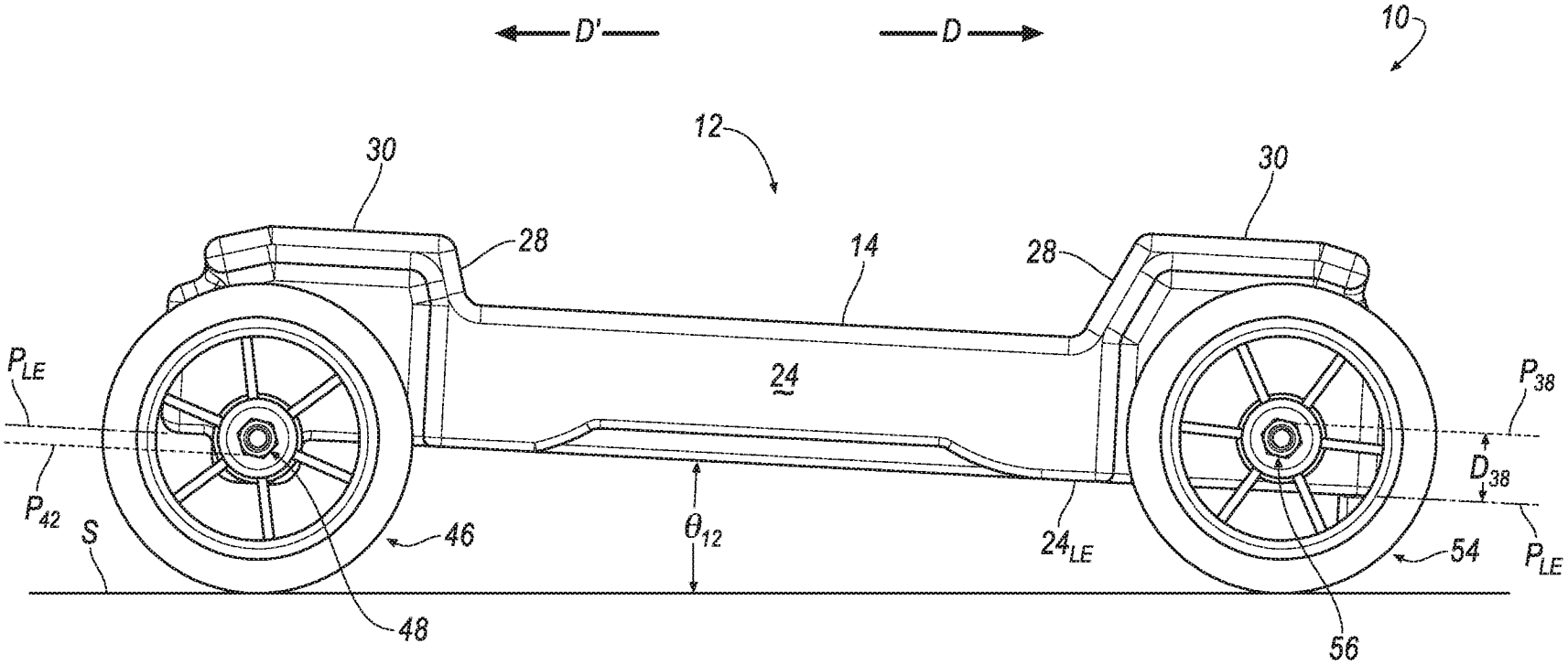
FIG. 10 is a second side view of the exercise assembly of FIG. 1 that is supported by an underlying support surface.
Figure 11:
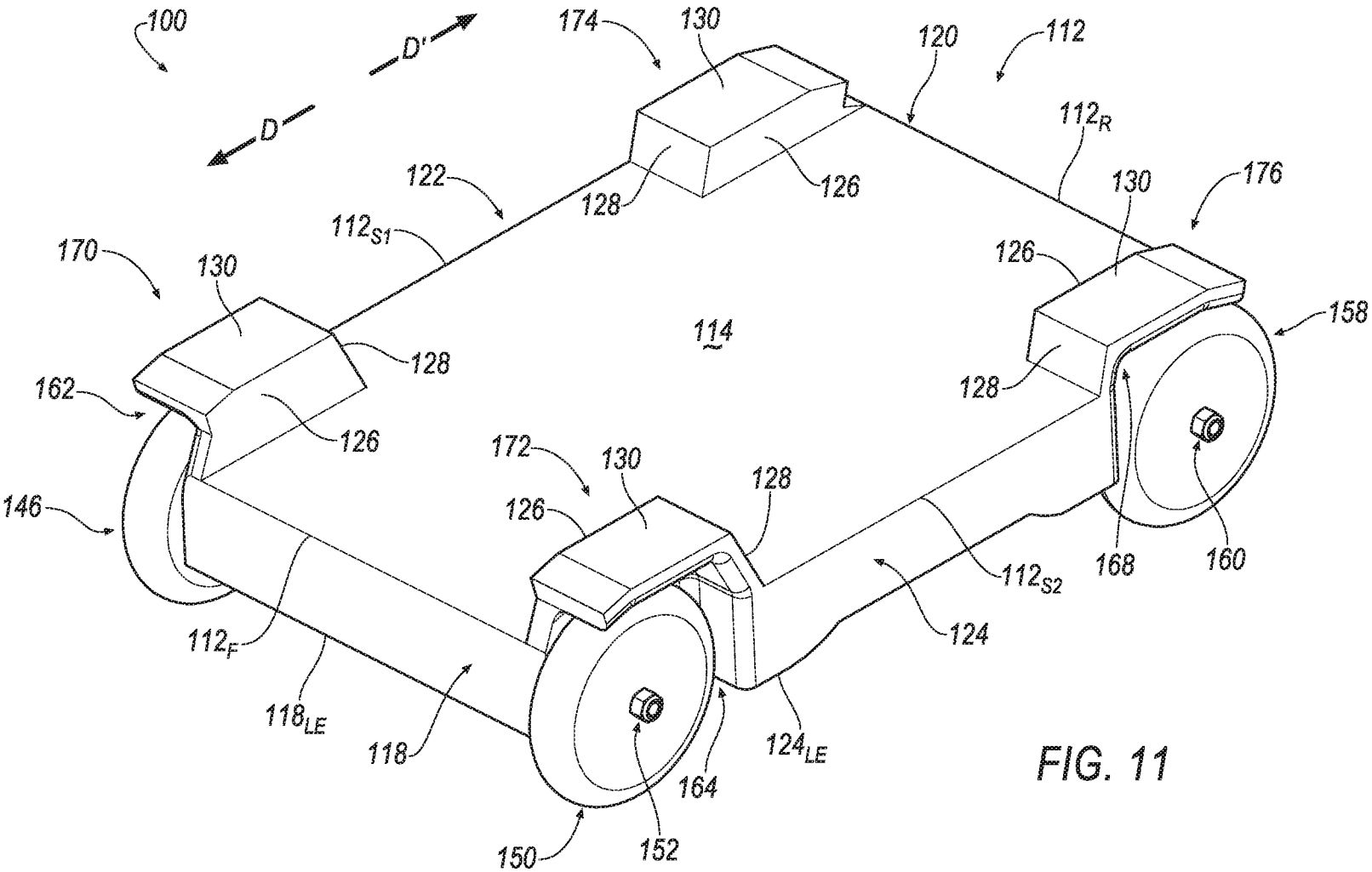
FIG. 11 is a perspective view of another exemplary exercise assembly.
Figure 12:
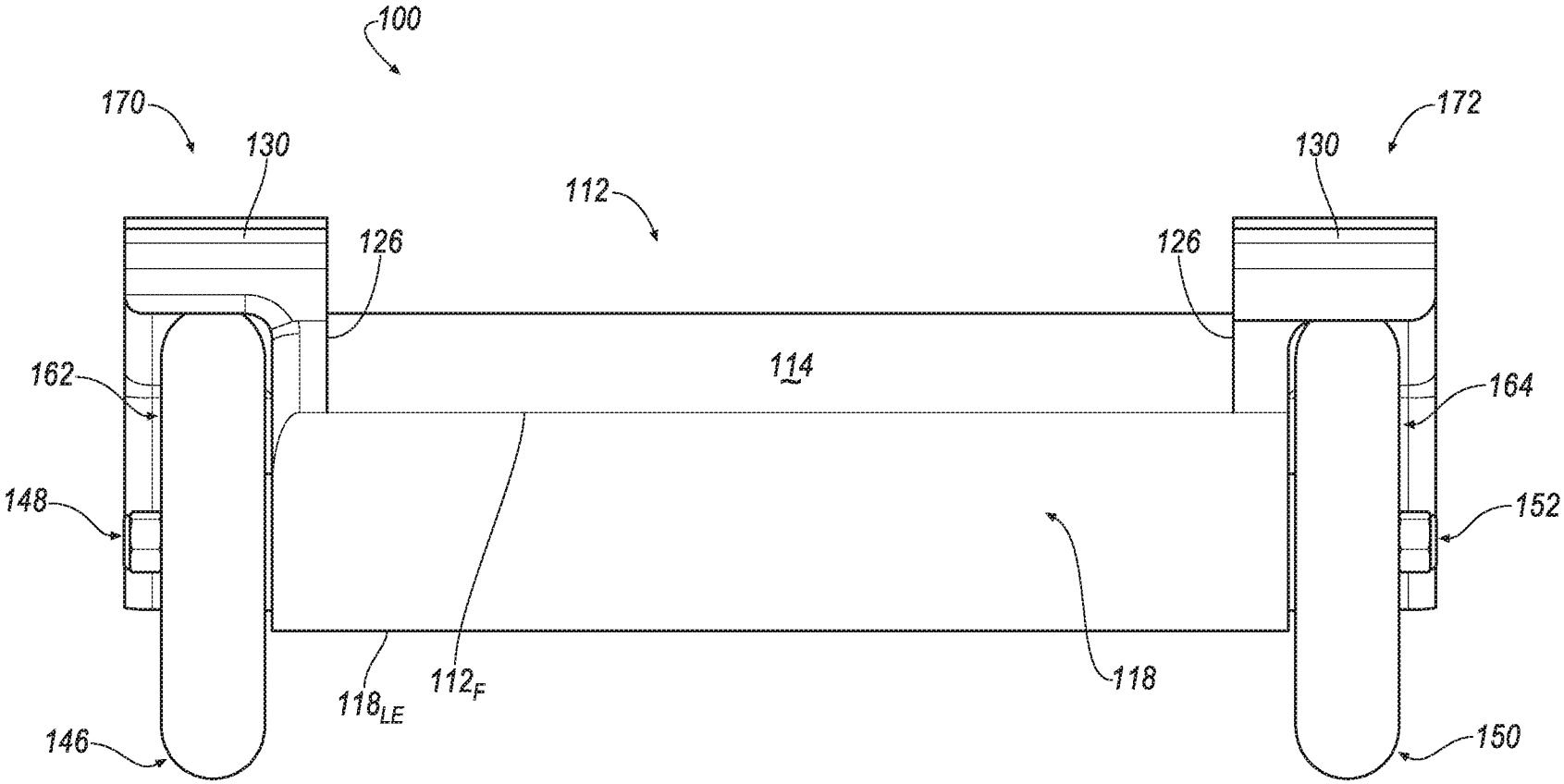
FIG. 12 is a front view of the exercise assembly of FIG. 11.
Figure 13:
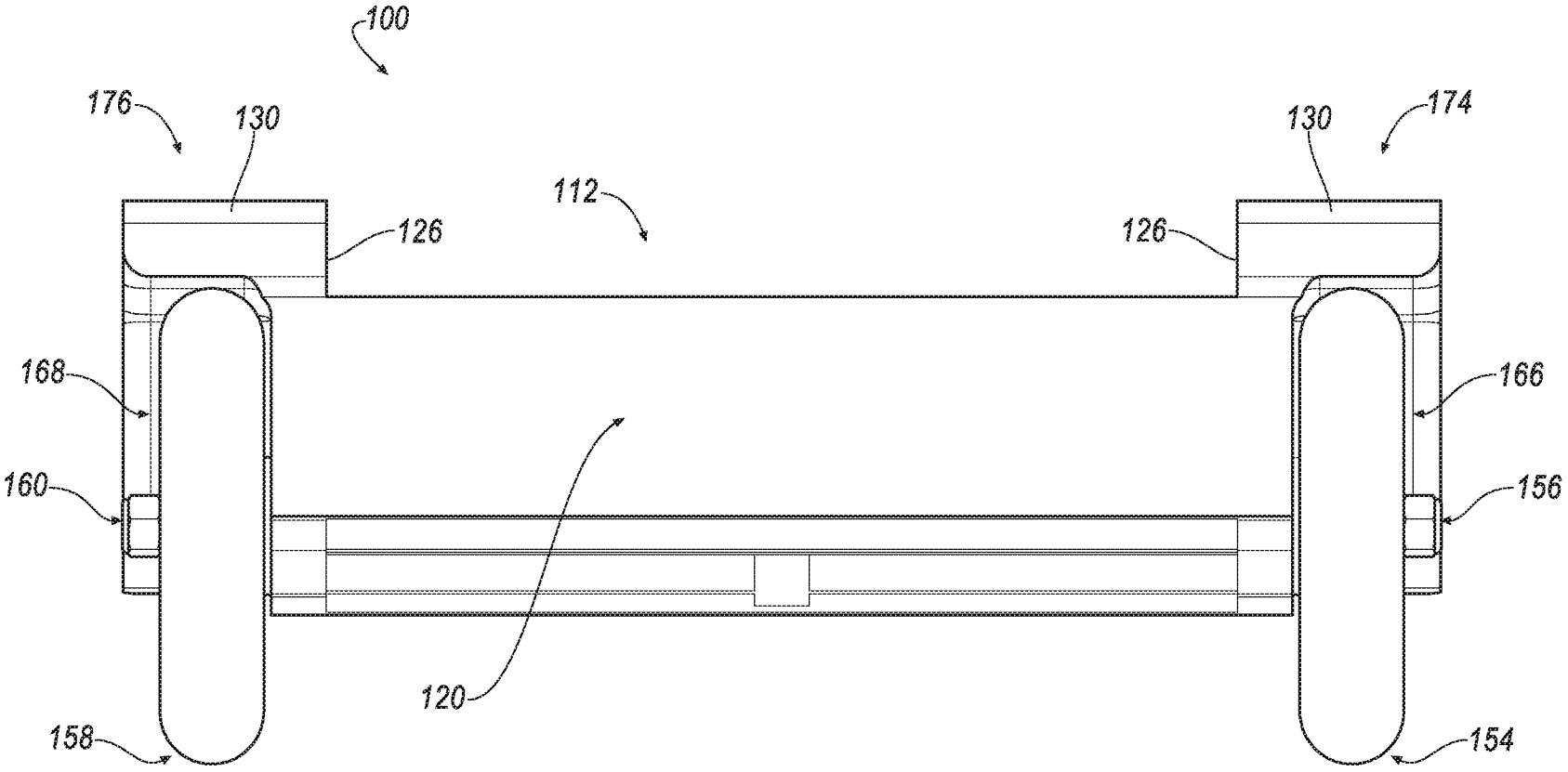
FIG. 13 is a rear view of the exercise assembly of FIG. 11.
Figure 14:
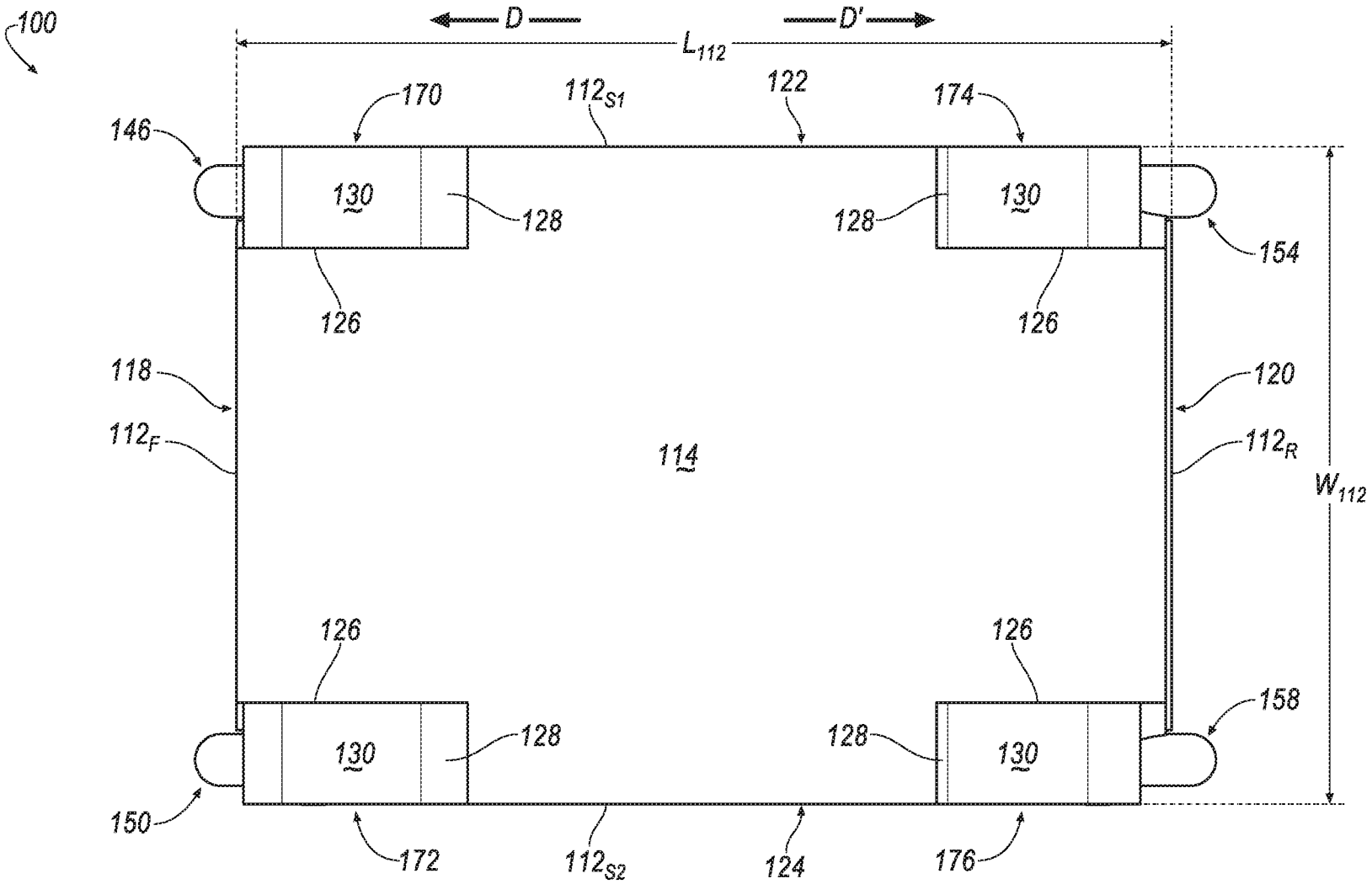
FIG. 14 is a top view of the exercise assembly of FIG. 11.
Figure 15:
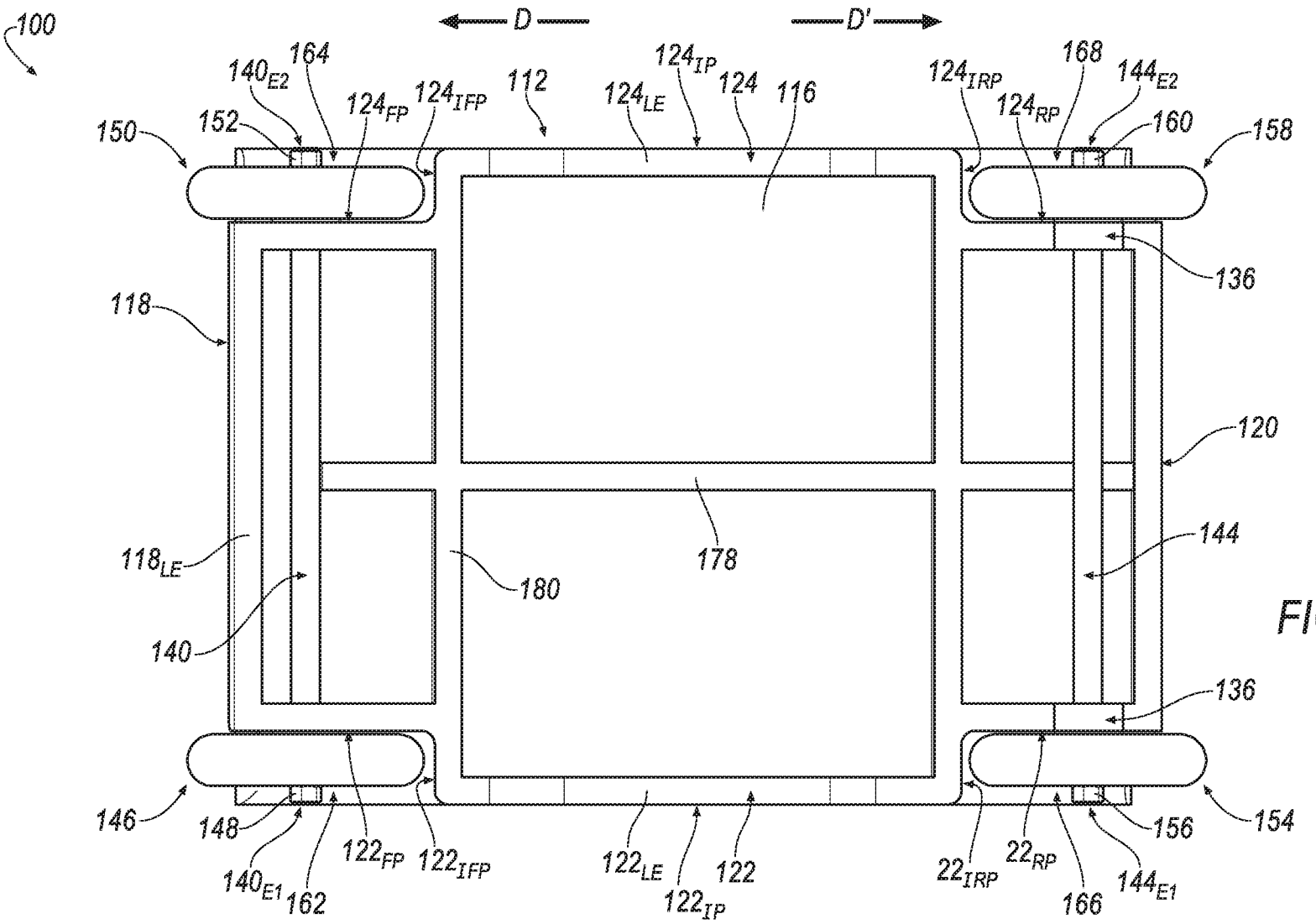
FIG. 15 is a bottom view of the exercise assembly of FIG. 11.
Figure 16:
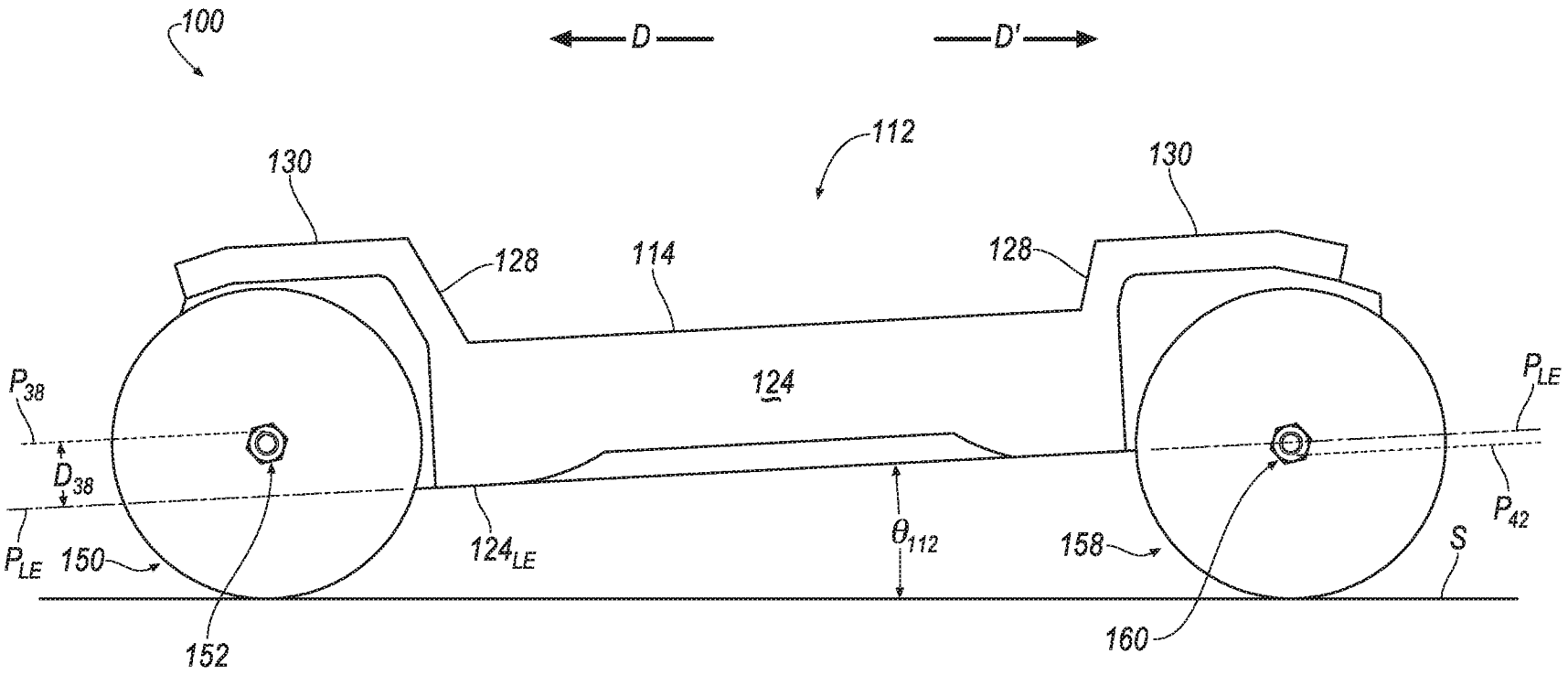
FIG. 16 is a side view of the exercise assembly of FIG. 11.

As seen throughout FIGS. 1-10, the body 12 includes an upper surface 14 and a lower surface 16 (see, e.g., FIGS. 6,7 and 7'). The body 12 also includes a plurality of flanges 18-30. As seen at, for example, FIGS. 1 and 2, the plurality of flanges 18-30 include a plurality of sidewall flanges 18-24 that extend from the lower surface 16 of the body 12. The plurality of flanges 18-30 may also optionally include a plurality of wheel covering flanges 26-30 that extend from the upper surface 14 of the body 12.

Referring to FIGS. 7 and 7', the body 12 is generally defined by a one or more thicknesses or heights $H_{12-1}$, $H_{12-2}$, and $H_{12-3}$. In some configurations, the body 12 is defined by a first height $H_{12-1}$ extending between the upper surface 14 and the lower surface 16. In other configurations, the body 12 is defined by a second height $H_{12-2}$ extending between the upper surface 14 and a lower edge any of the plurality of sidewall flanges 18-24. In yet other configurations, the body 12 is defined by a third height $H_{12-3}$ extending between the upper surface 14 and an upper edge of the wheel covering flange 30 of the plurality of wheel covering flanges 26-30.

Figure 1:
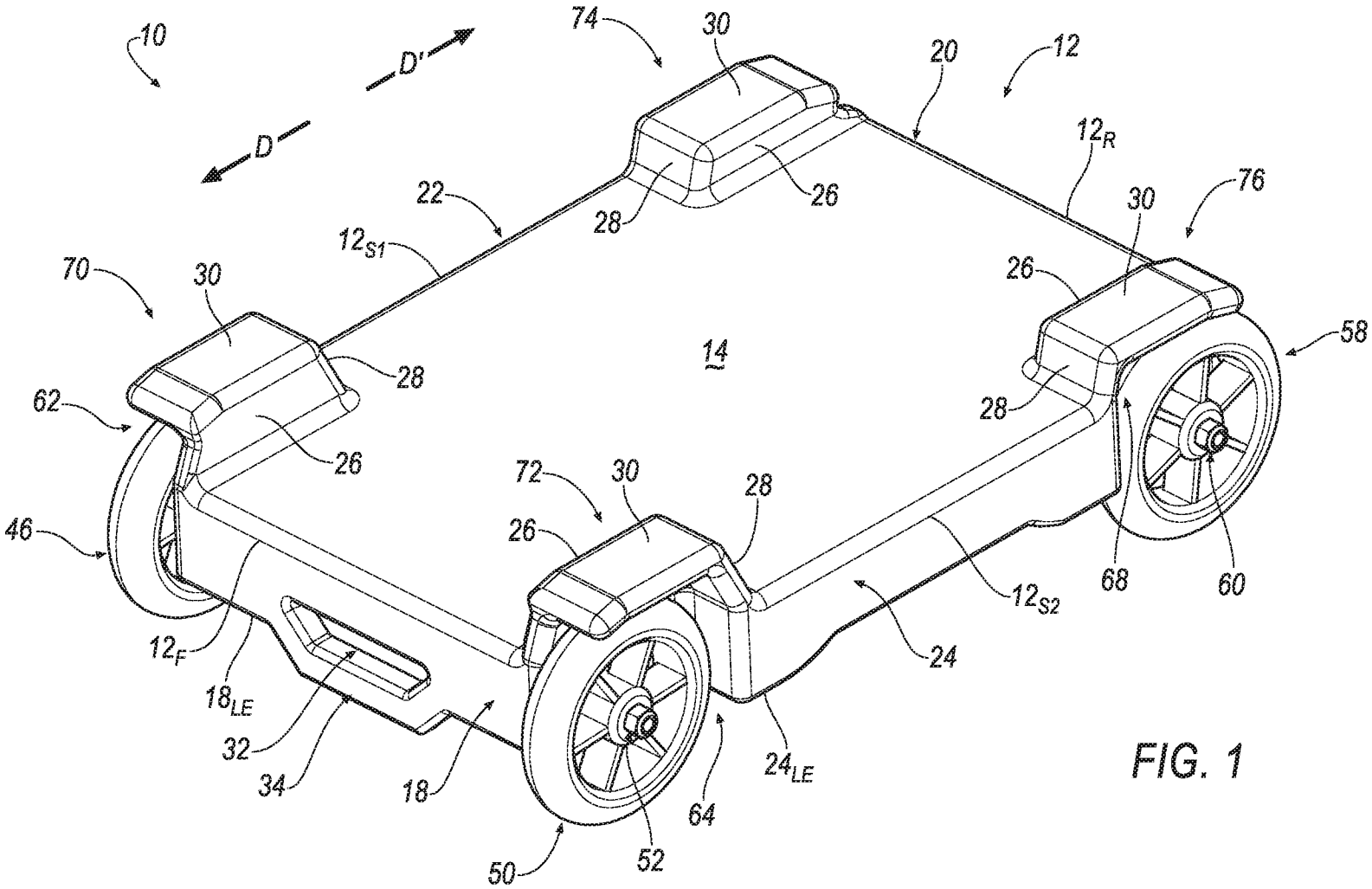
FIG. 1 is a perspective view of an exemplary exercise assembly.
Figure 2:
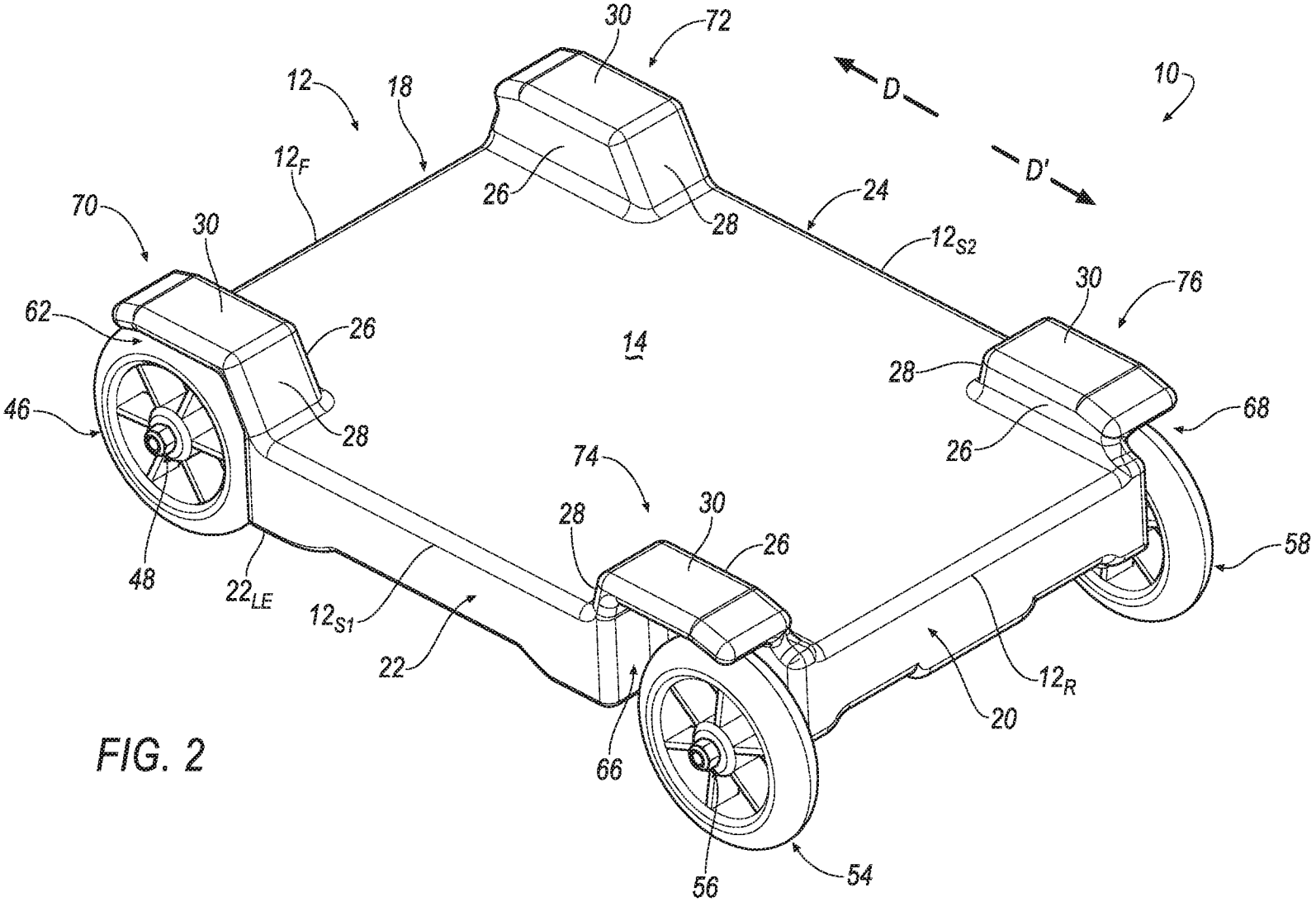
FIG. 2 is another perspective view of the exercise assembly of FIG. 1.

As seen at, for example, FIGS. 1 and 2, the plurality of sidewall flanges 18-24 include one or more of a front flange 18, a rear flange 20, a first sidewall flange 22, and a second sidewall flange 24. Each of the front flange 18 and the rear flange 20 extends between the first side edge $\mathbf{12}_{S1}$ and the second side edge $\mathbf{12}_{S2}$. Each of the first sidewall flange 22 and the second sidewall flange 24 extends between the front edge $\mathbf{12}_{F}$ and the rear edge $\mathbf{12}_{R}$.

Figure 3:
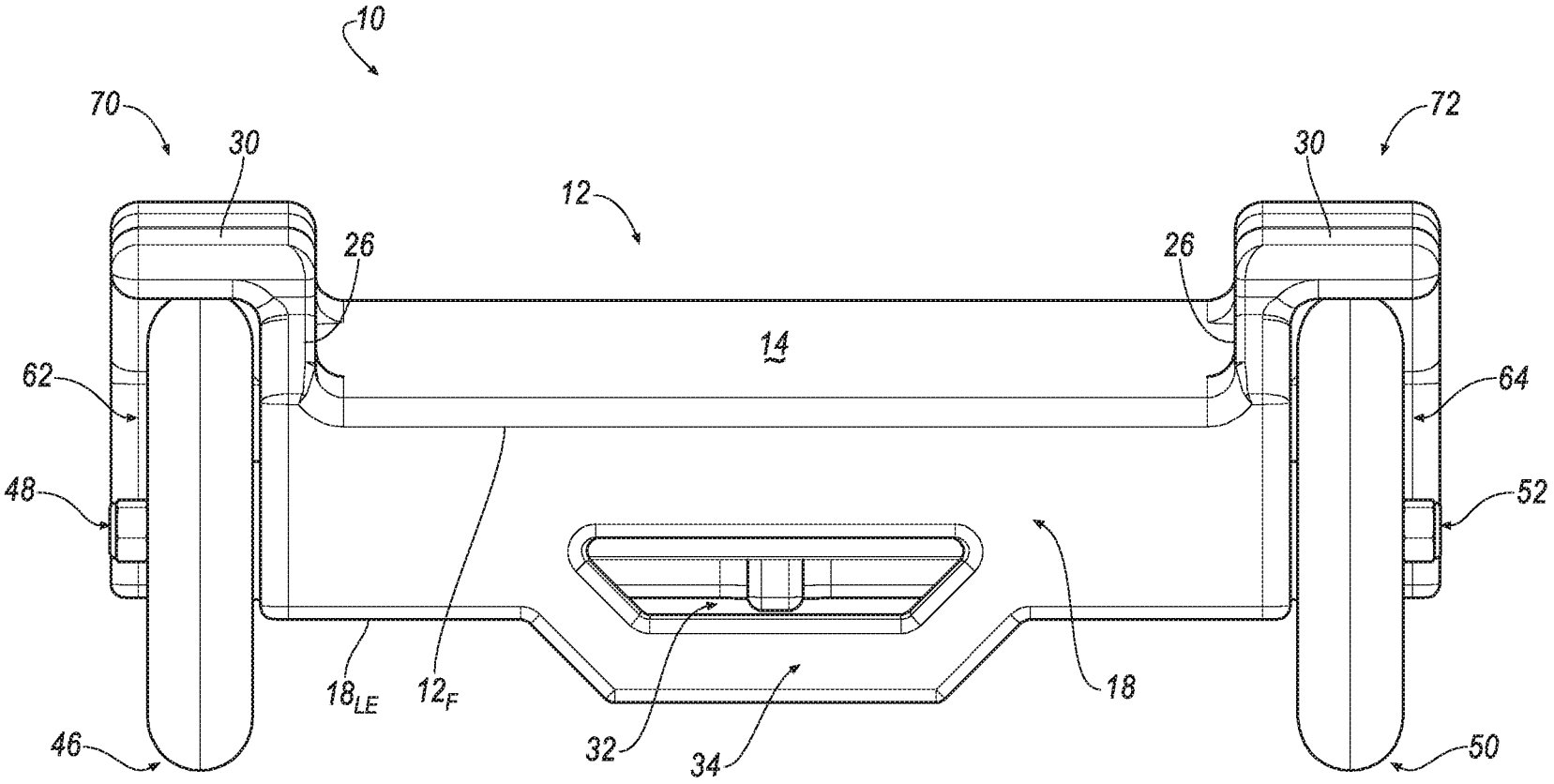
FIG. 3 is a front view of the exercise assembly of FIG. 1.
Figure 4:
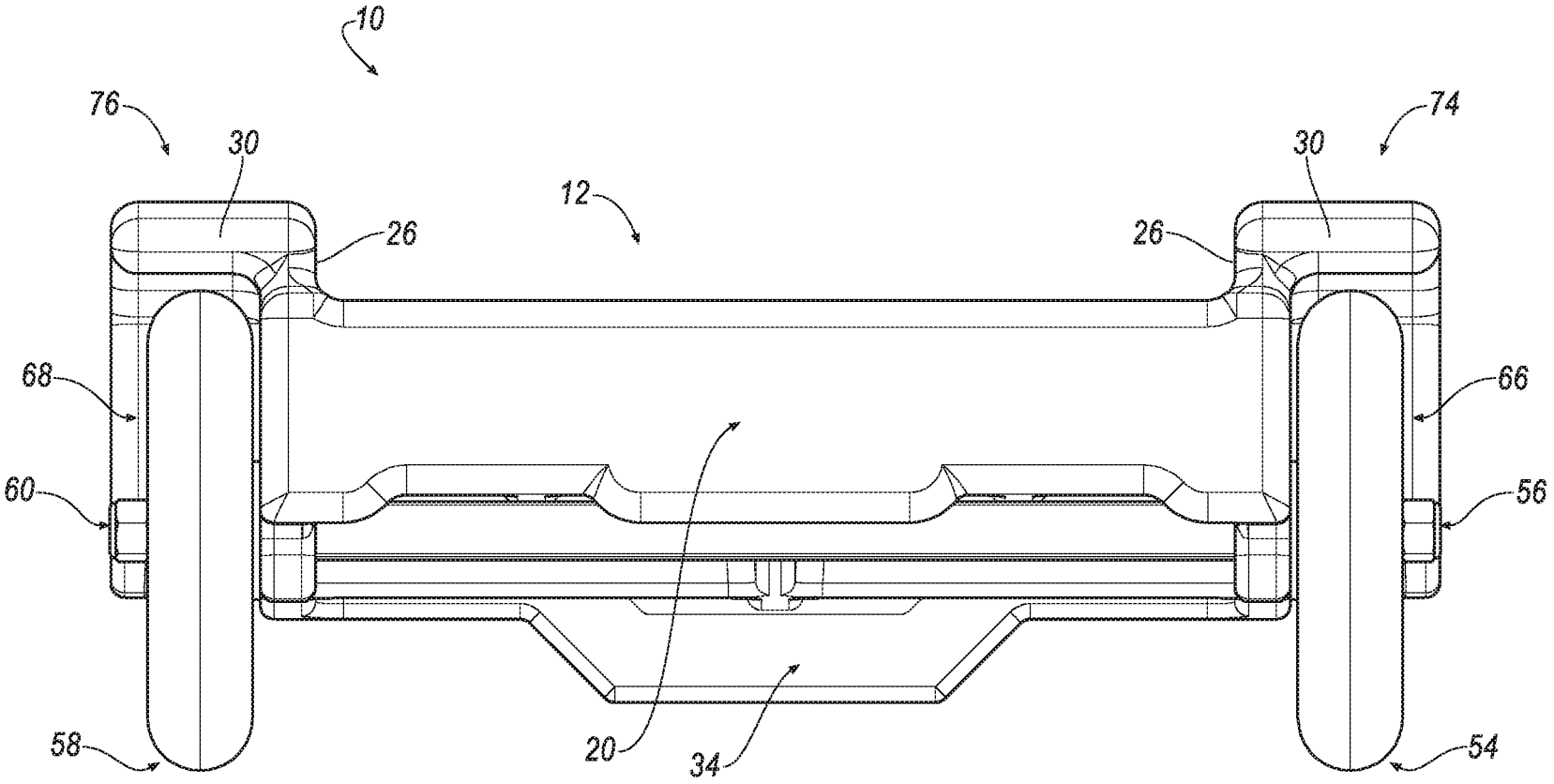
FIG. 4 is a rear view of the exercise assembly of FIG. 1.

As seen at, for example, FIGS. 1 and 3, one or more of the plurality of sidewall flanges 18-24 may define an opening 32. In some instances, the opening 32 may be sized for receiving fingers of the user U; accordingly, the opening 32 may be alternatively referred to as a finger-receiving opening. In other examples, the opening 32 may be sized for receiving a resistance component, such as, for example, a resistance band (see, e.g., reference letter B at FIGS. 22-24); accordingly, the opening 32 may be alternatively referred to as a resistance band-receiving opening.

In some instances, the opening 32 may be defined by the front flange 18. In some configurations, the sidewall flange (e.g., the front flange 18) of the plurality of sidewall flanges 18-24 that defines the opening 32 may be further defined by a lower edge (see, e.g., a lower edge $\mathbf{18}_{LE}$ of the front flange 18) of the plurality of sidewall flanges 18-24. If the opening 32 is arranged near the lower edge (e.g., the lower edge $\mathbf{18}_{LE}$ of the front flange 18), a portion of the lower edge (e.g., the lower edge $\mathbf{18}_{LE}$ of the front flange 18) arranged near the opening 32 may define a handle portion 34 of the sidewall flange (e.g., the front flange 18) of the plurality of sidewall flanges 18-24. In some configurations, the handle portion 34 extends away from the lower edge (e.g., the lower edge $\mathbf{18}_{LE}$ of the front flange 18) of the sidewall flange (e.g., the front flange 18) of the plurality of sidewall flanges 18-24.

Each of the first sidewall flange 22 and the second sidewall flange 24 are defined by a lower edge (see, e.g., a lower edge $\mathbf{22}_{LE}$ of the first sidewall flange 22 in FIG. 2 and a lower edge $\mathbf{24}_{LE}$ of the second sidewall flange 24 in FIG. 1). Referring to FIGS. 7, 7' and 8, a plane $P_{LE}$ extends across the lower edge $\mathbf{22}_{LE}$, $\mathbf{24}_{LE}$ of each of the first sidewall flange 22 and the second sidewall flange 24.

The lower edge $\mathbf{22}_{LE}$, $\mathbf{24}_{LE}$ of each of the first sidewall flange 22 and the second sidewall flange 24 is generally parallel to a plane extending across the upper surface 14. As will be discussed in the following disclosure, the lower edge $\mathbf{22}_{LE}$, $\mathbf{24}_{LE}$ of each of the first sidewall flange 22 and the second sidewall flange 24 generally contributes to defining an angle $\theta_{12}$ (see, e.g., FIGS. 9 and 10) of the body 12 with respect to the underlying support surface S; accordingly, the upper surface 14 of the body 12 may be said to be pitched at the angle $\theta_{12}$ with respect to the underlying support surface S as a result of the plane extending across the upper surface 14 of the body 12 being generally parallel to the lower edge $\mathbf{22}_{LE}$, $\mathbf{24}_{LE}$ of each of the first sidewall flange 22 and the second sidewall flange 24 that defines the plane $P_{LE}$.

Furthermore, with reference to FIGS. 6,7, and 7', each of the first sidewall flange 22 and the second sidewall flange 24 defines a front longitudinal portion $\mathbf{22}_{FP}$, $\mathbf{24}_{FP}$ and a rear longitudinal portion $\mathbf{22}_{RP}$, $\mathbf{24}_{RP}$. In some instances, a portion of the lower edge $\mathbf{22}_{LE}$, $\mathbf{24}_{LE}$ defining the rear longitudinal portion $\mathbf{22}_{RP}$, $\mathbf{24}_{RP}$ of each of the first sidewall flange 22 and the second sidewall flange 24 defines an optional axle-receiving projection 36. As seen at FIGS. 7 and 7', the optional axle-receiving projection 36 extends below the plane $P_{LE}$. Other than the optional axle-receiving projection 36, the plane $P_{LE}$ coincidently extends across a majority of the lower edge $\mathbf{22}_{LE}$, $\mathbf{24}_{LE}$ of each of the first sidewall flange 22 and the second sidewall flange 24.

Referring to FIGS. 7 and 7', the front longitudinal portion $\mathbf{22}_{FP}$, $\mathbf{24}_{FP}$ of each of the first sidewall flange 22 and the second sidewall flange 24 defines a front axle-receiving opening 38. The front axle-receiving opening 38 defined by each of the first sidewall flange 22 and the second sidewall flange 24 are axially aligned and are sized for receiving a front axle member 40.

As also seen at FIGS. 7 and 7', the rear longitudinal portion $\mathbf{22}_{RP}$, $\mathbf{24}_{RP}$ of each of the first sidewall flange 22 and the second sidewall flange 24 defines a rear axle-receiving opening 42. The rear axle-receiving opening 42 defined by each of the first sidewall flange 22 and the second sidewall flange 24 are axially aligned and are sized for receiving a rear axle member 44. In some instances, the rear axle-receiving opening 42 is at least partially defined by the optional axle-receiving projection 36 that is defined by a portion of the lower edge $\mathbf{22}_{LE}$, $\mathbf{24}_{LE}$ defining the rear longitudinal portion $\mathbf{22}_{RP}$, $\mathbf{24}_{RP}$ of each of the first sidewall flange 22 and the second sidewall flange 24.

The front axle-receiving opening 38 and the rear axle-receiving opening 42 are arranged so as to position the respective axle members 40, 44 received therein and corresponding wheels 46, 50, 54, 58 attached thereto in close proximity to the underlying support surface S. Therefore, the body 12 is also arranged in close proximity to the to the underlying support surface S. Because the body 12 is arranged in close proximity to the to the underlying support surface S, the assembly 10 has or defines a low center of gravity.

As seen at FIGS. 7 and 7', a plane $P_{38}$ that is tangent to a top portion of each front axle-receiving opening 38 is parallel to and arranged above the plane $P_{LE}$ extending across the lower edge $\mathbf{22}_{LE}$, $\mathbf{24}_{LE}$ of each of the first sidewall flange 22 and the second sidewall flange 24. Similarly, as seen at FIGS. 7 and 7', a plane $P_{42}$ that is tangent to a lower portion of each rear axle-receiving opening 42 (that is at least partially defined by the optional axle-receiving projection 36) is parallel to and arranged below the plane $P_{LE}$ extending across the lower edge $\mathbf{22}_{LE}$, $\mathbf{24}_{LE}$ of each of the first sidewall flange 22 and the second sidewall flange 24. Accordingly, utilizing the plane $P_{LE}$ extending across the lower edge $\mathbf{22}_{LE}$, $\mathbf{24}_{LE}$ of each of the first sidewall flange 22 as a frame of reference, the planes $P_{38}$, $P_{42}$ respectively associated with each front axle-receiving opening 38 and each rear axle-receiving opening 42 are not co-planar.

With continued reference to FIGS. 7 and 7', each front axle-receiving opening 38 may be arranged away from the lower edge $\mathbf{22}_{LE}$, $\mathbf{24}_{LE}$ of each of the first sidewall flange 22 and the second sidewall flange 24 at a distance $D_{38}$. Conversely, the plane $P_{LE}$ extending across the lower edge $\mathbf{22}_{LE}$, $\mathbf{24}_{LE}$ of each of the first sidewall flange 22 and the second sidewall flange 24 may extend across or traverse each rear axle-receiving opening 42 such that each rear axle-receiving opening 42 is not spaced apart or arranged at a distance away from the lower edge $\mathbf{22}_{LE}$, $\mathbf{24}_{LE}$ of each of the first sidewall flange 22 and the second sidewall flange 24. As will be described in greater detail in the following disclosure, because each front axle-receiving opening 38 is arranged at the distance $D_{38}$ away from the lower edge $\mathbf{22}_{LE}$, $\mathbf{24}_{LE}$ of each of the first sidewall flange 22 and the second sidewall flange 24 (whereas each rear axle-receiving opening 42 is not spaced apart or arranged at a distance away from the lower edge $\mathbf{22}_{LE}$, $\mathbf{24}_{LE}$ of each of the first sidewall flange 22 and the second sidewall flange 24) and/or because the plane $P_{38}$ associated with each front axle-receiving opening 38 is not co-planar with the plane $P_{42}$ associated with each rear axle-receiving opening 42, the upper surface 14 of the body 12 is pitched at an angle $\theta_{12}$ (see, e.g., FIGS. 9 and 10) with respect to the underlying support surface S.

Referring to FIG. 6, a first front wheel 46 is connected to a first end $\mathbf{40}_{E1}$ of the front axle member 40 that extends through and beyond the front axle-receiving opening 38 formed by the first sidewall flange 22. The first front wheel 46 may removably-secured to the first end $\mathbf{40}_{E1}$ of the front axle member 40 by a first front wheel fastener 48 such as a nut. A second front wheel 50 is connected to a second end $\mathbf{40}_{E2}$ of the front axle member 40 that extends through and beyond the front axle-receiving opening 38 formed by the second sidewall flange 24. The second front wheel 50 may removably-secured to the second end $\mathbf{40}_{E2}$ of the front axle member 40 by a second front wheel fastener 52 such as a nut.

With continued reference to FIG. 6, a first rear wheel 54 is connected to a first end $\mathbf{44}_{E1}$ of the rear axle member 44 that extends through and beyond the rear axle-receiving opening 42 formed by the first sidewall flange 22. The first rear wheel 54 may removably-secured to the first end $\mathbf{44}_{E1}$ of the rear axle member 44 by a first rear wheel fastener 56 such as a nut. A second rear wheel 58 is connected to a second end $\mathbf{44}_{E2}$ of the rear axle member 44 that extends through and beyond the rear axle-receiving opening 42 formed by the second sidewall flange 24. The second rear wheel 58 may removably-secured to the second end $\mathbf{44}_{E2}$ of the rear axle member 44 by a second rear wheel fastener 60 such as a nut.

As a result of the assembly 10 including two axles (i.e., the front axle member 40 and the rear axle member 44) and four wheels (i.e., the first front wheel 46, the second front wheel 50, the first rear wheel 54, and the second rear wheel 58), when the four wheels 46, 50, 54, 58 are disposed upon an underlying support surface S, the upper surface 14 is pitched at the angle $\theta_{12}$. As seen in the following disclosure at FIGS. 25A-25E, FIGS. 26A-26E, FIGS. 27A-27E, and FIGS. 28A-28E, the pitch defined by the angle $\theta_{12}$ that the upper surface 14 of the body 12 is arranged at remains constant during the course of the utilization of the assembly 10. Accordingly, during simultaneously rotation of four wheels 46, 50, 54, 58 in a first direction D and a second D' that is opposite the first direction D, the pitch of the angle $\theta_{12}$ does not change. If, for example, the assembly 10 were to undesirably include only one axle supported by only two wheels, such a configuration having two points of support provided by the only two wheels would undesirably permit the body 12 to rotate about an axis extending through the length of the only one axle, which would undesirably result in the pitch of the upper surface 14 constantly changing depending on the direction and amount of force applied to the upper surface 14 of the body 12 by the user U. As a result, the two axle 40, 44 and four wheel 46, 50, 54, 58 design of the assembly 10 provides four points of support relative an underlying support surface S that yields a stable upper surface 14 at fixed angle $\theta_{12}$ that does not change in view of the direction and the amount of force F/F' (see, e.g., FIGS. 25A-25E, FIGS. 26A-26E, FIGS. 27A-27E, and FIGS. 28A-28E) applied to the upper surface 14 of the body 12 by the user U.

Referring to FIGS. 1, 2, 5, 6, 9 and 10, all of the first front wheel 46, the second front wheel 50, the first rear wheel 54, and the second rear wheel 58 are configured to simultaneously roll in a first direction D and a second D' that is opposite the first direction D. The first direction D may be alternatively referred to as a forward direction. The second direction D' may be alternatively referred to as a rearward direction. All of the first front wheel 46, the second front wheel 50, the first rear wheel 54, and the second rear wheel 58 are not caster wheels; accordingly, all of the first front wheel 46, the second front wheel 50, the first rear wheel 54, and the second rear wheel 58 are not permitted to "caster" or swivel 360° about a swivel axis that is perpendicular to the underlying support surface.

Referring to FIG. 6, an intermediate front longitudinal portion $\mathbf{22}_{IP}$, $\mathbf{24}_{IP}$ of each of the first sidewall flange 22 and the second sidewall flange 24 is connected to the front longitudinal portion $\mathbf{22}_{FP}$, $\mathbf{24}_{FP}$ of each of the first sidewall flange 22 and the second sidewall flange 24 by an intermediate front laterally-extending portion $\mathbf{22}_{IFP}$, $\mathbf{24}_{IFP}$ of each of the first sidewall flange 22 and the second sidewall flange 24. Accordingly, the front longitudinal portion $\mathbf{22}_{FP}$ and the intermediate front laterally-extending portion $\mathbf{22}_{IFP}$ of the first sidewall flange 22 defines a first front wheel well 62 that is sized for receiving the first front wheel 46. Similarly, the front longitudinal portion $\mathbf{24}_{FP}$ and the intermediate front laterally-extending portion $\mathbf{24}_{IFP}$ of the second sidewall flange 24 defines a second front wheel well 64 that is sized for receiving the second front wheel 50.

Furthermore, the intermediate front longitudinal portion $\mathbf{22}_{IP}$, $\mathbf{24}_{IP}$ of each of the first sidewall flange 22 and the second sidewall flange 24 is connected to the rear longitudinal portion $\mathbf{22}_{RP}$, $\mathbf{24}_{RP}$ of each of the first sidewall flange 22 and the second sidewall flange 24 by an intermediate rear laterally-extending portion $\mathbf{22}_{IRP}$, $\mathbf{24}_{IRP}$ of each of the first sidewall flange 22 and the second sidewall flange 24. Accordingly, the rear longitudinal portion $\mathbf{22}_{RP}$ and the intermediate rear laterally-extending portion $\mathbf{22}_{IFP}$ of the first sidewall flange 22 defines a first rear wheel well 66 that is sized for receiving the first rear wheel 54. Similarly, the rear longitudinal portion $\mathbf{24}_{FP}$ and the intermediate rear laterally-extending portion $\mathbf{24}_{IRP}$ of the second sidewall flange 24 defines a second rear well 68 that is sized for receiving the second rear wheel 58.

Referring to FIGS. 1 and 2, the plurality of wheel covering flanges 26-30 extend from the upper surface 14 of the body 12 and respectively define a first front wheel covering portion 70 that is sized for covering the first front wheel 46, a second front wheel covering portion 72 that is sized for covering the second front wheel 50, a first rear wheel covering portion 74 that is sized for covering the first rear wheel 54, and a second rear wheel covering portion 76 that is sized for covering the second rear wheel 58. Furthermore, the plurality of wheel covering flanges 26-30 forming each of the first front wheel covering portion 70, the second front wheel covering portion 72, the first rear wheel covering portion 74, and the second rear wheel covering portion 76 may further contribute to respectively defining the first front wheel well 62, the second front wheel well 64, the first rear wheel well 66, and the second rear wheel well 68.

In an example, the plurality of wheel covering flanges 26-30 include a longitudinal wheel covering flange 26, a lateral wheel covering flange 28, and a top wheel covering flange 30. The flanges 26, 28, and 30 may collectively define a wheel covering portion or fender (see, e.g., reference numerals 70, 72, 74, 76). The longitudinal wheel covering flange 26 and the lateral wheel covering flange 28 directly extend from the upper surface 14 of the body, and the longitudinal wheel covering flange 26 is connected to the lateral wheel covering flange 28. The top wheel covering flange 30 is connected to both of the longitudinal wheel covering flange 26 and the lateral wheel covering flange 28 to form a three-sided structure defining each of the first front wheel covering portion 70, the second front wheel covering portion 72, the first rear wheel covering portion 74, and the second rear wheel covering portion 76.

In use, a user U may arrange an implement such as, for example, an exercise bar, or alternatively, a portion of his/her foot (as seen at, e.g., FIGS. 25A-25E or FIGS. 26A-26E), adjacent a portion of adjacent one or more of the flanges 26, 28, and 30 (such as, e.g., the lateral wheel covering flange 28) during use of the assembly 10. By permitting the user U to arrange a portion of his/her foot, or, in other instances, a portion of an implement such as, for example, an exercise bar adjacent one or more of the flanges 26, 28, and 30, the one or more of the flanges 26, 28, and 30 may provide a biasing surface that assists a user U in pushing or pulling (as seen at, e.g., FIGS. 25A-25E or FIGS. 26A-26E with reference to pulling force F') the assembly 10.

In some examples, the longitudinal wheel covering flange 26 defining each of the first front wheel covering portion 70, the second front wheel covering portion 72, the first rear wheel covering portion 74, and the second rear wheel covering portion 76 is respectively aligned with the front longitudinal portion $\mathbf{22}_{FP}$ of the first sidewall flange 22, the front longitudinal portion $\mathbf{24}_{FP}$ of the second sidewall flange 24, the rear longitudinal portion $\mathbf{22}_{RP}$ of the first sidewall flange 22, and the rear longitudinal portion $\mathbf{24}_{RP}$ of the second sidewall flange 24. In other examples, the lateral wheel covering flange 28 defining each of the first front wheel covering portion 70, the second front wheel covering portion 72, the first rear wheel covering portion 74, and the second rear wheel covering portion 76 is respectively aligned with the intermediate front laterally-extending portion $\mathbf{22}_{IFP}$, of the first sidewall flange 22, the intermediate front laterally-extending portion $\mathbf{24}_{IFP}$ of the second sidewall flange 24, the intermediate rear laterally-extending portion $\mathbf{22}_{IRP}$, of the first sidewall flange 22, and the intermediate rear laterally-extending portion $\mathbf{24}_{IRP}$ of the second sidewall flange 24.

With reference to FIGS. 6,7, and 7', a plurality of strengthening ribs 78-84 may extend away from the lower surface 16 of the body 12. The plurality of strengthening ribs 78-84 may include a first plurality of strengthening ribs 78-80 defined by a first thickness or height and a second plurality of strengthening ribs 82-84 defined by a second thickness or height.

Referring to FIG. 6, the first plurality of strengthening ribs 78-80 may include at least one longitudinally-extending strengthening rib 78 and at least one laterally-extending strengthening rib 80. The first plurality of strengthening ribs 78-80 may include a plurality of longitudinally-extending strengthening ribs 78 and a plurality of laterally-extending strengthening ribs 80 that form one or more strengthening rib patterns such as, for example, a grid pattern, a square pattern, a rectangular pattern, a C-shape pattern, an L-shape pattern, an E-shape pattern, an M-shape pattern, a W-shape pattern or the like.

With reference to FIGS. 7 and 7', the first plurality of strengthening ribs 78-80 may be defined by a height that is approximately equal to the second height $H_{12\text{-}2}$ extending between the upper surface 14 and a lower edge any of the plurality of sidewall flanges 18-24. In some instances, the first plurality of strengthening ribs 78-80 may be integral with or extend from one or more of the front longitudinal portion $\mathbf{22}_{FP}$, $\mathbf{24}_{FP}$, the rear longitudinal portion $\mathbf{22}_{RP}$, $\mathbf{24}_{RP}$, intermediate front longitudinal portion $\mathbf{22}_{IP}$, $\mathbf{24}_{IP}$, the intermediate front laterally-extending portion $\mathbf{22}_{IFP}$, $\mathbf{24}_{IFP}$, and the intermediate rear laterally-extending portion $\mathbf{22}_{IRP}$.

The second plurality of strengthening ribs 82-84 may include at least one longitudinally-extending strengthening rib 82 and at least one laterally-extending strengthening rib 84. The second plurality of strengthening ribs 82-84 may include a plurality of longitudinally-extending strengthening ribs 82 and a plurality of laterally-extending strengthening ribs 84 that form one or more strengthening rib patterns such as, for example, a grid pattern, a square pattern, a rectangular pattern, a C-shape pattern, an L-shape pattern, an E-shape pattern, an M-shape pattern, a W-shape pattern or the like.

With reference to FIGS. 7 and 7', the second plurality of strengthening ribs 82-84 may be defined by a height $H_{12\text{-}4}$ that is greater than the first height $H_{12\text{-}1}$ extending between the upper surface 14 and the lower surface 16 but less than the second height $H_{12\text{-}2}$ extending between the upper surface 14 and a lower edge any of the plurality of sidewall flanges 18-24. In some instances, the second plurality of strengthening ribs 82-84 may be integral with or extend from one or more of the front flange 18, the rear flange 20, the front longitudinal portion $\mathbf{22}_{FP}$, $\mathbf{24}_{FP}$, the rear longitudinal portion $\mathbf{22}_{RP}$, $\mathbf{24}_{RP}$, intermediate front longitudinal portion $\mathbf{22}_{IP}$, $\mathbf{24}_{IP}$, the intermediate front laterally-extending portion $\mathbf{22}_{IFP}$, $\mathbf{24}_{IFP}$, the intermediate rear laterally-extending portion $\mathbf{22}_{IRP}$, and the first plurality of strengthening ribs 78-80.

The upper surface 14 of the body 12 may include a frictional surface pattern that is molded, stamped or otherwise formed during the manufacturing (e.g., injection molding) of the body 12. In other configurations, the upper surface 14 of the body 12 may be substantially smooth and a covering made from a frictional material such as, for example, rubber may be glued or adhered to the upper surface 14.

With reference to FIG. 7', an exemplary configuration of the assembly 10 may also include one or more optional ribs or hooks 86 that extend away from the lower surface 16 of the body 12. The optional one or more ribs or hooks 86 may be aligned with and arranged opposite the opening 32. In some instances (as seen at, e.g., FIG. 24), the optional one or more ribs or hooks 86 is/are sized for receiving, retaining or removably-securing a first end $B_1$ of the resistance band B thereto. Upon receiving, retaining or removably-securing the first end $B_1$ of the resistance band B about the optional one or more ribs or hooks 86, a second end $B_2$ of the resistance band B is permitted to pass through the opening 32 formed by the front flange 18 such that the second end $B_2$ of the resistance band B extends beyond the front flange 18 and is not arranged opposite the lower surface 16 of the body 12.

Referring to FIGS. 11-16, an exemplary assembly is shown generally at 100. The assembly 100 is substantially similar to the assembly 10 described above at FIGS. 1-10. Accordingly, the assembly 100 includes the same reference numeral pattern (see, e.g., the body 12 related to the assembly 10 and the body 112 related to the assembly 100), and, as such, the specific structural details associated with the assembly 100 are omitted here for purposes of brevity.

The assembly 100 differs from the assembly 10 in that one or more structural aspects of the assembly 100 is/are omitted in comparison to the assembly 10. In some instances, the assembly 100 may not include, for example, the opening (see, e.g., reference numeral 32 of the assembly 10), the handle portion (see, e.g., reference numeral 34 of the assembly 10) and the second plurality of strengthening ribs (see, e.g., reference numerals 82-84 of the assembly 10).

Figure 17:
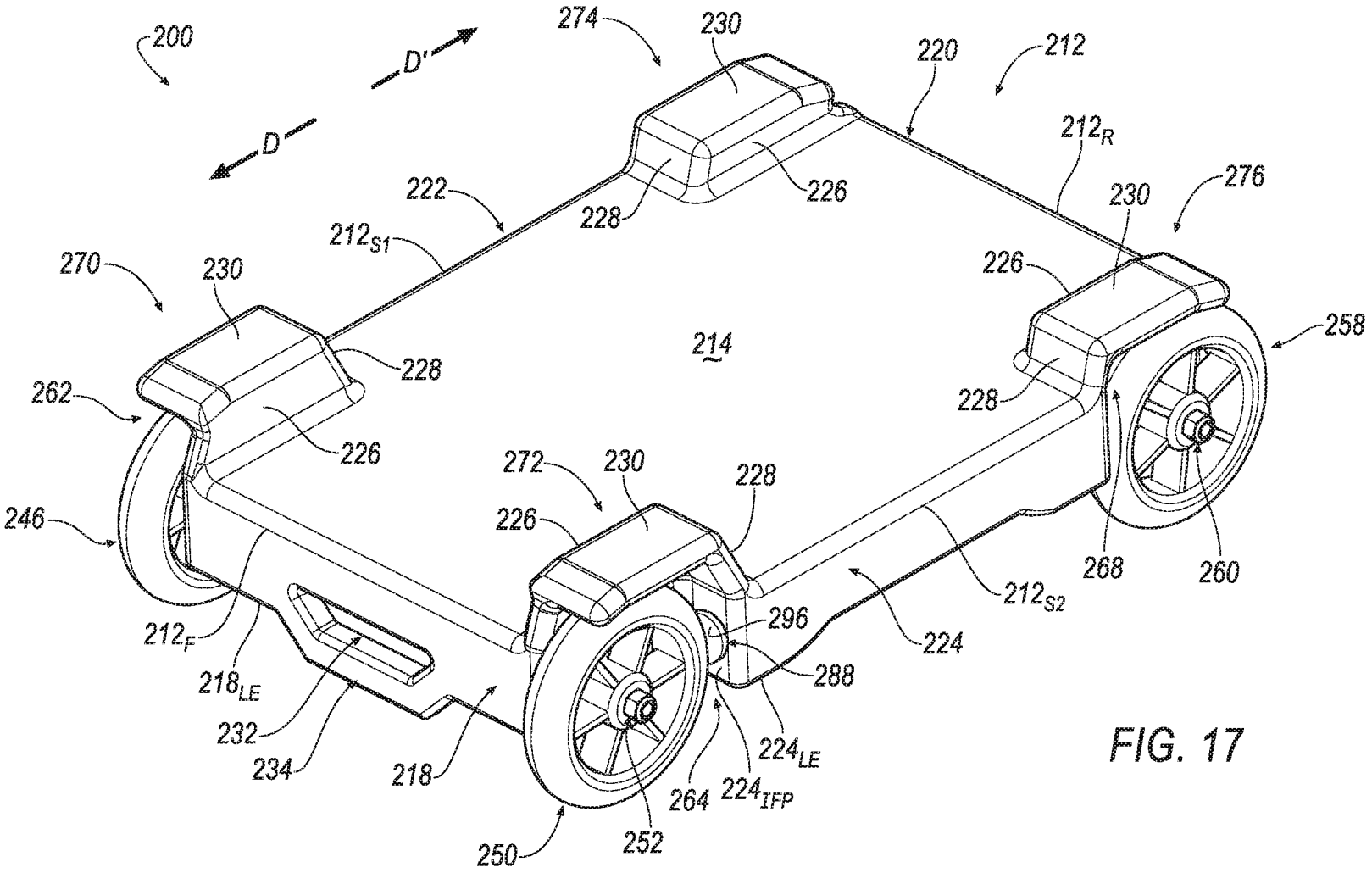
FIG. 17 is a perspective view of another exemplary exercise assembly.
Figure 18B:
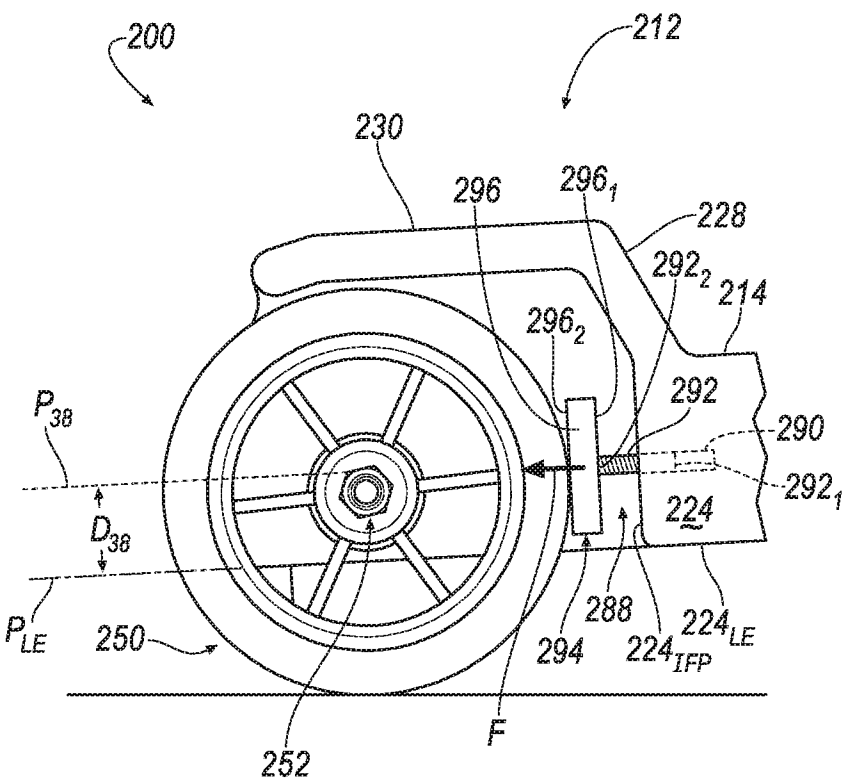
FIG. 18B is another partial front view of the exercise assembly of FIG. 18A illustrating the wheel rotation resistance device arranged in a second orientation.

Referring to FIGS. 17-18B, an exemplary assembly is shown generally at 200. The assembly 200 is substantially similar to the assembly 10 described above at FIGS. 1-10. Accordingly, the assembly 200 includes the same reference numeral pattern (see, e.g., the body 12 related to the assembly 10 and the body 212 related to the assembly 200), and, as such, the specific structural details associated with the assembly 200 are omitted here for purposes of brevity.

Figure 18A:
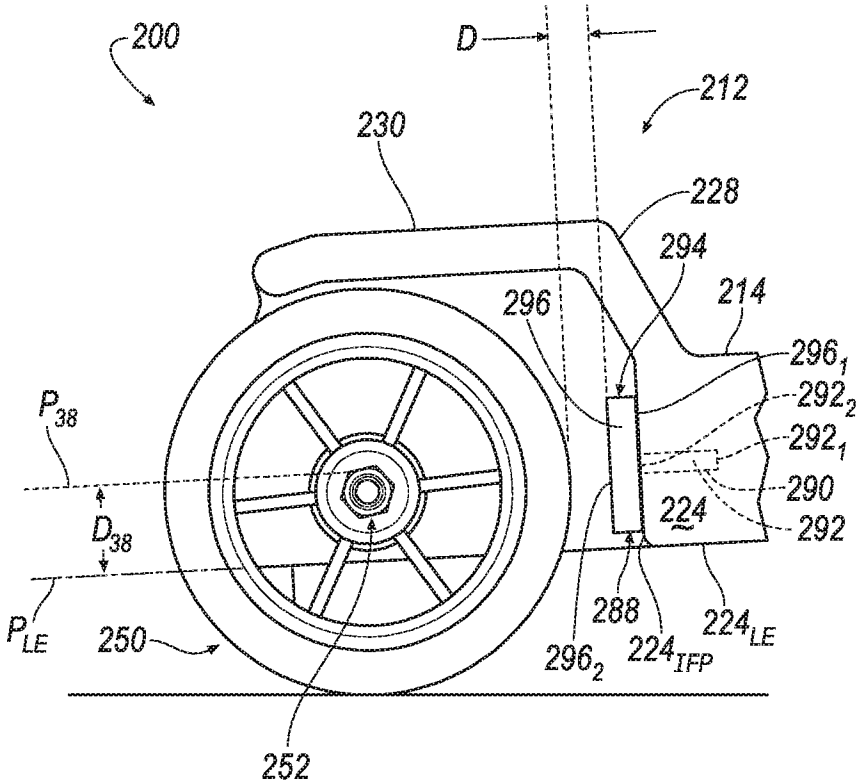
FIG. 18A is a partial front view of the exercise assembly of FIG. 17 illustrating a wheel rotation resistance device arranged in a first orientation.

The assembly 200 differs from the assembly 10 in that the assembly 200 includes one or more wheel rotation resistance devices 288 adjustably-connected to the body 212. In some instances as seen at FIGS. 17 and 18A-18B, the one or more wheel rotation resistance devices 288 include a first wheel rotation resistance device 288 extending from the intermediate front laterally-extending portion $\mathbf{224}_{IFP}$ of the second sidewall flange 224 and a second wheel rotation resistance device (not shown) extending from the intermediate front laterally-extending portion $\mathbf{222}_{IFP}$ of the first sidewall flange 222. In other configurations, the one or more wheel rotation resistance devices 288 may also include a third wheel rotation resistance device (not shown) extending from the intermediate rear laterally-extending portion $\mathbf{224}_{IRP}$ of the second sidewall flange 224 and a fourth wheel rotation resistance device (not shown) extending from the intermediate rear laterally-extending portion $\mathbf{222}_{IRP}$ of the first sidewall flange 222. Although the assembly 200 may include one pair or two pairs of wheel rotation resistance devices 288, the following description is directed to the operation of the first wheel rotation resistance device 288 extending from the intermediate front laterally-extending portion $\mathbf{224}_{IFP}$ of the second sidewall flange 224 and is not intended to be a limiting configuration of the exemplary assembly 200 (i.e., the assembly 200 may include one, two, three or four wheel rotation resistance devices 288).

As see at FIGS. 18A-18B, in some instances, a first threaded bore 290 extends into the body 212 from the front laterally-extending portion $\mathbf{224}_{IFP}$ of the second sidewall flange 224. Similarly, one or more of a second threaded bore (not shown), a third threaded bore (not shown), and a fourth threaded bore (not shown) extends into the body 212 from the front laterally-extending portion $\mathbf{222}_{IFP}$ of the first sidewall flange 222, the intermediate rear laterally-extending portion $\mathbf{224}_{IRP}$ of the second sidewall flange 224, and the intermediate rear laterally-extending portion $\mathbf{222}_{IRP}$ of the first sidewall flange 222.

The first wheel rotation resistance device 288 includes a threaded stem portion 292 having a first end $\mathbf{292}_1$ and a second end $\mathbf{292}_2$. The first threaded bore 290 is sized for receiving the threaded stem portion 292. The first end $\mathbf{292}_1$ of the threaded stem portion 292 is disposed within the first threaded bore 290. Although the second wheel rotation resistance device, the third wheel rotation resistance device, and the fourth wheel rotation resistance device are not shown as described above, a threaded stem portion of the second wheel rotation resistance device, the third wheel rotation resistance device, and the fourth wheel rotation resistance device are similarly sized for being received within, respectively, the second threaded bore, the third threaded bore, and the fourth threaded bore.

The first wheel rotation resistance device 288 also includes a tread-engaging portion 294 defined by a head portion 296. The head portion 296 includes a body-engaging surface $\mathbf{296}_1$ and a tread-engaging surface $\mathbf{296}_2$. The second end $\mathbf{292}_2$ of the threaded stem portion 292 is connected to and extends away from the body-engaging surface $\mathbf{296}_1$ of the head portion 296. Although the second wheel rotation resistance device, the third wheel rotation resistance device, and the fourth wheel rotation resistance device are not shown as described above, the second wheel rotation resistance device, the third wheel rotation resistance device, and the fourth wheel rotation resistance device also includes a tread-engaging portion having a head portion that are similarly connected to the respective stem portions of the second wheel rotation resistance device, the third wheel rotation resistance device, and the fourth wheel rotation resistance device.

With reference to FIGS. 18A-18B, the first wheel rotation resistance device 288 is movably-connected to the body 212 such that the body-engaging surface $\mathbf{296}_1$ of the head portion 296 of the first wheel rotation resistance device 288 is adjustably-arranged away from (see, e.g., FIG. 18B) or adjacent to (see, e.g., FIG. 18A) the laterally-extending portion $\mathbf{224}_{IFP}$ of the second sidewall flange 224. Movement toward or away from the laterally-extending portion $\mathbf{224}_{IFP}$ of the second sidewall flange 224 may arise from a user grasping the head portion 296 and imparting rotation thereto such that the threaded stem portion 292 is concurrently rotated in order to cause the first wheel rotation resistance device 288 to move out of or into the first threaded bore 290. The head portion of each of the second wheel rotation resistance device, the third wheel rotation resistance device, and the fourth wheel rotation resistance device may be similarly rotated for similarly adjustably-arranging the respective head portions of each of the second wheel rotation resistance device, the third wheel rotation resistance device, and the fourth wheel rotation resistance device as described above.

As seen at FIG. 18A, when the first wheel rotation resistance device 288 is adjustably-arranged adjacent to the laterally-extending portion $\mathbf{224}_{IFP}$ of the second sidewall flange 224 as described above, the second front wheel 250 is permitted to freely rotate in an unobstructed fashion as a result of the tread-engaging surface $\mathbf{296}_2$ of the head portion 296 of the first wheel rotation resistance device 288 being arranged at a distance D away from a tread surface of the second front wheel 250. Conversely, as seen at FIG. 18B, when the first wheel rotation resistance device 288 is adjustably-arranged away from the laterally-extending portion $\mathbf{224}_{IFP}$ of the second sidewall flange 224, the tread-engaging surface $\mathbf{296}_2$ of the head portion 296 of the first wheel rotation device 288 is no longer spaced apart from the tread surface of the second front wheel 250 at the distance D, and, as such the tread-engaging surface $\mathbf{296}_2$ of the head portion 296 of the first wheel rotation resistance device 288 engages a portion of the tread surface of the second front wheel 250 such that the second front wheel 250 is still permitted to rotate but in an obstructed fashion such that the first wheel rotation resistance device 288 resists rotation of the second front wheel 250. A user may selectively adjust the positioning of the head portion 296 of the first wheel rotation resistance device 288 away from the laterally-extending portion $\mathbf{224}_{IFP}$ of the second sidewall flange 224 at a desired positioning adjacent the portion of the tread surface of the second front wheel 250 in order selectively adjust an amount of radial force F (see, e.g., FIG. 18B) that the tread-engaging surface $\mathbf{296}_2$ of the head portion 296 radially imparts to the portion of the tread surface of the second front wheel 250. Although the operation of the head portion of the each of the second wheel rotation resistance device, the third wheel rotation resistance device, and the fourth wheel rotation resistance device is not shown in the drawings, the respective head portions may be operated in a similar manner as described above in order to respectively apply a selectively-adjusted amount of radial force F to each of, respectively, the first front wheel 246, the second rear wheel 258, and the first rear wheel 254.

Figure 19:
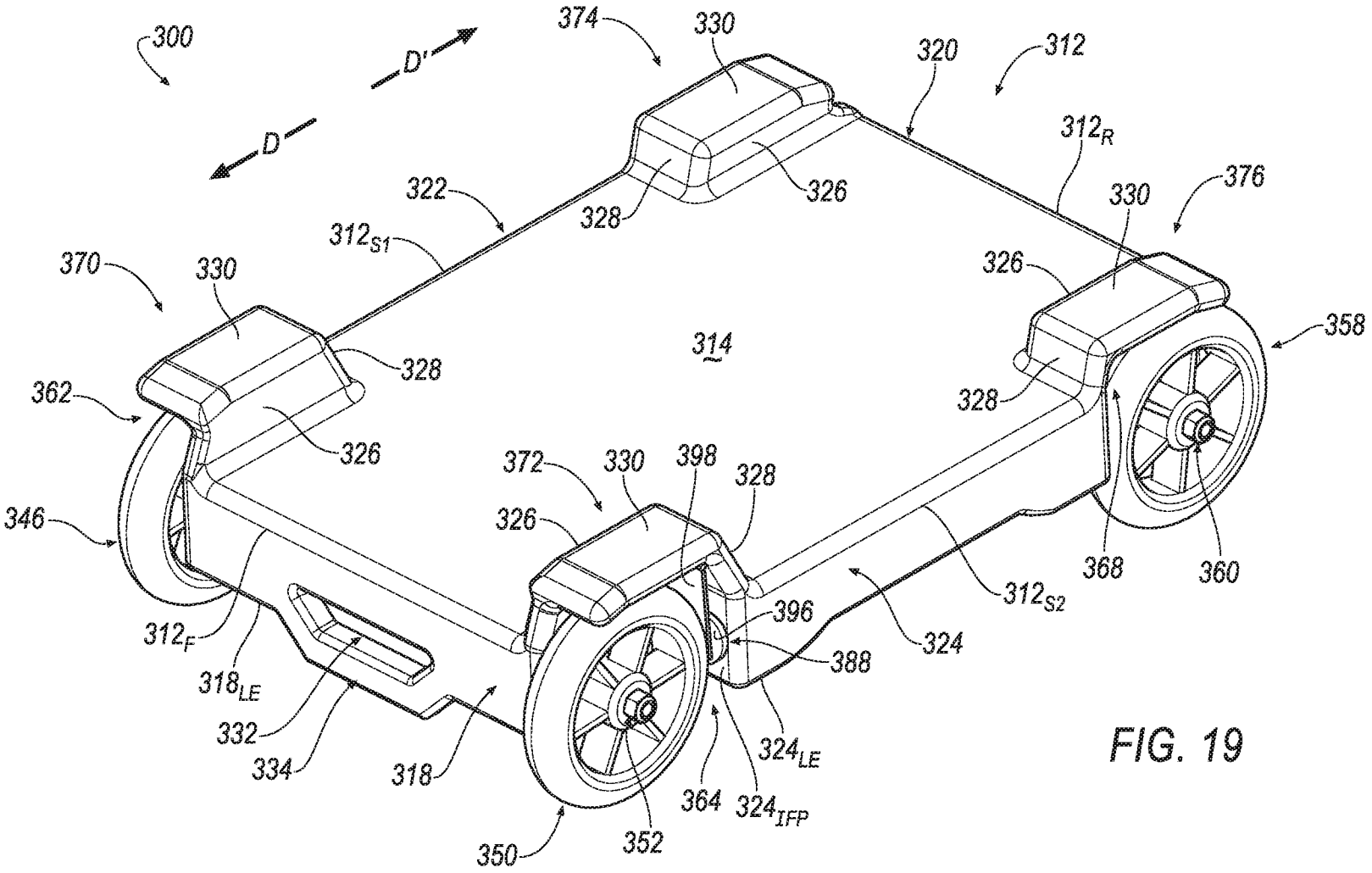
FIG. 19 is a perspective view of another exemplary exercise assembly.
Figure 20B:
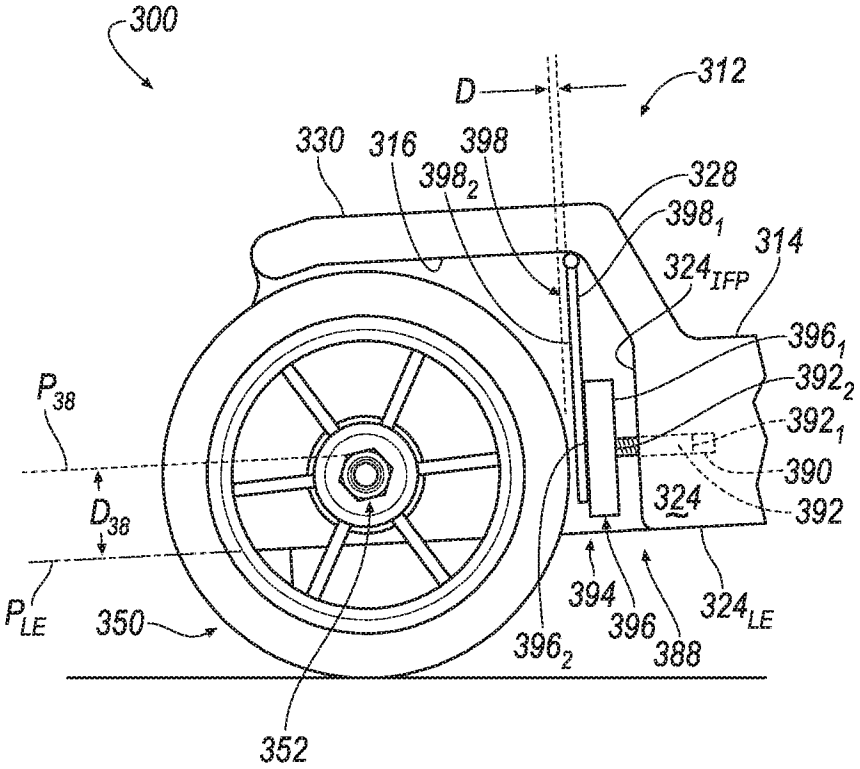
FIG. 20B is another partial front view of the exercise assembly of FIG. 20A illustrating the wheel rotation resistance device arranged in a second orientation.
Figure 20A:
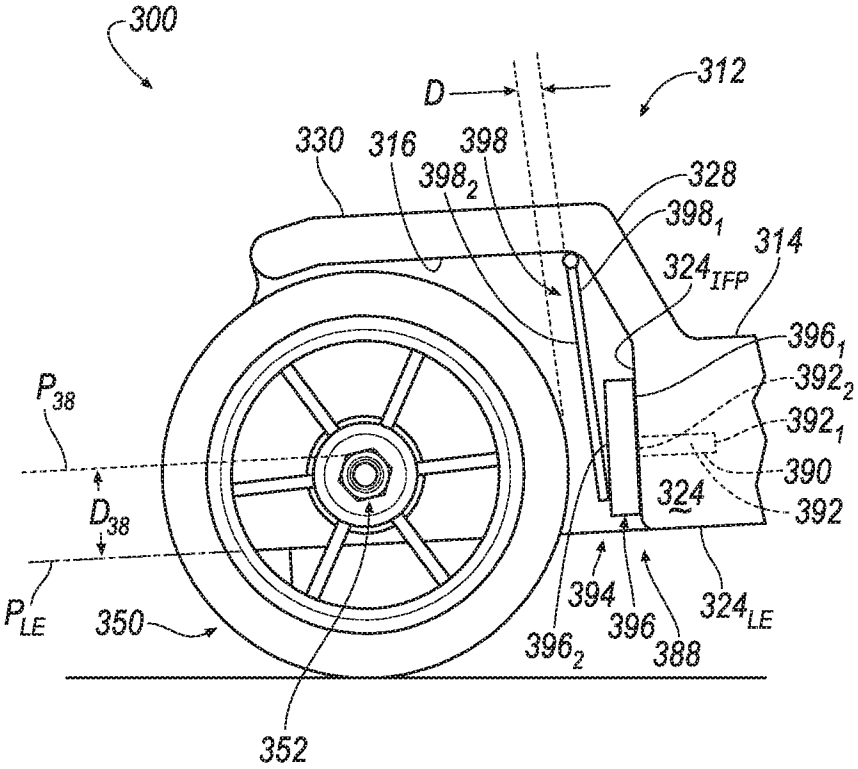
FIG. 20A is a partial front view of the exercise assembly of FIG. 19 illustrating a wheel rotation resistance device arranged in a first orientation.
Figure 20C:
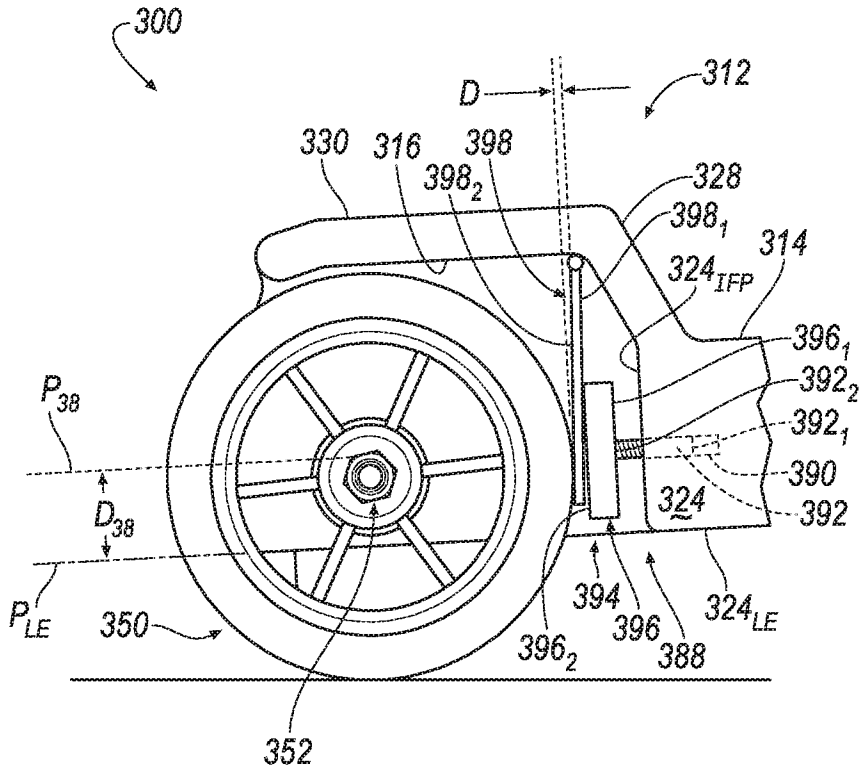
FIG. 20C is another partial front view of the exercise assembly of FIG. 20B illustrating the wheel rotation resistance device arranged in a third orientation.

Referring to FIGS. 19-20C, an exemplary assembly is shown generally at 300. The assembly 300 is substantially similar to the assembly 10 described above at FIGS. 1-10. Accordingly, the assembly 300 includes the same reference numeral pattern (see, e.g., the body 12 related to the assembly 10 and the body 312 related to the assembly 300), and, as such, the specific structural details associated with the assembly 200 are omitted here for purposes of brevity.

The assembly 300 differs from the assembly 10 in that the assembly 300 includes one or more wheel rotation resistance devices 388 adjustably-connected to the body 312 as seen at FIGS. 19 and 20A-20C. In some instances, a first wheel rotation resistance device of the one or more wheel rotation resistance devices 388 includes: (1) a first portion seen at reference numeral 396 extending from the intermediate front laterally-extending portion $\mathbf{324}_{IFP}$ of the second sidewall flange 324; and (2) a second portion seen at reference numeral 398 extending from the lower surface 316 of the body 312.

In other configurations, the one or more wheel rotation resistance devices 388 may also include: a second wheel rotation resistance device (not shown). In some instances, the second wheel rotation resistance device of the one or more wheel rotation resistance devices 388 includes: (1) a first portion (not shown, but refer to reference numeral 396 as described above) extending from the intermediate front laterally-extending portion $\mathbf{322}_{IFP}$ of the first sidewall flange 322; and (2) a second portion (not shown, but refer to reference numeral 398 as described above) extending from the lower surface 316 of the body 312.

In yet other configurations, the one or more wheel rotation resistance devices 388 may also include: a third wheel rotation resistance device (not shown). In some instances, the third wheel rotation resistance device of the one or more wheel rotation resistance devices 388 includes: (1) a first portion (not shown, but refer to reference numeral 396 as described above) extending from the intermediate rear laterally-extending portion $\mathbf{324}_{IRP}$ of the second sidewall flange 324; and (2) a second portion (not shown, but refer to reference numeral 398 as described above) extending from the lower surface 316 of the body 312.

In other configurations, the one or more wheel rotation resistance devices 388 may also include: a fourth wheel rotation resistance device (not shown). In some instances, the fourth wheel rotation resistance device of the one or more wheel rotation resistance devices 388 includes: (1) a first portion (not shown, but refer to reference numeral 396 as described above) extending from the intermediate rear laterally-extending portion $\mathbf{322}_{IRP}$ of the first sidewall flange 322; and (2) a second portion (not shown, but refer to reference numeral 398 as described above) extending from the lower surface 316 of the body 312.

Although the assembly 300 may include one pair or two pairs of wheel rotation resistance devices 388, the following description is directed to the operation of the first wheel rotation resistance device 388. Accordingly, the following description is not intended to be a limiting configuration of the exemplary assembly 300 (i.e., the assembly 300 may include one, two, three or four wheel rotation resistance devices 388).

As seen at FIGS. 20A-20C, in some instances, a first threaded bore 390 extends into the body 312 from the front laterally-extending portion $\mathbf{324}_{IFP}$ of the second sidewall flange 324. Similarly, one or more of a second threaded bore (not shown), a third threaded bore (not shown), and a fourth threaded bore (not shown) extends into the body 312 from the front laterally-extending portion $\mathbf{322}_{IFP}$ of the first sidewall flange 322, the intermediate rear laterally-extending portion $\mathbf{324}_{IRP}$ of the second sidewall flange 324, and the intermediate rear laterally-extending portion $\mathbf{322}_{IRP}$ of the first sidewall flange 322.

The first wheel rotation resistance device 388 includes a threaded stem portion 392 having a first end $\mathbf{392}_1$ and a second end $\mathbf{392}_2$. The first threaded bore 390 is sized for receiving the threaded stem portion 392. The first end $\mathbf{392}_1$ of the threaded stem portion 392 is disposed within the first threaded bore 390. Although the second wheel rotation resistance device, the third wheel rotation resistance device, and the fourth wheel rotation resistance device are not shown as described above, a thread stem portion of the second wheel rotation resistance device, the third wheel rotation resistance device, and the fourth wheel rotation resistance device are similarly sized for being received within, respectively, the second threaded bore, the third threaded bore, and the fourth threaded bore.

The first wheel rotation resistance device 388 also includes a tread-engaging portion 394. The tread-engaging portion 394 includes a head portion 396 and a flange portion 398. The head portion 396 of the tread-engaging portion 394 includes a body-engaging surface $\mathbf{396}_1$ and a flange-engaging surface $\mathbf{396}_2$. The second end $\mathbf{392}_2$ of the threaded stem portion 392 is connected to and extends away from the body-engaging surface $\mathbf{396}_1$ of the head portion 396 of the tread-engaging portion 394. Although the second wheel rotation resistance device, the third wheel rotation resistance device, and the fourth wheel rotation resistance device are not shown as described above, the second wheel rotation resistance device, the third wheel rotation resistance device, and the fourth wheel rotation resistance device also includes a tread-engaging portion including a head portion that are similarly connected to the respective stem portions of the second wheel rotation resistance device, the third wheel rotation resistance device, and the fourth wheel rotation resistance device.

The flange portion 398 of the tread-engaging portion 394 includes a head portion-engaging surface $\mathbf{398}_1$ and a tread-engaging surface $\mathbf{398}_2$. The flange portion 398 of the tread-engaging portion 394 extends from the lower surface 316 of the body 312 of the assembly 300 and is arranged proximate and extends across the flange-engaging surface $\mathbf{396}_2$ of the head portion 396. In some instances the flange portion 398 of the tread-engaging portion 394 may be hingedly-connected to the lower surface 316 of the body 312. In other examples, the flange portion 398 of the tread-engaging portion 394 may integrally extend from the lower surface 316 of the body 312 of the assembly 300. Although the second wheel rotation resistance device, the third wheel rotation resistance device, and the fourth wheel rotation resistance device are not shown as described above, the second wheel rotation resistance device, the third wheel rotation resistance device, and the fourth wheel rotation resistance device also includes a tread-engaging portion including a flange portion that extends from the lower surface 316 of the body 312 of the assembly 300 and are respectively arranged proximate and extends across the flange-engaging surface of the head portion of, respectively, the second wheel rotation resistance device, the third wheel rotation resistance device, and the fourth wheel rotation resistance device.

In some configurations, the head portion 396 and the flange portion 398 may both be made from a magnetic material. Accordingly, as seen at, for examples, FIGS. 20A-20B, the flange-engaging surface $\mathbf{396}_2$ of the head portion 396 is magnetically disposed adjacent the head portion-engaging surface $\mathbf{398}_1$ of the flange portion 398. Although the head portion 396 and the flange portion 398 may both be made from a magnetic material, the flange-engaging surface $\mathbf{396}_2$ of the head portion 396 may be connected, joined or otherwise disposed adjacent the head portion-engaging surface $\mathbf{398}_1$ of the flange portion 398 in other configurations such as, for example, a male-female mechanical coupling.

With reference to FIGS. 20A-20C, the first wheel rotation resistance device 388 is movably-connected to the body 312 such that the body-engaging surface $\mathbf{396}_1$ of the head portion 396 of the first wheel rotation resistance device 388 is adjustably-arranged adjacent to (see, e.g., FIG. 20A) or away from (see, e.g., FIG. 20C) the laterally-extending portion $\mathbf{324}_{IFP}$ of the second sidewall flange 324. The head portion 396 of the first wheel rotation resistance device 388 may also be adjustably-arranged in an intermediate orientation (see, e.g., FIG. 20B) with respect to the laterally-extending portion $\mathbf{324}_{IFP}$ of the second sidewall flange 324. Movement toward or away from the laterally-extending portion $\mathbf{324}_{IFP}$ of the second sidewall flange 324 may arise from a user grasping the head portion 396 and imparting rotation thereto such that the threaded stem portion 392 is concurrently rotated in order to cause the head portion 396 of the first wheel rotation resistance device 388 to move out of or into the first threaded bore 390. The head portion of each of the second wheel rotation resistance device, the third wheel rotation resistance device, and the fourth wheel rotation resistance device may be similarly rotated for similarly adjustably-arranging the respective head portions of each of the second wheel rotation resistance device, the third wheel rotation resistance device, and the fourth wheel rotation resistance device as described above.

As seen at FIG. 20A, when the head portion 396 of the first wheel rotation resistance device 388 is adjustably-arranged adjacent the laterally-extending portion $\mathbf{324}_{IFP}$ of the second sidewall flange 324 as described above (or in an intermediate orientation as seen at, for example, FIG. 20B), the second front wheel 350 is permitted to freely rotate in an unobstructed fashion. Rotation of the second front wheel 350 in an unobstructed fashion arises from the head portion 396 not urging the tread-engaging surface $\mathbf{398}_2$ of the flange portion 398 adjacent the second front wheel 350; accordingly, as seen at FIGS. 20A and 20B, the tread-engaging surfaces $\mathbf{398}_2$ of the flange portion 398 is spaced apart from the portion of the tread surface of the second front wheel 350 at a distance D. Conversely, as seen at FIG. 20C, when the head portion 396 of the first wheel rotation resistance device 388 is adjustably-arranged away from the laterally-extending portion $\mathbf{324}_{IFP}$ of the second sidewall flange 324, the flange-engaging surface $\mathbf{396}_2$ of the head portion 396 of the first wheel rotation device 388 urges the tread-engaging surface $\mathbf{398}_2$ of the flange portion 398 adjacent the portion of the tread surface of the second front wheel 350 such that the tread-engaging surface $\mathbf{398}_2$ of the flange portion 398 is no longer spaced apart from the portion of the tread surface of the second front wheel 350 at the distance D. As such, the tread-engaging surface $\mathbf{398}_2$ of the flange portion 398 of the first wheel rotation resistance device 388 engages a portion of the tread surface of the second front wheel 350 such that the second front wheel 350 is still permitted to rotate but in an obstructed fashion such that the first wheel rotation resistance device 388 resists rotation of the second front wheel 350. A user may selectively adjust the head portion 396 of the first wheel rotation resistance device 388 away from the laterally-extending portion $\mathbf{324}_{IFP}$ of the second sidewall flange 324 at a desired positioning such that the head portion 396 urges the tread-engaging surface $\mathbf{398}_2$ of the flange portion 398 adjacent the portion of the tread surface of the second front wheel 350 in order selectively adjust an amount of radial force F (see, e.g., FIG. 20C) that the tread-engaging surface $\mathbf{398}_2$ of the flange portion 398 radially imparts to the portion of the tread surface of the second front wheel 350.

Figure 21:
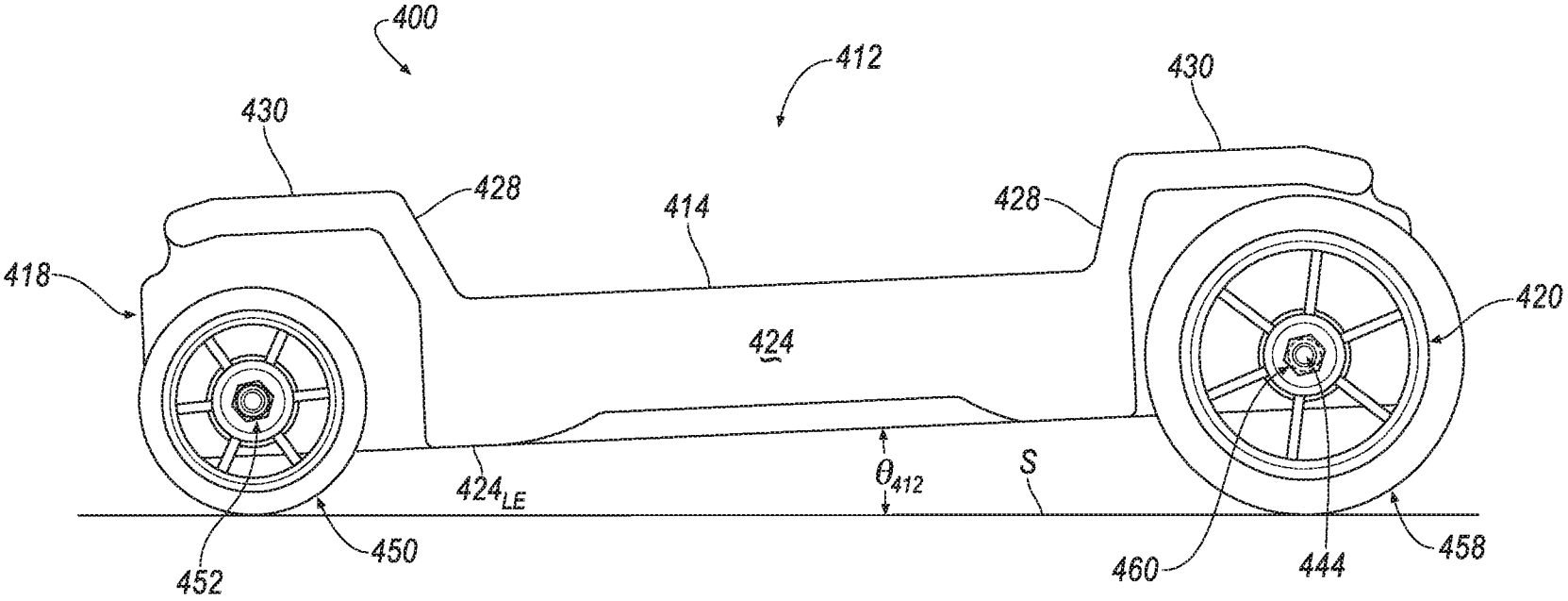
FIG. 21 is a perspective view of another exemplary exercise assembly.

Referring to FIG. 21, an exemplary assembly is shown generally at 400. The assembly 400 is substantially similar to the assembly 10 described above at FIGS. 1-10. Accordingly, the assembly 400 includes the same reference numeral pattern (see, e.g., the body 12 related to the assembly 10 and the body 412 related to the assembly 400), and, as such, the specific structural details associated with the assembly 100 are omitted here for purposes of brevity.

The assembly 400 differs from the assembly 10 in that one or more structural aspects of the assembly 400 is/are omitted in comparison to the assembly 10. In some instances, the assembly 400 may not include, for example, the axle-receiving projection 36; accordingly, each rear axle-receiving opening 442 may be formed by each of the first sidewall flange 422 and the second sidewall flange 424 for receiving the rear axle member 444. Furthermore, the assembly 400 differs from the assembly 10 in that the first front wheel 446 and the second front wheel 450 are defined by smaller wheel diameters in comparison to the first rear wheel 454 and the second rear wheel 458; accordingly, the differences in diameter of the front wheels 446, 450 in comparison to the rear wheels 454, 458 provides an angular pitch (see, e.g., the angle $\theta_{412}$) of the body 412 that is substantially similar to the orientation (see, e.g., the angle $\theta_{12}$) of the body 12 when the four wheels 46, 50, 54, 58 are disposed upon an underlying support surface S.

Figure 22:
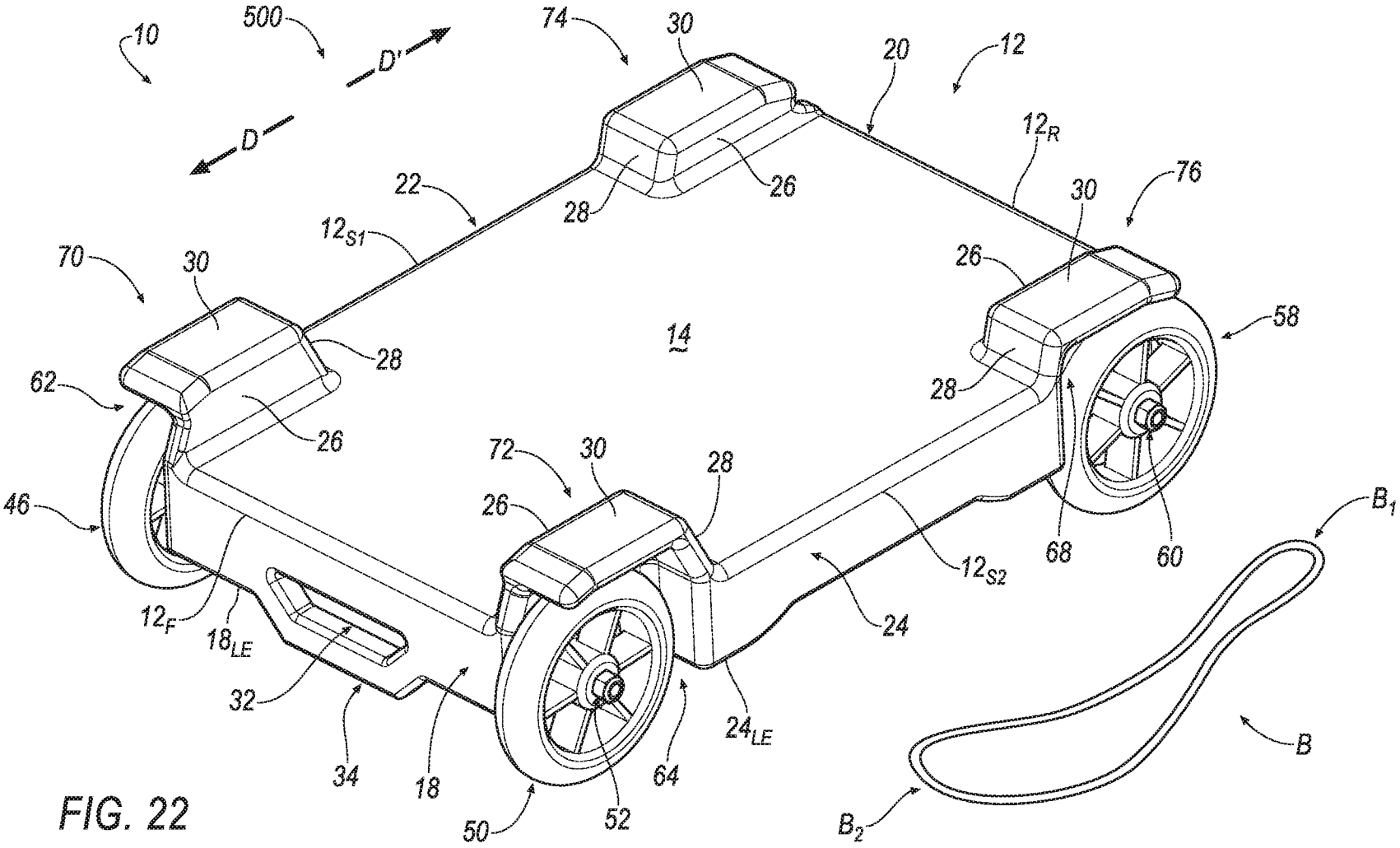
FIG. 22 is a perspective view of an exercise system including a resistance band and any of the exercise assemblies of FIGS. 1-19 arranged in a first configuration.
Figure 23:
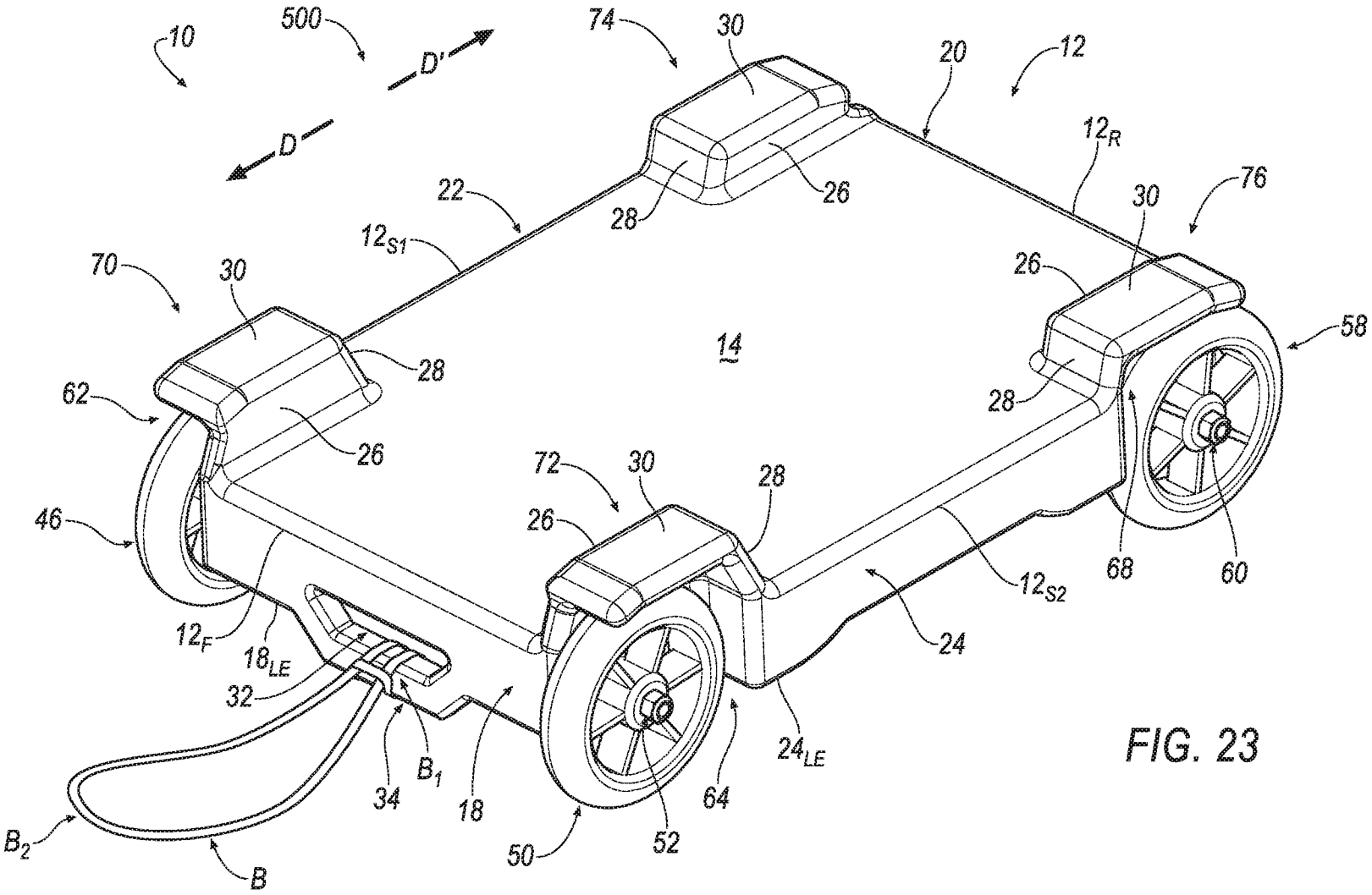
FIG. 23 is a perspective view of the exercise system of FIG. 22 arranged in a second configuration.
Figure 24:
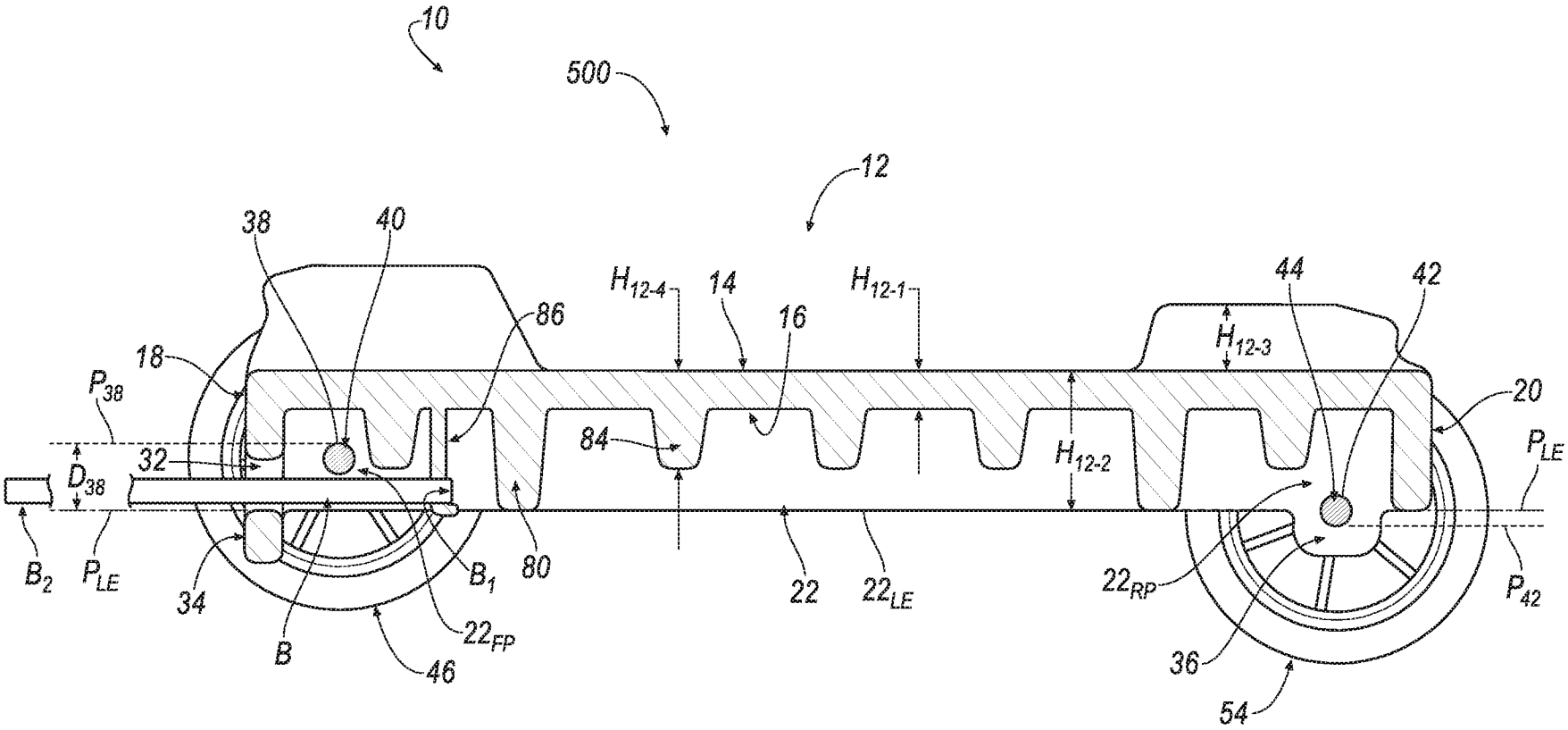
FIG. 24 is a cross-sectional view of an exemplary system including an exercise band and the exemplary exercise assembly of FIG. 7'.

Referring to FIGS. 22-24, an exemplary exercise system is shown generally at 500. Although FIGS. 22-24 illustrates the resistance band B interfaced with the exemplary assembly 10, the exercise system 500 may include any of the exemplary assemblies 10, 200, 300, and 400. In some instances as seen at, for example, FIG. 23, the first end $B_1$ of the resistance band B may be removably-secured to (e.g., looped around, tied-to, or knotted-to) the handle portion 34/234/334/434 of the assembly 10/200/300/400. In other examples as seen at, for example, FIGS. 7' and 24, the first end $B_1$ of the resistance band B may be removably-secured to the one or more optional ribs or hooks 86 (see, e.g., FIG. 7') in order to permit the second end $B_2$ of the resistance band B to be extended through the opening 32/232/332/442 (see, e.g., FIG. 24) formed by the front flange 18/218/318/418 such that the second end $B_2$ of the resistance band B extends beyond the front flange 18/218/318/418 and is not arranged opposite the lower surface 16/216/316/416 of the body 12/212/312/412; although not shown, any of the exemplary assemblies 200, 300, and 400 may also include the one or more optional ribs or hooks 86 in order to permit passage of the resistance band through the opening 232/332/442 formed by the front flange 218/318/418 as described above.

With reference to FIGS. 25A-25E, a user U is shown utilizing the exemplary exercise system 500 that includes the resistance band B and any of the exemplary assemblies 10, 200, 300, and 400. Regions of the user U are generally defined by an upper body or arm region $U_U$, an intermediate or core region $U_I$ and a lower body region $U_L$. The lower body region $U_L$ includes one or more of the user's leg(s), knee(s) and/or foot/feet.

As seen at FIGS. 25A-25E, the user U utilizes the exemplary exercise system 500 for conducting a leg adduction exercise routine. In some instances, the user U may arrange the second end $B_2$ of the resistance band B over an exercise step $S_S$. Then, the user may step on (with the user's right foot) the second end $B_2$ of the resistance band B in order to secure or anchor the second end $B_2$ of the resistance band B over the exercise step $S_S$. Then, with the first end $B_1$ of the resistance band B being removably-secured to the exemplary assembly 10/200/300/400 as described above, the user U may step on (with the user's left foot) the upper surface 14/214/314/414 of the body 12/212/312/412 of the exemplary assembly 10/200/300/400.

Figure 25A:
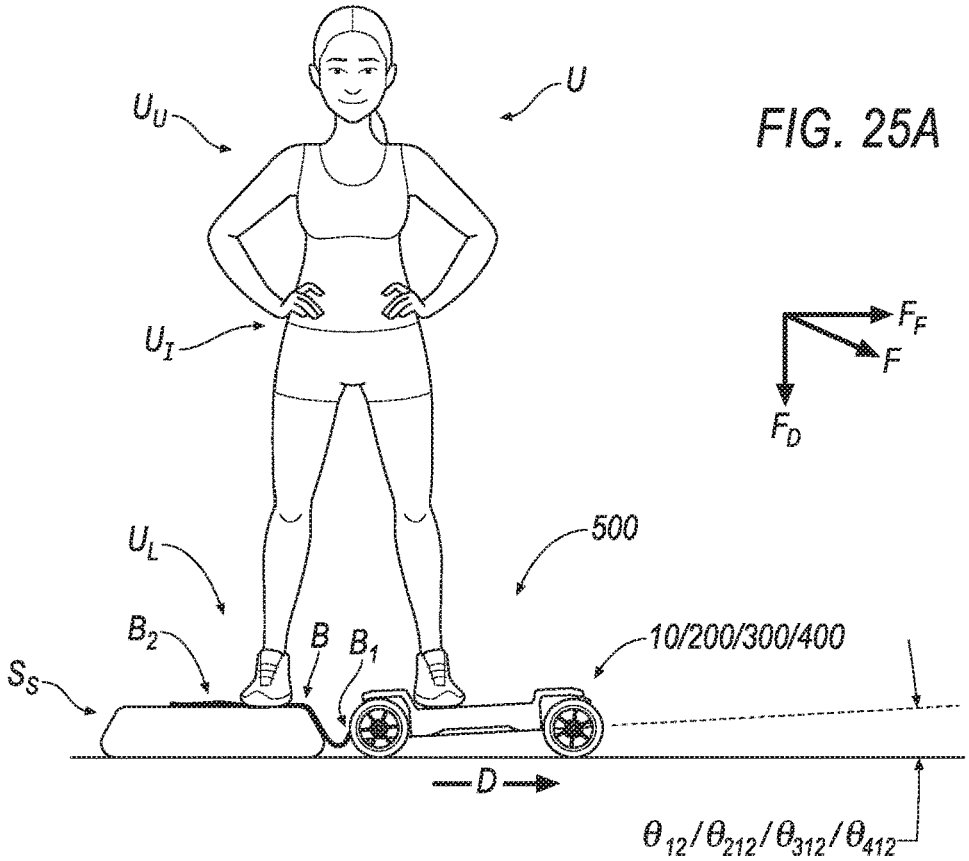
FIGS. 25A-25E are side views of a user utilizing any of the exercise systems of FIGS. 22-24.
Figure 25B:
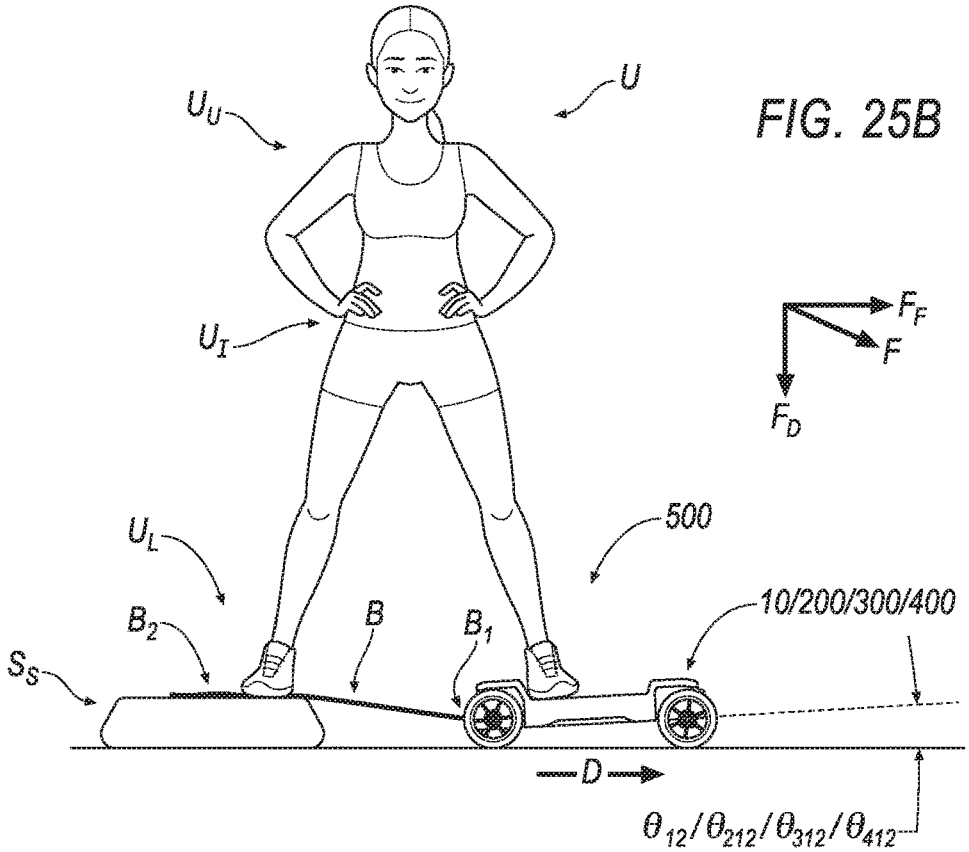
Figure 25C:
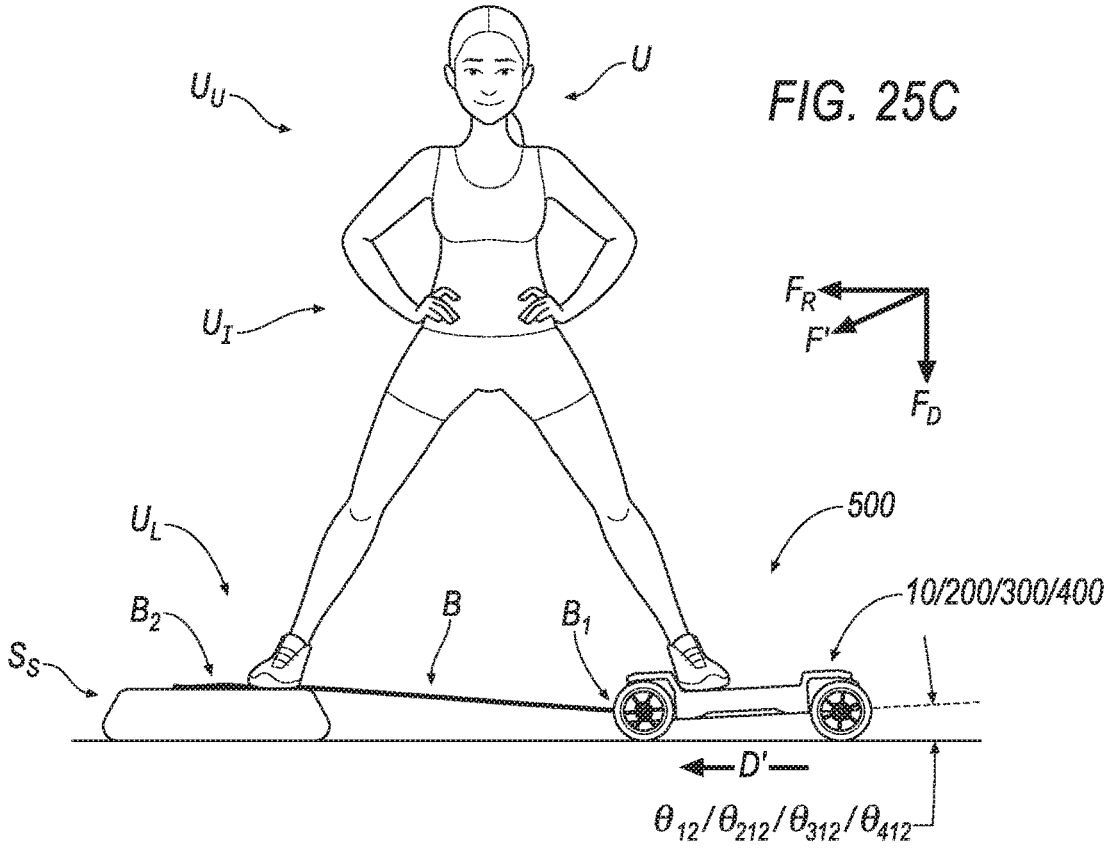
Figure 25D:
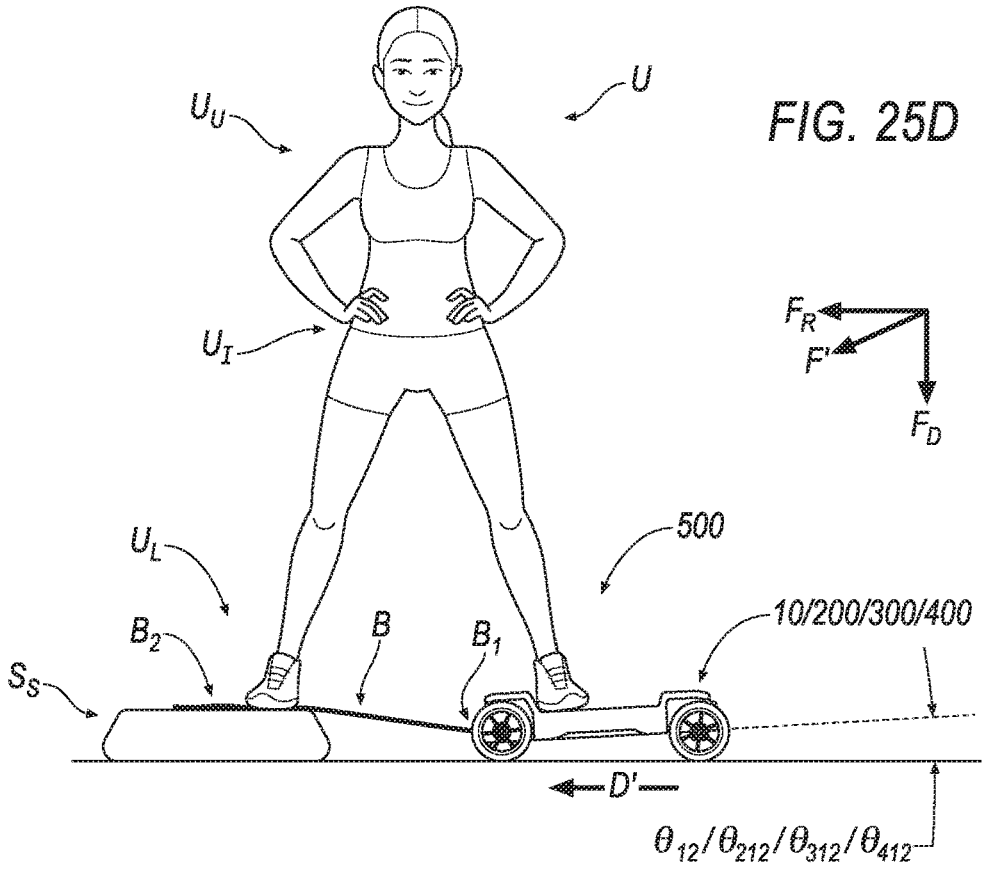

Then, as seen at 25A-25B, the left foot of the user U may urge (with a first force F that is opposite a second force F' as seen at FIGS. 25C-25D) the assembly 10/200/300/400 in a first direction D (that is opposite a second D' as seen at FIGS. 25C-25D). The first or forward force F in the first direction D applied to the upper surface 14/214/314/414 of the body 12/212/312/412 includes a downward force component $F_D$ and a forward force component $F_F$. The downward force component $F_D$ may be substantially perpendicular to the underlying support surface S. The forward force component $F_F$ may be parallel to the underlying support surface S. As a result of the upper surface 14/214/314/414 of the body 12/212/312/412 being pitched at the angle (see, e.g., the angle $\theta_{12}/\theta_{212}/\theta_{312}/\theta_{412}$) with respect to the underlying support surface S, the upper surface 14/214/314/414 provides a biasing surface that supports the user's left foot as the user U applies the first or forward force F to the upper surface 14/214/314/414 of the body 12/212/312/412 for urging the body 12/212/312/412 in the first/forward direction D. As a result of applying the first or forward force F, the assembly 10/200/300/400 movably-transports the user's lower body (e.g. the user's left leg and left foot) $U_L$ in a direction away from the exercise step $S_S$.

Thereafter, as seen at FIGS. 25C and 25D, the user's left foot applies a second or rearward force F' to the upper surface 14/214/314/414 of the body 12/212/312/412 in order to cause the assembly 10/200/300/400 to movably-transport the user's lower body or foot region $U_L$ in a direction toward the exercise step $S_S$ in the second/rearward direction D'. The second or rearward force F' applied to the upper surface 14/214/314/414 of the body 12/212/312/412 includes the downward force component $F_D$ and a rearward force component $F_R$. The downward force component $F_D$ may be substantially perpendicular to the underlying support surface S. The rearward force component $F_R$ may be parallel to the underlying support surface S.

Although the upper surface 14/214/314/414 of the body 12/212/312/412 is pitched at the angle (see, e.g., angle $\theta_{12}/\theta_{212}/\theta_{312}/\theta_{412}$) with respect to the underlying support surface S, the downward force component $F_D$ applied to the upper surface 14/214/314/414 may be greater than the rearward force component $F_R$ as the user U applies the second or rearward force F' to the upper surface 14/214/314/414 of the body 12/212/312/412 for urging the body 12/212/312/412 in the second/rearward direction D' such that the user's left foot remains adjacent the upper surface 14/214/314/414 of the body 12/212/312/412 and therefore is not dislodged or removed therefrom during the course of movement in the second/rearward direction D'. As a result of applying the second or rearward force F', the assembly 10/200/300/400 movably-transports the user's lower body or foot region $U_L$ in a direction toward from the exercise step $S_S$.

Figure 25E:
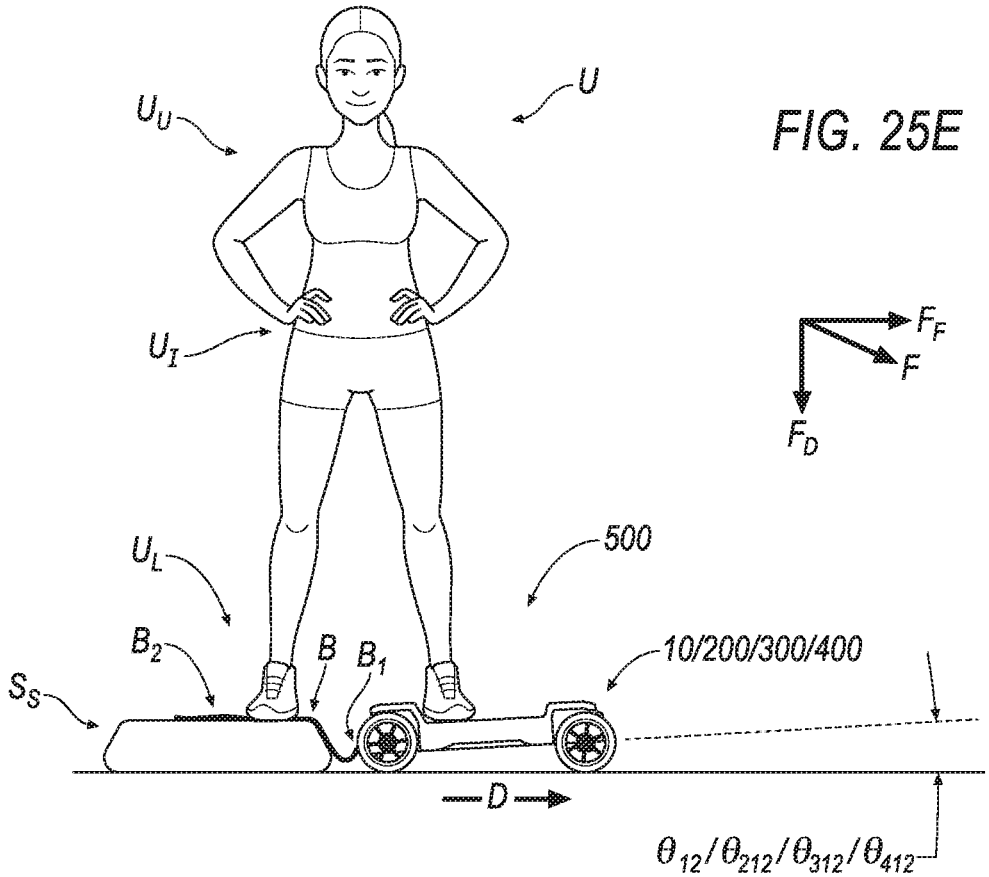
Figure 26A:
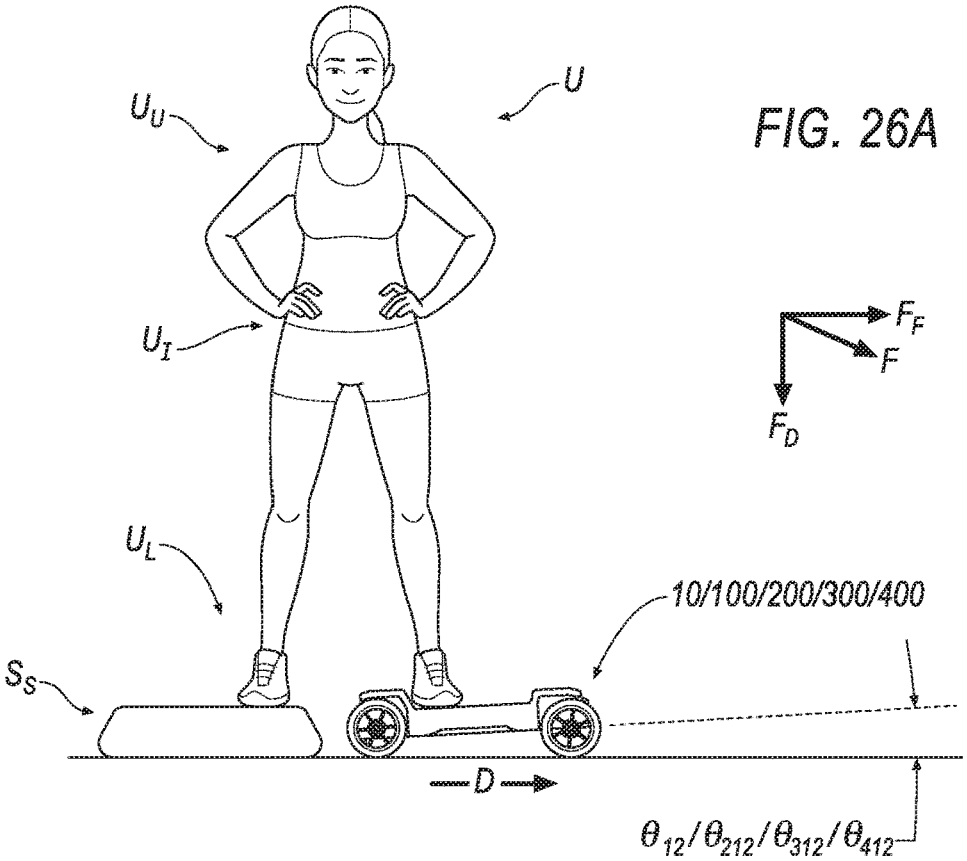
FIGS. 26A-26E are side views of a user utilizing any of the exercise assemblies of FIGS. 1-19.
Figure 26B:
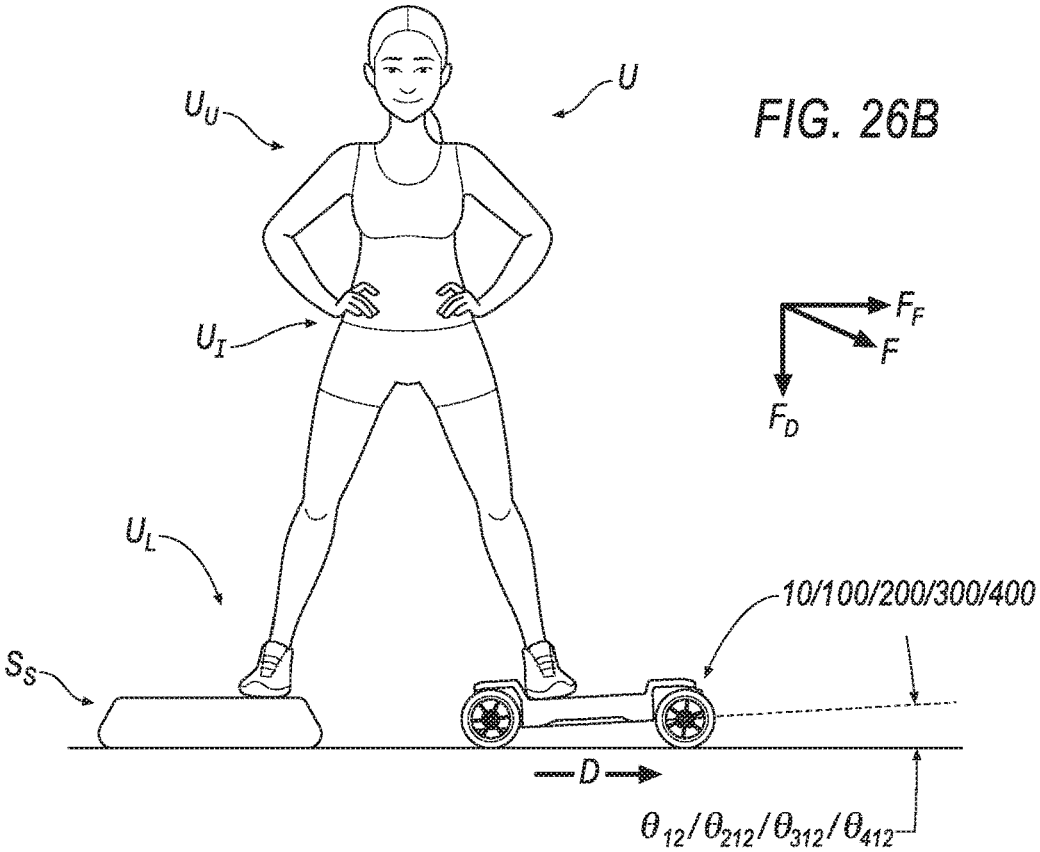
Figure 26C:
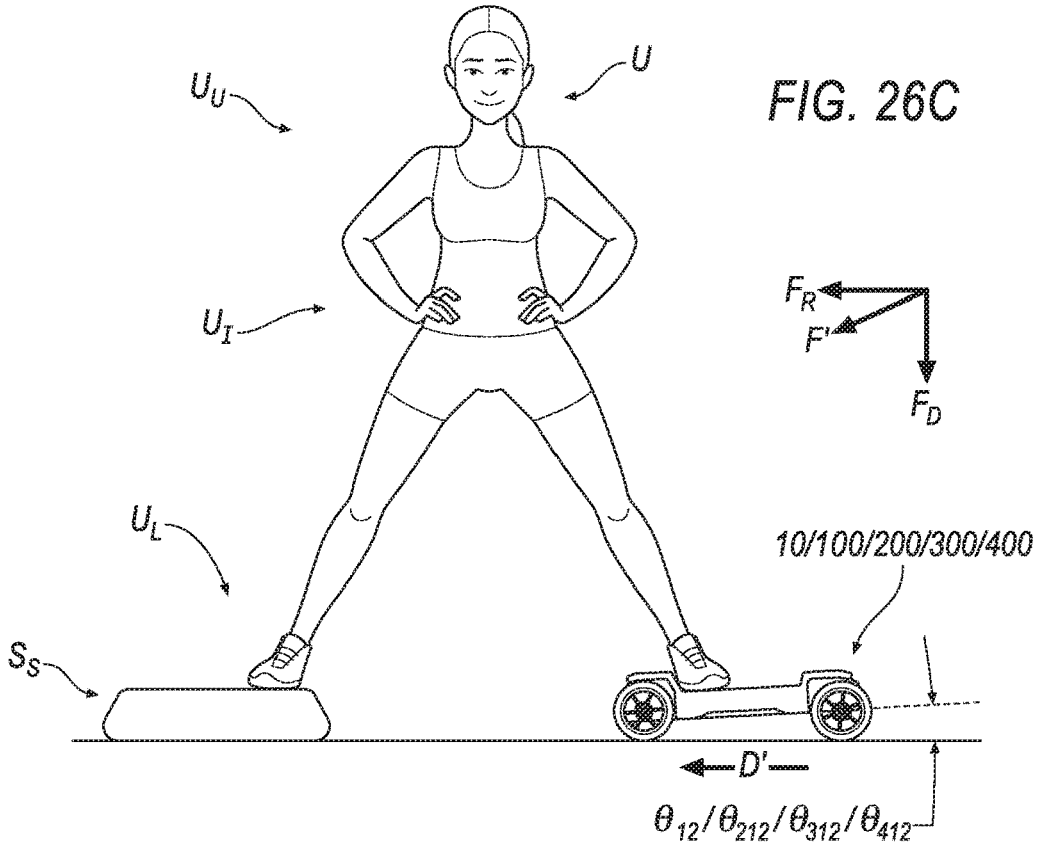
Figure 26D:
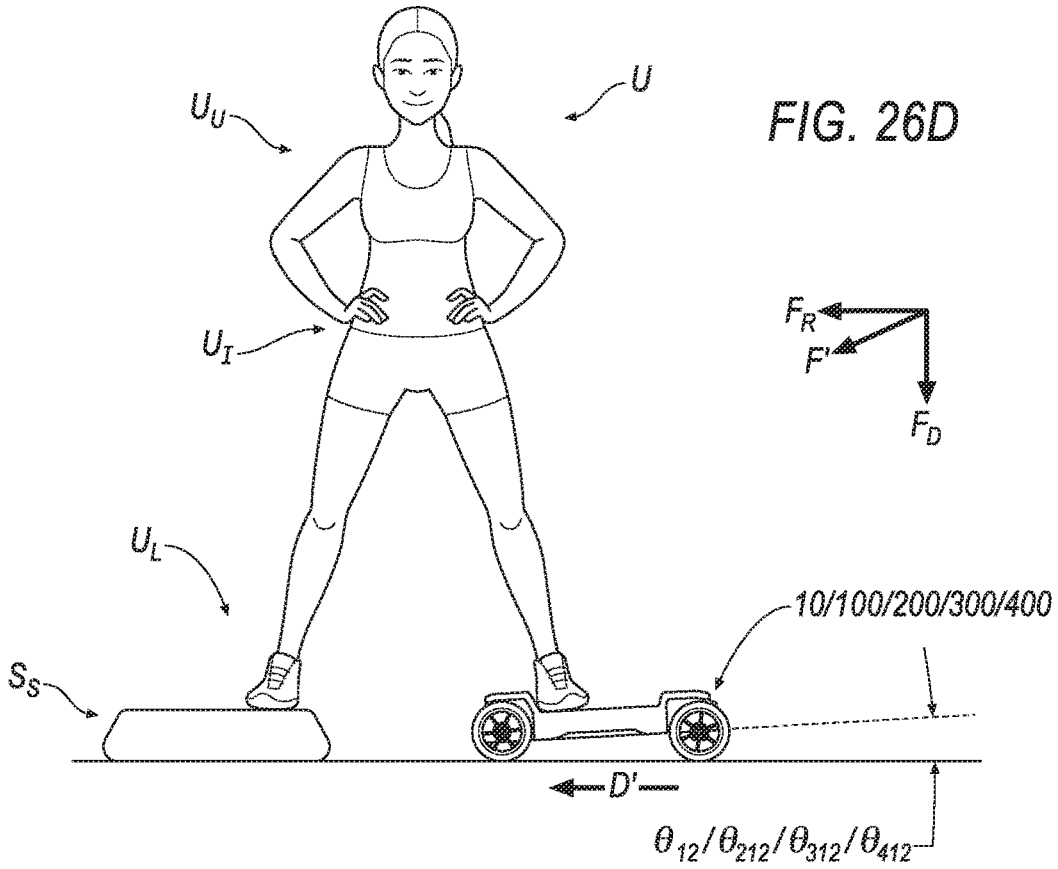
Figure 26E:
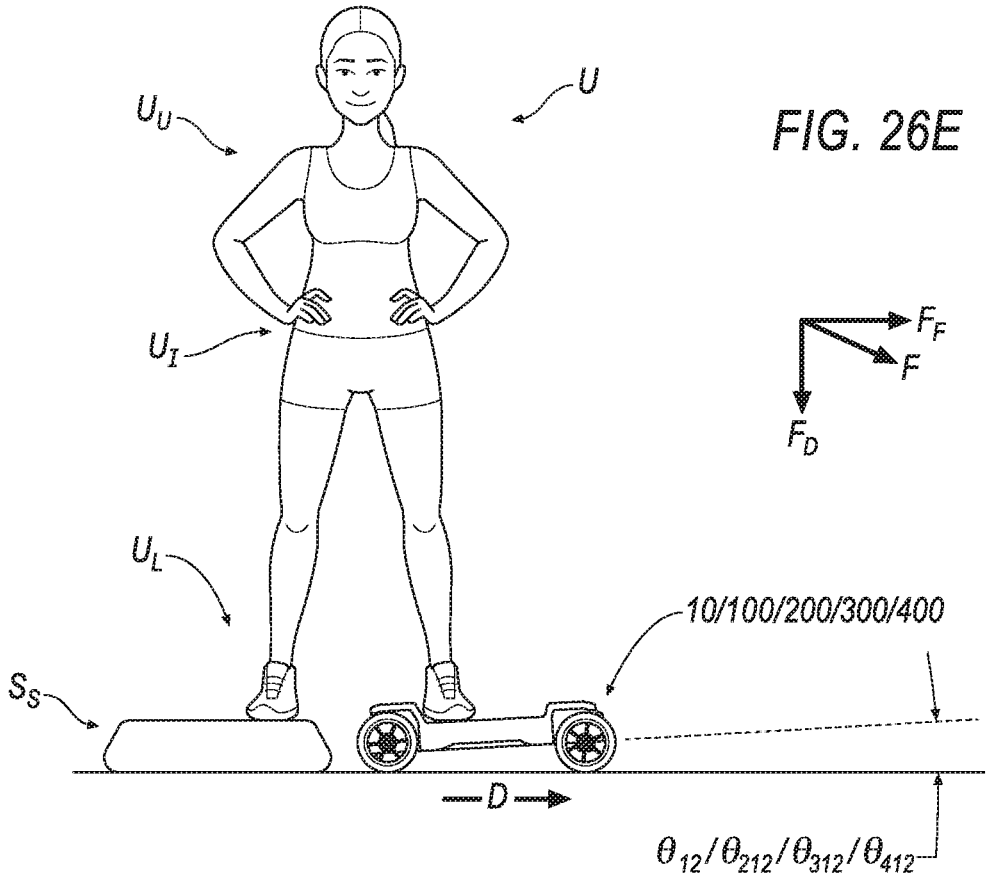

As a result of applying the second or rearward force F', the assembly 10/200/300/400 movably-transports the user's left lower body (e.g. the user's left leg and left foot) $U_L$ in a direction toward the exercise step $S_S$. Thereafter, the user U may continue to apply the second or rearward force F' such that the assembly 10/200/300/400 movably-transports the user's left lower body (e.g. the user's left leg and left foot) $U_L$ in a direction further toward the exercise step $S_S$ such that user's left lower body (e.g. the user's left leg and left foot) $U_L$ is returned to an at-rest orientation as seen at FIG. 25E (that is substantially similar to the user's initial pose at FIG. 25A).

Referring to FIGS. 26A-26E, the user U utilizes any of the exemplary assemblies 10, 100, 200, 300, and 400 described above at FIGS. 1-21 for conducting a leg adduction exercise routine that is substantially similar to the leg adduction exercise routine described above at FIGS. 25A-25E. Unlike the exemplary leg adduction exercise routine described above at FIGS. 25A-25E, a resistance band B is not interfaced or connected to any of the exemplary assemblies 10, 100, 200, 300, and 400 at FIGS. 26A-26E. Accordingly, inclusion of the resistance band B with the any of the exemplary assemblies 10, 200, 300, and 400 at FIGS. 25A-25E results in resistance being applied to the any of the exemplary assemblies 10, 200, 300, and 400 when the user U urges any of the exemplary assemblies 10, 200, 300, and 400 in the first direction D with the first or forward force F. Conversely, in connection with the leg adduction exercise routine described at FIGS. 26A-26E, the lack of inclusion of a resistance band B results in no resistance being applied to the any of the exemplary assemblies 10, 100, 200, 300, and 400 when the user U urges any of the exemplary assemblies 10, 100, 200, 300, and 400 in the first direction D with the first or forward force F.

As seen at FIGS. 27A-27E, the user U utilizes the exemplary exercise system 500 for conducting a "dynamic" plank exercise pose. In some instances, the user U may arrange the second end $B_2$ of the resistance band B under an exercise step $S_S$. Meanwhile, the user U may removably-secure the first end $B_1$ of the resistance band B to any of the exemplary assemblies 10, 200, 300, and 400 as described above.

Referring to FIGS. 28A-28E, the user U may utilize any of the exemplary assemblies 10, 100, 200, 300, and 400 described above at FIGS. 1-21 for conducting a "dynamic" plank exercise pose. In a substantially similar manner as described above with respect to the differences between the leg adduction exercise routines at FIGS. 25A-25E and 26A-26E, the lack of inclusion of a resistance band B at FIGS. 28A-28E results in no resistance being applied to the any of the exemplary assemblies 10, 100, 200, 300, and 400 when the user U urges the any of the exemplary assemblies 10, 200, 300, and 400 away from the exercise step $S_S$.

Figure 28A:
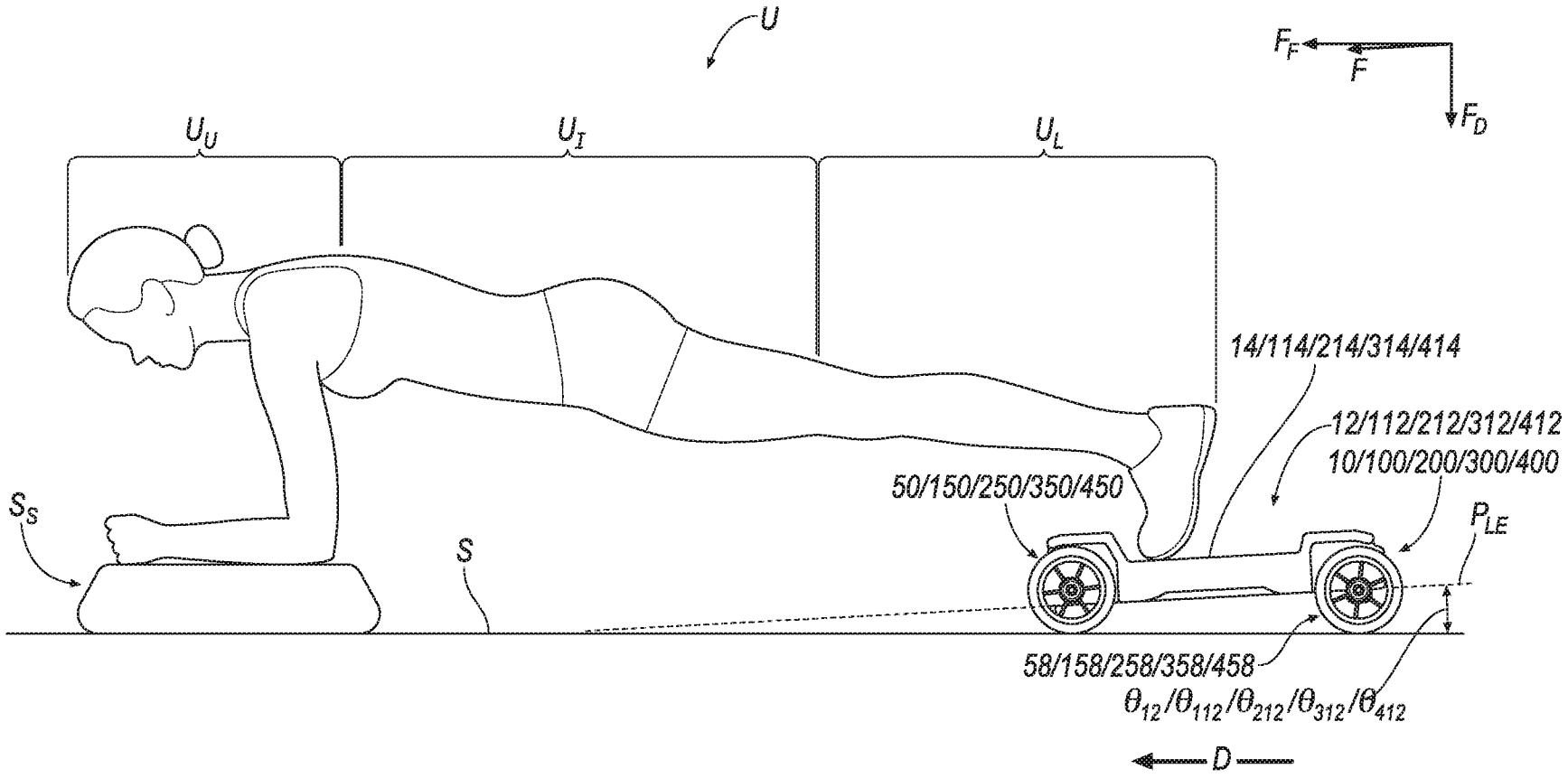
FIGS. 28A-28E are side views of a user utilizing any of the exercise assemblies of FIGS. 1-19.
Figure 28B:
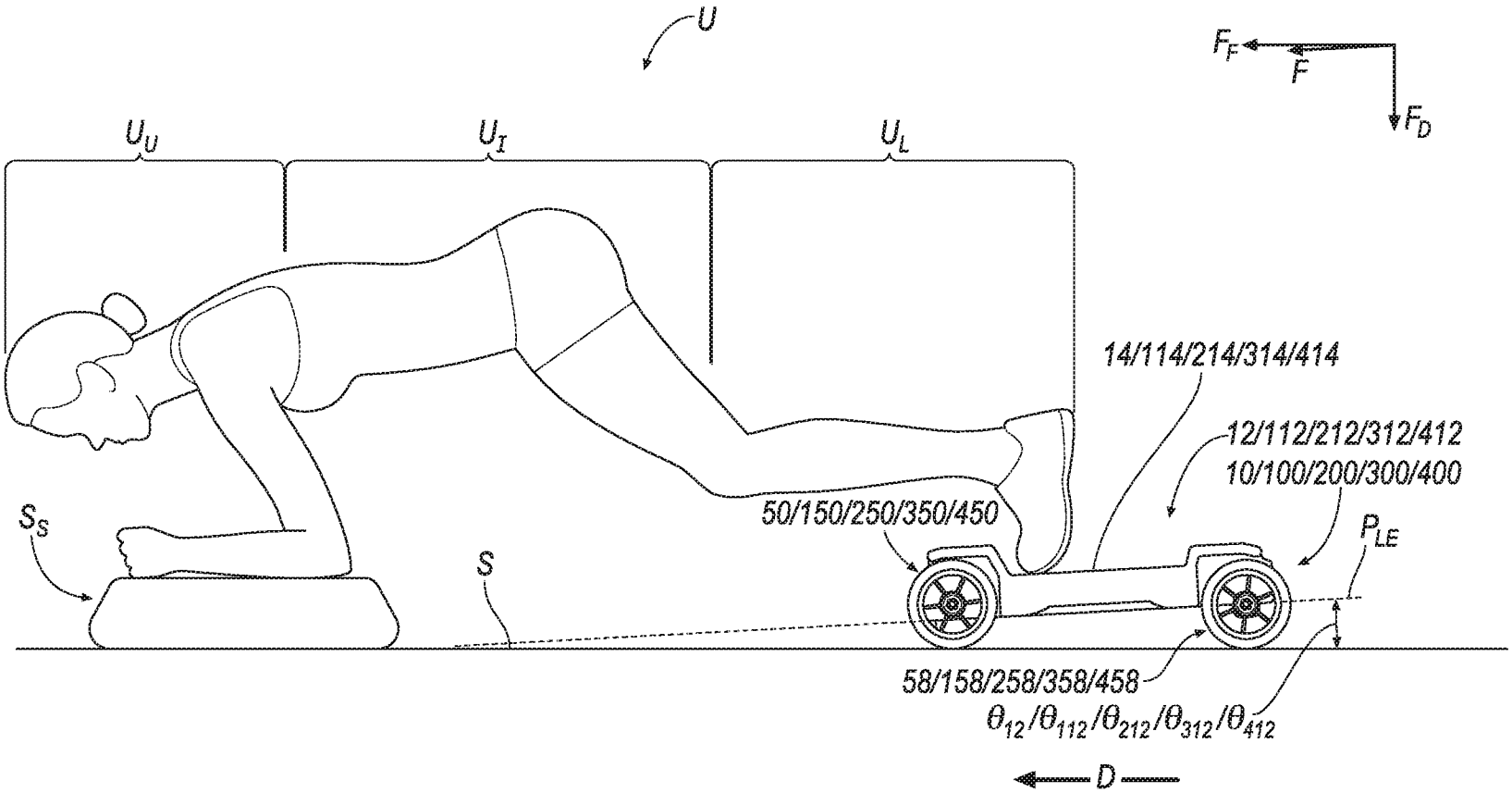
Figure 28C:
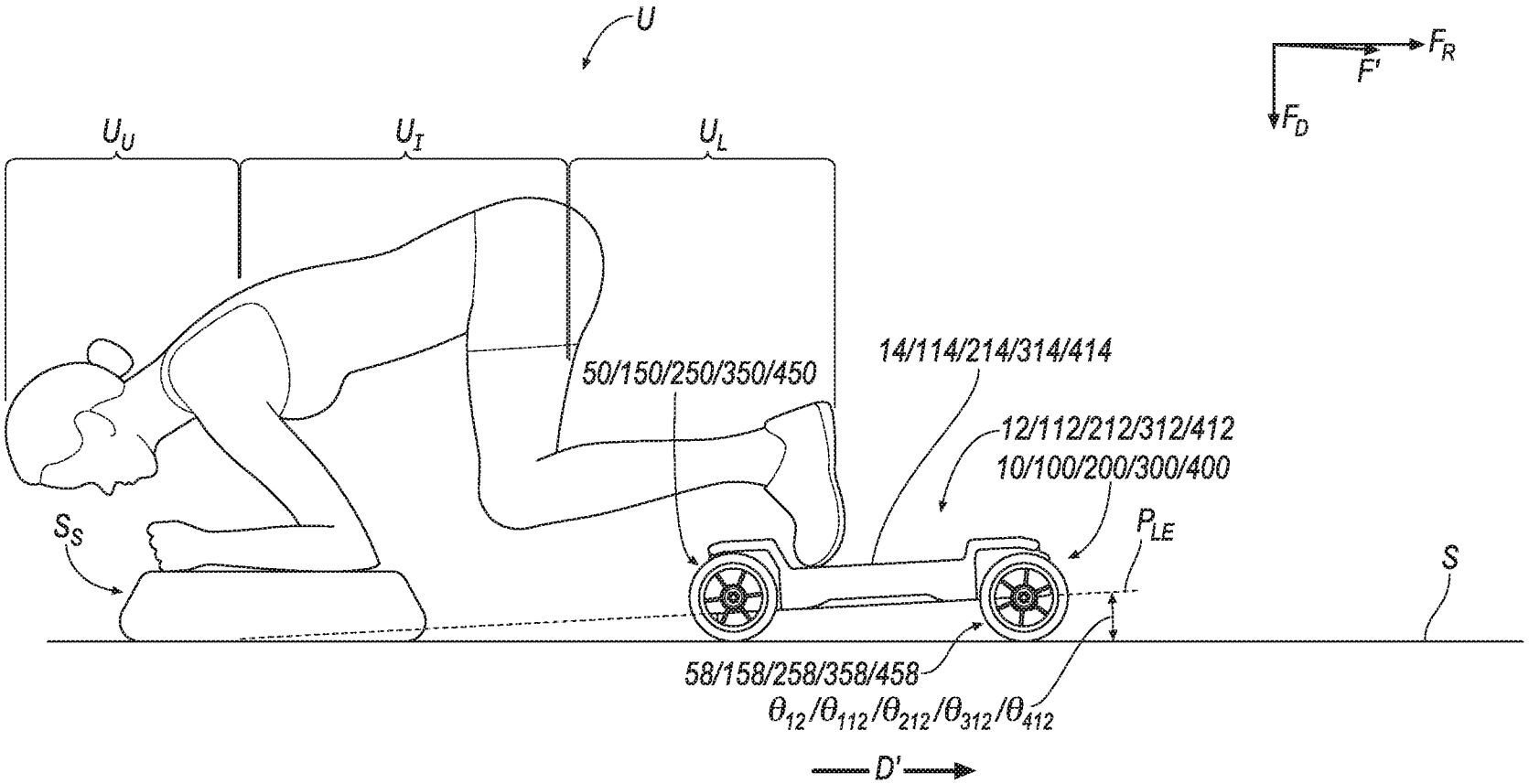
Figure 28D:
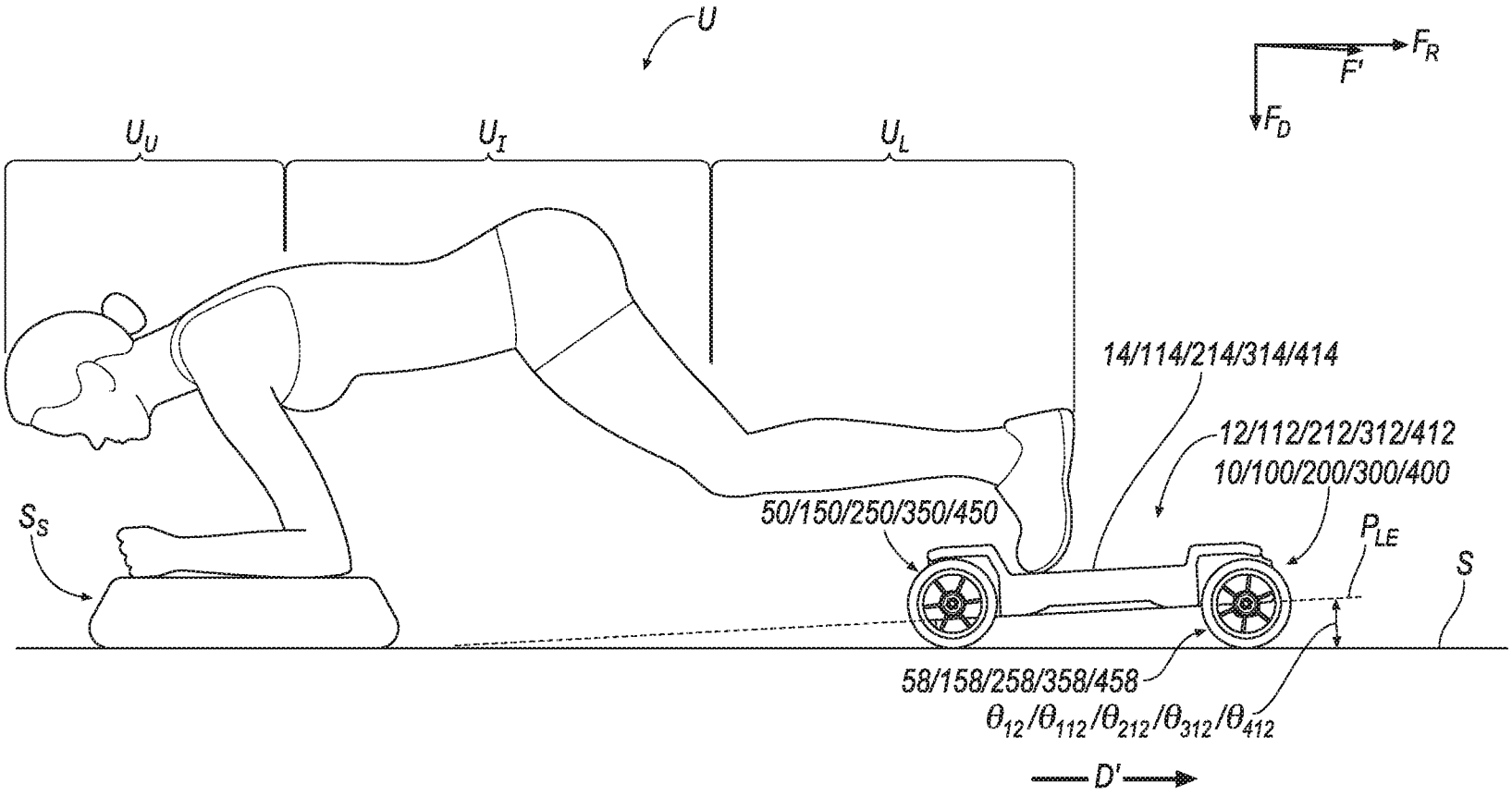
Figure 28E:
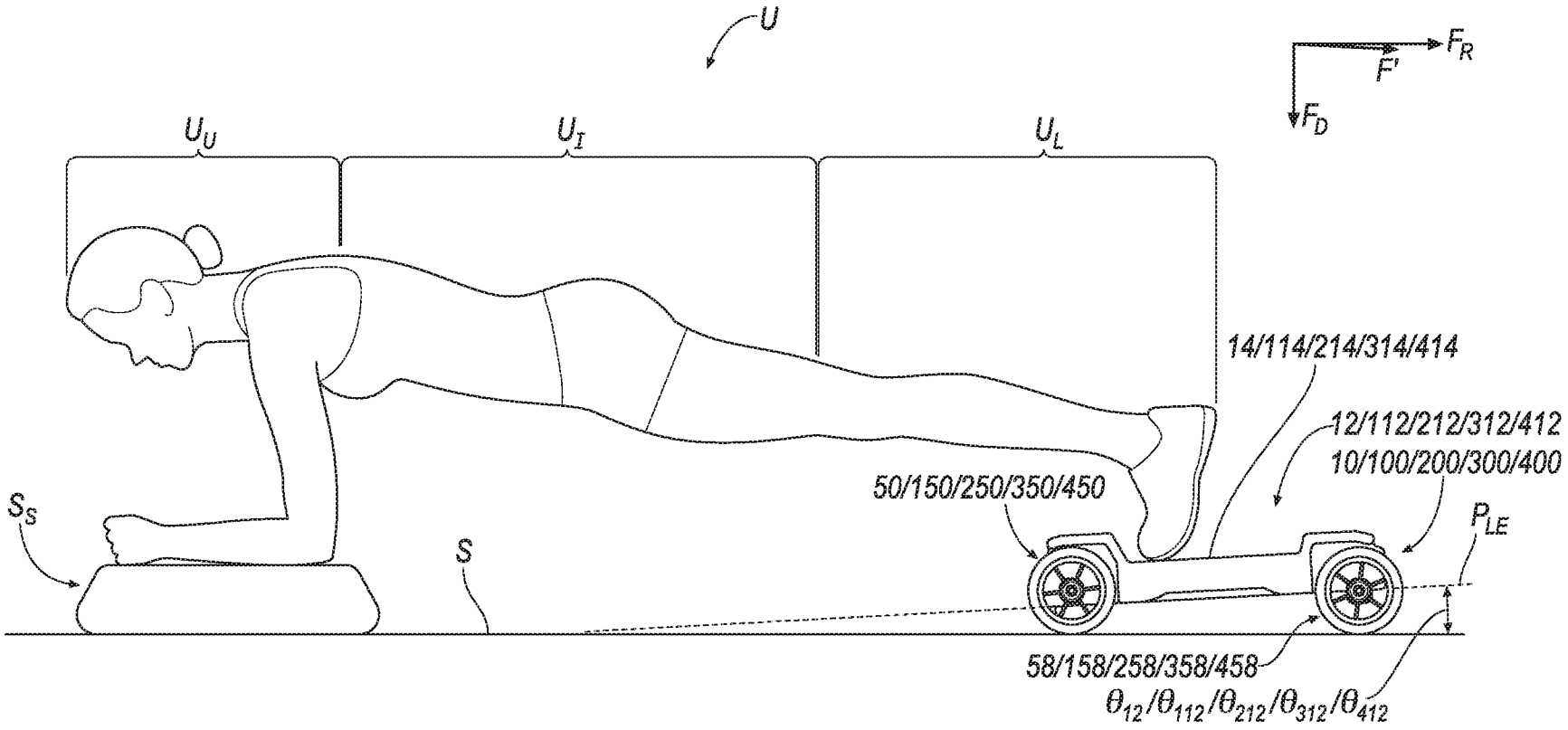
Figure 29:
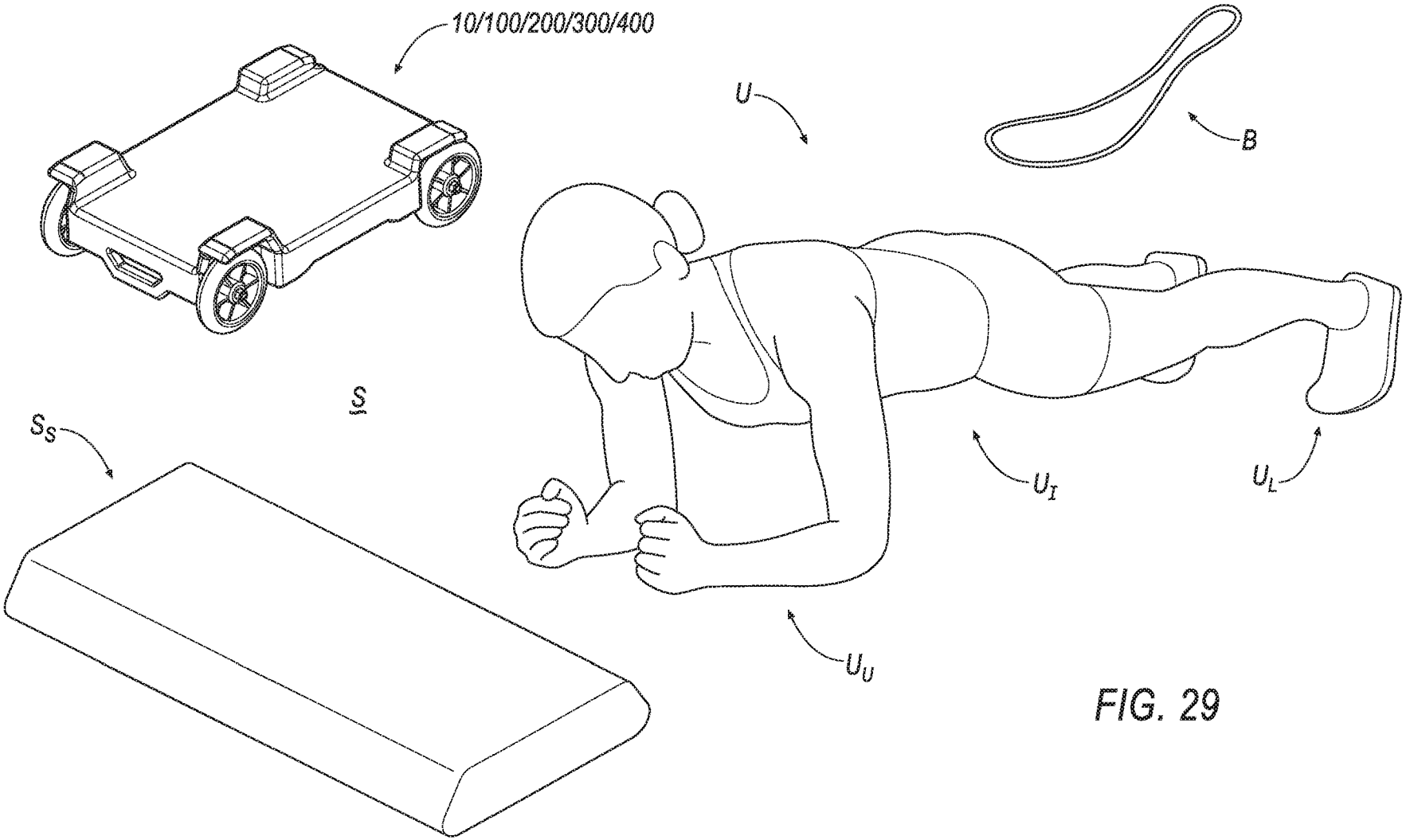
FIG. 29 is a perspective view of the user, an optional exercise step, and any of the exercise assemblies of FIGS. 1-19.

Referring to FIG. 29, a plank exercise pose generally includes the user U arranging his/her hands, wrists, forearms and elbows that define portions of the upper body region $U_U$ of the user U adjacent an underlying support surface S or underlying support member $S_S$ (see also FIGS. 27A-27E and 28A-28E), which may be an exercise step that is supported by the underlying support surface S. The plank exercise pose of FIGS. 27A, 27E, 28A, 28E, and 29 may also include the user U arranging his/her feet or toes that define portions of the lower body or foot region $U_L$ of the user U adjacent an underlying support surface S or underlying support member (see also FIGS. 27A, 27E, 28A, and 28E whereby the underlying support member is the assembly 10/100/200/300/400).

With reference to FIGS. 27A-27E and 28A-28E, the user U is shown utilizing any of the exemplary assemblies 10, 200, 300, and 400. Regions of the user U are generally defined by an upper body or arm region $U_U$, an intermediate or core region $U_I$ and a lower body region $U_L$. The lower body region $U_L$ includes one or more of the user's leg(s), knee(s) and/or foot/feet.

In some instances as seen at FIGS. 27A-27E and 28A-28E, the lower body region $U_L$ of the user U includes one or more of the metatarsal regions and phalanges regions of the user's foot. Furthermore, as seen at FIGS. 27A-27E and 28A-28E, any of the exemplary assemblies 10/100/200/300/400 does not include straps, belts, or the like to secure the user's lower body or foot region $U_L$ adjacent the upper surface 14/114/214/314/414 of the body 12/112/212/312/412 (i.e., the user U may elect to freely remove himself/herself from the upper surface 14/114/214/314/414 of the body 12/112/212/312/412 at any time during the exercise routine); accordingly, the user U may quickly and easily dismount from the assembly 10/100/200/300/400 at any time during the course of an exercise routine without having to pause the exercise routine in order to unlatch/unstrap/unbuckle himself or herself from the assembly 10/100/200/300/400.

As seen in FIGS. 27A and 27E & 28A and 28E, the user U is arranged in what is traditionally referred to as a "plank" exercise pose, which may be alternatively referred to as a "front hold" exercise pose, a "hover" exercise pose, or an "abdominal bridge" exercise pose. As also seen at FIG. 29, a plank exercise pose generally includes the user U arranging his/her hands, wrists, forearms and elbows that define portions of the upper body region $U_U$ of the user U adjacent an underlying support surface S or underlying support member $S_S$ (see also FIGS. 27A, 27E, 28A, and 28E), which may be an exercise step that is supported by the underlying support surface S. The plank exercise pose of FIGS. 27A, 27E, 28A, 28E, and 29 may also include the user U arranging his/her feet or toes that define portions of the lower body or foot region $U_L$ of the user U adjacent an underlying support surface S or underlying support member (see also FIGS. 27A and 27E & 28A and 28E whereby the underlying support member is the assembly 10/100/200/300/400).

With reference to FIGS. 27A-27E, 28A-28E, and 29, a variety of exercises poses or exercise routines are now described. In an example, as seen at FIG. 29, during the course of a user's exercise routine, the user U may elect to assume a "static" plank exercise pose without utilizing, for example, one or both of the assembly 10/100/200/300/400 and the exercise step $S_S$. When a static plank pose is assumed by the user U, the user's lower body or foot region $U_L$ is generally immobilized with respect to the underlying support surface S. However, as seen at FIGS. 27A-27E and 28A-28E, the user U may wish to supplement or avoid the static plank exercise pose with a "dynamic" plank exercise pose by utilizing the assembly 10/100/200/300/400 that is movably-disposed upon the underlying support surface S. Accordingly, as seen at FIGS. 27A-27E and 28A-28E, the assembly 10/100/200/300/400 permits the user to mobilize the user's lower body or foot region $U_L$ as a result of the user U urging (with a first force F or a second force F' that is opposite the first force F) the assembly 10/100/200/300/400 in a first direction D and a second D' that is opposite the first direction D. As a result, the dynamic plank exercise pose permits the user U to exercise or work a plurality of regions of the user's abdomen or core and legs.

Referring to FIGS. 27A-27E and 28A-28E, exemplary views of the user U utilizing the assembly 10/100/200/300/400 is described in order to permit the user U to execute a plurality of movements defining the dynamic plank exercise pose. The first front wheel 46/146/246/346/446, the second front wheel 50/150/250/350/450, the first rear wheel 54/154/254/354/454, and the second rear wheel 58/158/258/358/458 (hereinafter, "the plurality of wheels") are shown disposed upon the underlying support surface S; furthermore, each wheel of the plurality of wheels is defined by a similar diameter. Because the plane $P_{38}/P_{138}/P_{238}/P_{338}/P_{438}$ that is tangent to a top portion of each front axle-receiving opening 38/138/238/338/438 is not co-planar with the plane $P_{42}/P_{142}/P_{242}/P_{342}/P_{442}$ that is tangent to a bottom portion of each rear axle-receiving opening 42/142/242/342/442 as described above, the upper surface 14/114/214/314/414 of the body 12/112/212/312/412 is pitched at the angle $\theta_{12}/\theta_{112}/\theta_{212}/\theta_{312}/\theta_{412}$ with respect to the underlying support surface S.

As seen in FIGS. 27A-27E and 28A-28E, the user U disposes a portion of his/her lower body or foot region $U_L$ adjacent the upper surface 14/114/214/314/414 of the body 12/112/212/312/412. Although FIGS. 27A-27E and 28A-28E illustrate the user's foot disposed adjacent the upper surface 14/114/214/314/414 of the body 12/112/212/312/412, the user U may alternative dispose his/her knees adjacent the upper surface 14/114/214/314/414 of the body 12/112/212/312/412. As seen at FIGS. 27A-27E and 28A-28E, the assembly 10/100/200/300/400 does not include straps, bands, or the like to secure the portion of the user's lower body or foot region $U_L$ adjacent the upper surface 14/114/214/314/414 of the body 12/112/212/312/412 (i.e., the user U may elect to freely remove himself/herself from the upper surface 14 of the body 12/112/212/312/412 at any time during the exercise routine); accordingly, the user U may quickly and easily dismount from the assembly 10/100/200/300/400 at any time during the course of an exercise routine without having to pause the exercise routine in order to unlatch/unstrap/unbuckle himself or herself from the assembly 10/100/200/300/400.

Referring to FIGS. 27A and 27B & 28A and 28B, in some instances, one or more of the metatarsal regions and phalanges regions of the user's foot applies a first or forward force F to the upper surface 14/114/214/314/414 of the body 12/112/212/312/412. In order to cause rotation of the plurality of wheels in the first/rearward direction D, the first or rearward force F applied to the upper surface 14/114/214/314/414 of the body 12/112/212/312/412 includes a downward force component $F_D$ and a forward force component $F_F$. The downward force component $F_D$ may be substantially perpendicular to the underlying support surface S. The forward force component $F_F$ may be parallel to the underlying support surface S.

Although the upper surface 14/114/214/314/414 of the body 12/112/212/312/412 is pitched at the angle $\theta_{12}/\theta_{112}/\theta_{212}/\theta_{312}/\theta_{412}$ with respect to the underlying support surface S, the downward force component $F_D$ applied to the upper surface 14/114/214/314/414 may be greater than the forward force component $F_F$ as the user U applies the first or forward force F to the upper surface 14/114/214/314/414 of the body 12/112/212/312/412 for urging the body 12/112/212/312/412 in the first/forward direction D such that the portion of the user's lower body or foot region $U_L$ remains adjacent the upper surface 14/114/214/314/414 of the body 12/112/212/

312/412 and therefore is not dislodged or removed therefore during the course of movement in the first/forward direction D. Furthermore, the frictional surface pattern or frictional material applied to the upper surface 14/114/214/314/414 of the body 12/112/212/312/412 may resist the portion of the lower body or foot region $U_L$ of the user U from slipping or sliding off of the upper surface 14/114/214/314/414 of the body 12/112/212/312/412 as the user U urges the body 12/112/212/312/412 in the second/forward direction D'.

Figure 27A:
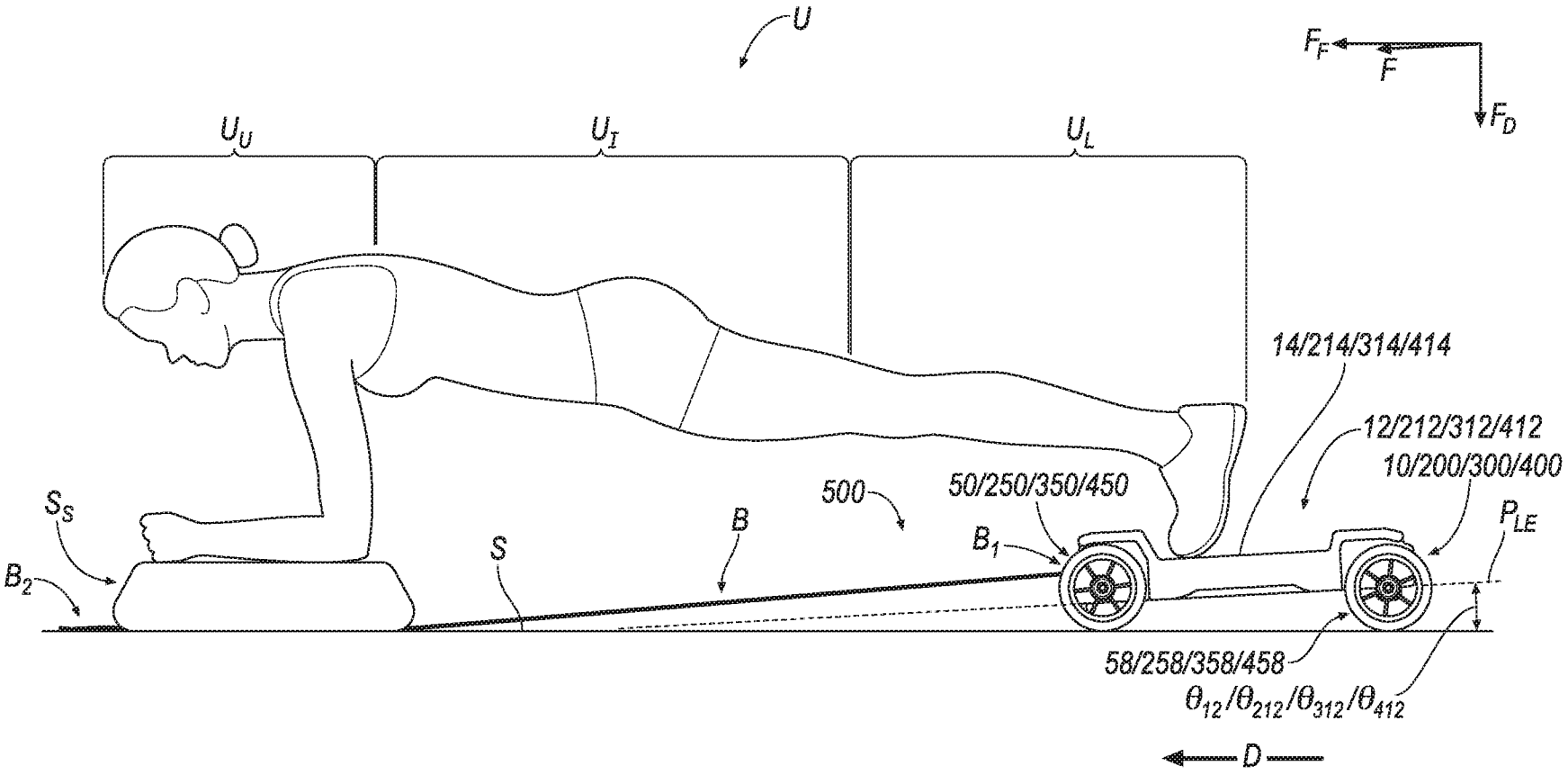
FIGS. 27A-27E are side views of a user utilizing any of the exercise systems of FIGS. 22-24.
Figure 27B:
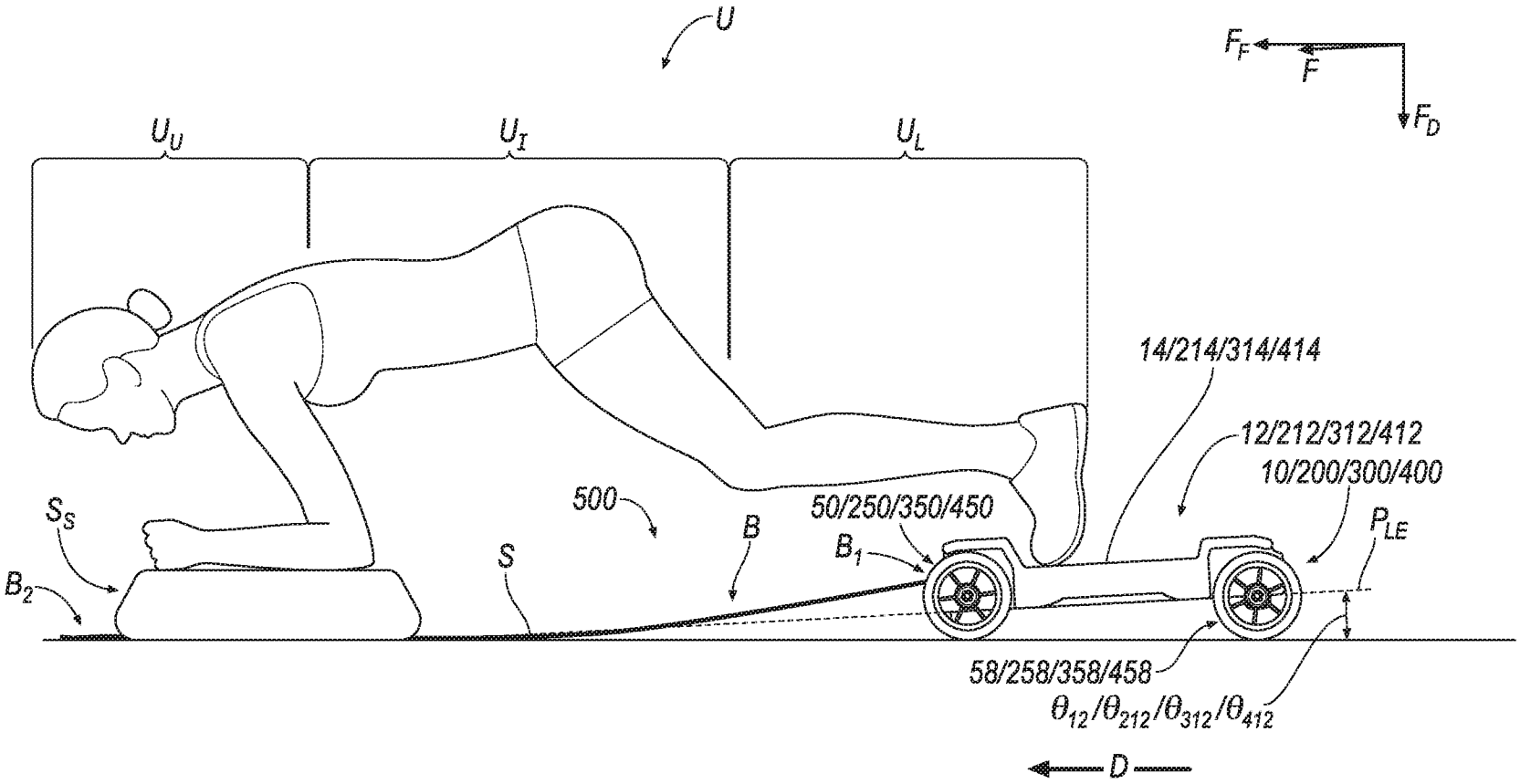
Figure 27C:
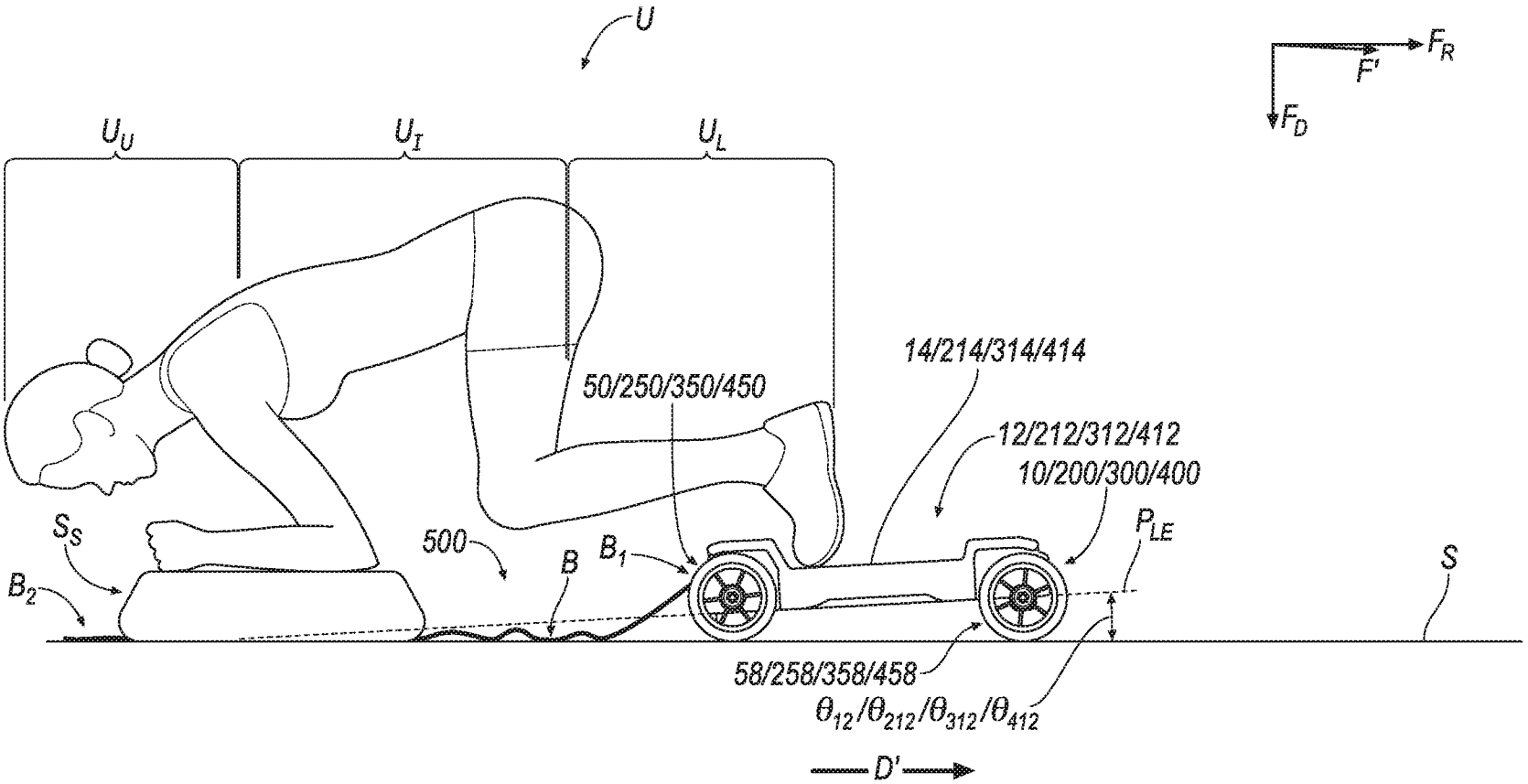

As a result of applying the first or forward force F, the assembly 10/100/200/300/400 movably-transports the user's lower body or foot region $U_L$ in a direction toward the user's upper body or arm region $U_U$ such that user's intermediate or core region $U_1$ is firstly arranged in a "partial plank crunch" orientation (see, e.g., FIGS. 27B and 28B) from a "selectively static plank" orientation (see, e.g., FIGS. 27A and 28A) and then subsequently in a "full plank crunch" orientation (see, e.g., FIGS. 27C and 28C). Once the user U has arranged his/her body in the "full plank crunch" orientation as seen at FIGS. 27C and 28C (or, alternatively, if the user U wishes to cease advancement of the lower body or foot region $U_L$ in order to remain arranged in the "partial plank crunch" orientation), the user U may cease application of the first or forward force F.

Thereafter, as seen at FIGS. 27C and 27D & 28C and 28D, one or more of the metatarsal regions and phalanges regions of the user's foot applies a second or rearward force F' to the upper surface 14/114/214/314/414 of the body 12/112/212/312/412 in order to cause rotation of the plurality of wheels in the second/rearward direction D'. The second or rearward force F' applied to the upper surface 14/114/214/314/414 of the body 12/112/212/312/412 includes the downward force component $F_D$ and a rearward force component $F_R$. The downward force component $F_D$ may be substantially perpendicular to the underlying support surface S. The rearward force component $F_R$ may be parallel to the underlying support surface S. As a result of the upper surface 14/114/214/314/414 of the body 12/112/212/312/412 being pitched at the angle $\theta_{12}/\theta_{112}/\theta_{212}/\theta_{312}/\theta_{412}$ with respect to the underlying support surface S, the upper surface 14/114/214/314/414 provides a biasing surface that supports one or more of the metatarsal regions and phalanges regions of the user's foot as the user U applies the second or rearward force F' to the upper surface 14/114/214/314/414 of the body 12/112/212/312/412 for urging the body 12/112/212/312/412 in the second/rearward direction D'.

Figure 27D:
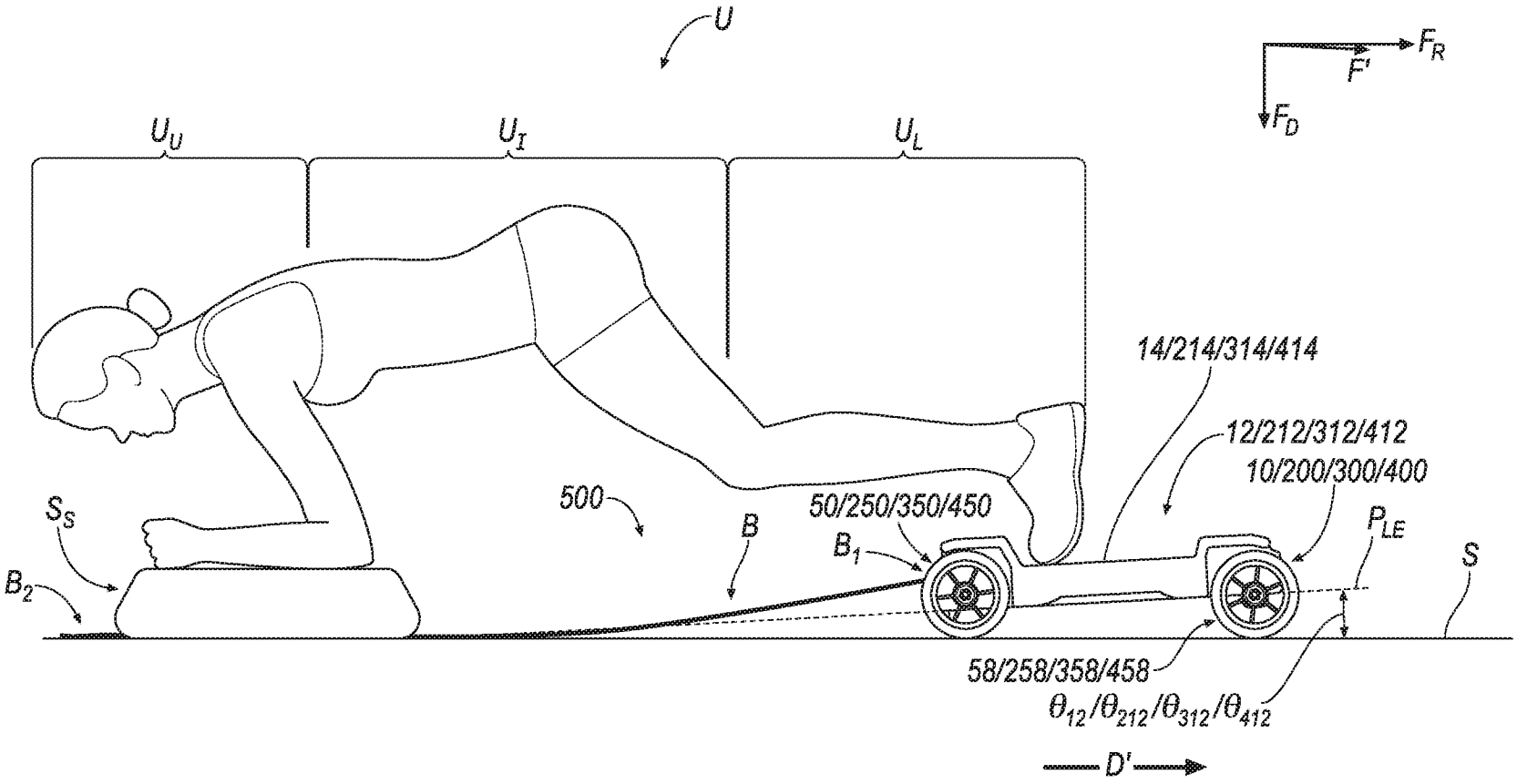
Figure 27E:
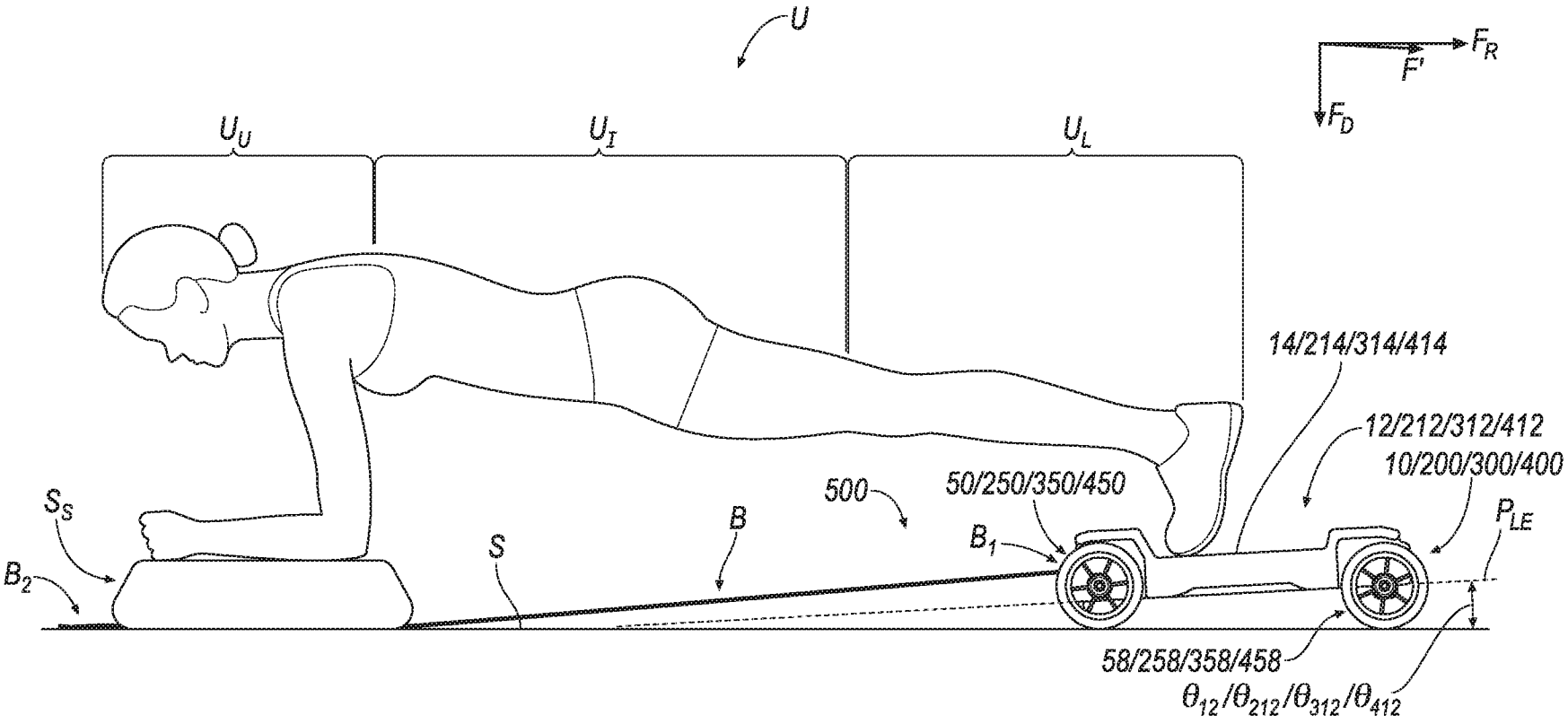

As a result of applying the second or rearward force F', the assembly 10/100/200/300/400 movably-transports the user's lower body or foot region $U_L$ in a direction away from the user's upper body or arm region $U_U$ such that user's intermediate or core region $U_I$ is returned from, for example, the "full plank crunch" orientation (of FIGS. 27C and 28C) to the "partial plank crunch" orientation (see, e.g., FIGS. 27D and 28D). Thereafter, the user U may continue to apply the second or rearward force F' such that the assembly 10/100/200/300/400 movably-transports the user's lower body or foot region $U_L$ in a direction further away from the user's upper body or arm region $U_U$ such that user's intermediate or core region $U_I$ is returned to the "selectively static plank" orientation (see, e.g., FIGS. 27E and 28E) from the "partial plank crunch" orientation of FIGS. 27D and 28D.

A number of implementations have been described. Nevertheless, it will be understood that various modifications may be made without departing from the spirit and scope of the disclosure. Accordingly, other implementations are within the scope of the following claims.

What is claimed is:

1. An assembly that is movably-disposed upon an underlying support surface, the assembly comprising:

a body including an upper surface, a lower surface, a front edge, a rear edge, a first side edge that connects the front edge to the rear edge, and a second side edge that connects the front edge to the rear edge, wherein the body is define by a length extending between the front edge and the rear edge and by a width extending between the first side edge and the second side edge, wherein the body defines a pair of front axle-receiving openings and a pair of rear axle-receiving openings;

a plurality of sidewall flanges extending from the lower surface of the body and including (i) a front flange and a rear flange each extending between the first side edge and the second side edge, (ii) a first sidewall flange and a second sidewall flange each extending between the front edge and the rear edge, wherein each of the first sidewall flange and the second sidewall flange defines a front longitudinal portion defining a front axle-receiving opening of the pair of front axle-receiving openings and a rear longitudinal portion defining an axle-receiving projection that extends from a portion of a lower edge of each of the first sidewall flange and the second sidewall flange, wherein each axle-receiving projection at least partially defines a rear axle-receiving opening of the pair of rear axle-receiving openings;

a front axle member extending through the pair of front axle-receiving openings;

a rear axle member extending through the pair of rear axle-receiving openings;

a first front wheel connected to a first end of the front axle member;

a second front wheel connected to a second end of the front axle member;

a first rear wheel connected to a first end of the rear axle member; and a second rear wheel connected to a second end of the rear axle member, wherein the upper surface of the body is pitched at an angle with respect to the underlying support surface.

2. The assembly of claim 1, wherein the upper surface of the body includes a frictional surface.

3. The assembly of claim 2, wherein the frictional surface is a layer of material attached to the upper surface of the body.

4. The assembly of claim 3, wherein the layer of material is a rubber material, wherein the body is defined by a plastic material or a metallic material.

5. The assembly of claim 2, wherein the frictional surface is integrally formed by the upper surface of the body.

6. The assembly of claim 1 further comprising:

one or more wheel rotation resistance devices adjustably-connected to the body, wherein each wheel rotation resistance device of the one or more wheel rotation resistance devices includes a tread-engaging portion.

7. The assembly of claim 6, wherein the tread-engaging portion is defined by:

a head portion that is movably-arranged opposite a portion of a tread surface of one of the first front wheel, the second front wheel, the first rear wheel, and the second rear wheel.

8. The assembly of claim 7, wherein the tread-engaging portion is further defined by:

a flange portion extending from the lower surface of the body, wherein the flange portion extends at least partially across the head portion, wherein the flange portion is arranged between the head portion and the portion of the tread surface of one of the first front wheel, the second front wheel, the first rear wheel, and the second rear wheel.

9. The assembly of claim 1, wherein one or more of the plurality of sidewall flanges defines one or more of a handle or an opening.

10. The assembly of claim 9 further comprising a hook extending away from the lower surface of the body, wherein the hook is arranged opposite the opening, wherein the hook is sized for removably-securing a first end of a resistance band.

11. The assembly of claim 1, further comprising at least two wheel rotation resistance devices including:

a first tread-engaging portion having a first head portion that is movably-arranged directly opposite a portion of a tread surface of the first front wheel; and a second tread-engaging portion having second head portion that is movably-arranged directly opposite a portion of a tread surface of the second front wheel.

12. The assembly of claim 11, wherein the at least two wheel rotation resistance devices further includes:

a third tread-engaging portion having a third head portion that is movably-arranged directly opposite a portion of a tread surface of the first rear wheel; and a fourth tread-engaging portion having a fourth head portion that is movably-arranged directly opposite a portion of a tread surface of the second rear wheel.

13. The assembly of claim 1 further comprising at least two wheel rotation resistance devices including:

a first tread-engaging portion having a first head portion that is movably-arranged opposite a portion of a tread surface of the first front wheel and a first flange portion that extends between the first front wheel and the first head portion; and a second tread-engaging portion having a second head portion that is movably-arranged opposite a portion of a tread surface of the second front wheel and a second flange portion that extends between the second front wheel and the second head portion.

14. The assembly of claim 13, wherein the two or more wheel rotation resistance devices further includes:

a third tread-engaging portion having a third head portion that is movably-arranged opposite a portion of a tread surface of the first rear wheel, and a third flange portion that extends between the first rear wheel and the third head portion; and a fourth tread-engaging portion having a fourth head portion that is movably-arranged opposite a portion of a tread surface of the second rear wheel, and a fourth flange portion that extends between the second rear wheel and the fourth head portion.

15. An exercise system comprising:

the assembly of claim 1; and a resistance band having a first end and a second end, wherein the first end of the resistance band is removably-secured to the assembly.

16. The exercise system of claim 15, wherein one or more of the plurality of sidewall flanges of the assembly defines a handle, wherein the first end of the resistance band is removably-secured to the handle.

17. The exercise system of claim 15, wherein one or more of the plurality of sidewall flanges of the assembly defines a handle and an opening, wherein a portion of the resistance band extends through the opening, wherein the first end of the resistance band is removably-secured to the handle.

18. The exercise system of claim 15, wherein a hook extends away from the lower surface of the body, wherein one or more of the plurality of sidewall flanges of the assembly defines an opening, wherein the first end of a resistance band is removably-secured to the hook, wherein a portion of the resistance band extends through the opening, wherein the second end is arranged away from the one or more of the plurality of sidewall flanges.

19. The assembly of claim 1, wherein the length and the width defines the body to include a substantially rectangular shape.

20. The assembly of claim 1, wherein the length and the width defines the body to include a substantially square shape.

21. The assembly of claim 1, wherein the angle that the upper surface of the body is pitched with respect to the underlying support surface is provided by the pair of front axle-receiving openings being arranged above a plane extending across a lower edge of each of the first sidewall flange and the second sidewall flange and the pair of rear axle-receiving openings being arranged below the plane extending across the lower edge of each of the first sidewall flange and the second sidewall flange.

22. The assembly of claim 1, further comprising one or more wheel-covering flanges that extend from the upper surface of the body.

23. The assembly of claim 1, wherein all of the first front wheel, the second front wheel, the first rear wheel, and the second rear wheel are not caster wheels.

24. The assembly of claim 1, wherein all of the first front wheel, the second front wheel, the first rear wheel, and the second rear wheel are configured to simultaneously rotate in a first direction or a second direction, wherein the second direction is opposite the first direction.

25. The assembly of claim 1 further comprising:

a plurality of strengthening ribs extending away from the lower surface of the body.

* * * * *